US012747554B2

(12) United States Patent
Manion

(10) Patent No.: US 12,747,554 B2
(45) Date of Patent: Sep. 29, 2026

(54) SUPPORT ASSEMBLY FOR WING MOLDBOARD AND RELATED METHODS

(71) Applicant: Cives Corporation, Alpharetta, GA (US)

(72) Inventor: Leo P. Manion, Durham (CA)

(73) Assignee: CIVES CORPORATION, Alpharetta, GA (US)

( * ) Notice: Subject to any disclaimer, the term of this patent is extended or adjusted under 35 U.S.C. 154(b) by 185 days.

(21) Appl. No.: 18/734,828

(22) Filed: Jun. 5, 2024

(65) Prior Publication Data

US 2025/0376822 A1 Dec. 11, 2025

(51) Int. Cl.
*E01H 5/06* (2006.01)

(52) U.S. Cl.
CPC ..... *E01H 5/067* (2013.01)

(58) Field of Classification Search
CPC ..... E01H 5/067
See application file for complete search history.

(56) References Cited

U.S. PATENT DOCUMENTS

| | | | |
|---|---|---|---|
| 2,513,231 | A | 6/1950 | Bourne |
| 4,259,794 | A | 4/1981 | Rath |
| 4,905,387 | A | 3/1990 | Street |
| 5,027,536 | A | 7/1991 | Farrell |
| 5,079,866 | A | 1/1992 | Farrell |
| 6,050,008 | A | 4/2000 | Doornek et al. |
| 6,219,943 | B1 | 4/2001 | Kitchell |
| 6,236,141 | B1 | 5/2001 | Sato et al. |
| 6,354,025 | B1 | 3/2002 | Kirchell |
| 6,536,141 | B2 | 3/2003 | Kitchell |
| 7,367,407 | B2 | 5/2008 | Lannert |

(Continued)

FOREIGN PATENT DOCUMENTS

| | | | |
|---|---|---|---|
| FR | 2626912 A1 * | 8/1989 | ..... E01H 5/067 |
| KR | 20120134206 A | 12/2012 | |

OTHER PUBLICATIONS

Viking Cives, VCL 275 Metro Tower, Standard Features, The North American Leader in Innovative Snow & Ice Control Equipment, Sep. 25, 2017, Vertical Position, 1 Page.

(Continued)

*Primary Examiner* — Matthew R Buck
(74) *Attorney, Agent, or Firm* — Panitch Schwarze Belisario & Nadel LLP

(57) ABSTRACT

A support assembly for a wing moldboard includes a rearward base securable to a vehicle to pivot about an upright axis, lower and upper booms, a lower-boom mechanical actuator, and a rotation member. The lower boom is pivotably securable to the rearward base. The upper boom has an upper-boom proximal portion pivotably securable to a distal end portion of the lower boom. A lower-boom mechanical actuator drives the lower boom to first and second positions. A rotation member has a proximal portion configured to be operatively engaged with the rearward base, and a distal portion operatively engaged to pivot the upper boom with respect to the lower boom when the lower-boom mechanical actuator drives the lower boom between the first and second positions. A further support assembly for a moldboard includes a support-wheel assembly including a travel-angle frame, a travel-angle actuator, a spindle mount, a spindle, and a wheel-height actuator.

28 Claims, 39 Drawing Sheets

(56) References Cited

U.S. PATENT DOCUMENTS

| | | | | |
|---|---|---|---|---|
| 7,975,408 | B2 | 7/2011 | Mishra et al. | |
| 8,033,036 | B1 | 10/2011 | Turnbull | |
| 8,732,989 | B1 | 5/2014 | Turnbull | |
| 9,388,544 | B2 | 7/2016 | Reeves et al. | |
| 9,650,071 | B2 | 5/2017 | Manion et al. | |
| 9,995,012 | B2 | 6/2018 | Boumediene et al. | |
| 10,053,826 | B1 * | 8/2018 | Null | E01H 5/067 |
| 10,865,532 | B2 | 12/2020 | Kraus | |
| 11,643,839 | B2 | 5/2023 | Jackson et al. | |
| 2008/0107512 | A1 | 5/2008 | Feller | |
| 2015/0292171 | A1 * | 10/2015 | May | E01H 5/067 37/279 |

OTHER PUBLICATIONS

Viking Cives, AHW 025 Mid-Mount Hydraulic Wing, Owners Manual, VIking Cives Midwest, Inc. 28 pages.

Viking Cives, VCL 275 AHW—All Hydraulic Wing, Standard Features, The North American Leader in Innovative Snow & Ice Control Equipment, Vertical Position, Sep. 25, 2017, 1 page.

Viking Cives, VCL WHD Heavy Duty Wings, Standard Features, The North American Leader in Innovative Snow & Ice Control Equipment, 1 page.

Viking Cives, Side Wing, Standard Features, North America's Leading Innovator of Snow & Ice Control Equipment, 1 page.

Viking Cives, Mid Mount "Junior" Wing, Features, North America's Leading Innovator Of Snow & Ice Control Equipment, 1 page.

Viking Cives, VCL AHW All Hydraulic Wing, Standard Features, The North American Leader in Innovative Snow & Ice Control Equipment, 1 page.

Viking Cives, VCL 350 Metro Tower, Standard Features, The North American Leader in Innovative Snow & Ice Control Equipment, Sep. 25, 2017, 1 page.

Viking Cives, VCL 350 SCL Cable Tower, Standard Features, The North American Leader in Innovative Snow & Ice Control Equipment, Sep. 25, 2017, 1 page.

Viking Cives, VCL 350 AHW—All Hydraulic Wing, Standard Features, The North American Leader in Innovative Snow & Ice Control Equipment, Sep. 25, 2017, 1 page.

Viking Cives, VCU Heavy Duty Wing—Owner's Manual, 8 pages.

Office Action mailed May 5, 2026 in corresponding U.S. Appl. No. 18/734,849, 10 pages.

* cited by examiner

SUPPORT ASSEMBLY FOR WING MOLDBOARD AND RELATED METHODS

BACKGROUND

The present disclosure relates to the field of plows, including snowplows, and particularly relates to a support assembly for a wing moldboard, along with related methods.

Various types of plows are configured for attachment to a vehicle, such as a motorized vehicle or a trailer. A general class of device used for plowing, including but not limited to snow plowing, is a moldboard. A wing moldboard is a specific type of moldboard configured to be mounted to a vehicle and to extend to a side of the vehicle, to help clear or drive snow or other material that is located to the side of a path of travel of the vehicle. The wing moldboard is attached to the vehicle via a support assembly. The support assembly may allow the moldboard to be positioned under operator control into one or more storage positions or one or more working positions, with the operator controlling the operation of a hydraulic cylinder, mechanical actuator, or other device configured to exert force upon the support assembly and thereby to control the movement of the wing moldboard.

The support assembly may also be configured to allow the wing moldboard to take on working positions in contact with or close to a ground surface, and to take on raised working positions called "benching" positions for pushing back material, wherein a bottom edge of the moldboard is supported above the ground surface so that the moldboard may push an upper portion of a pile of material, such as a pile of previously plowed snow, soil, or other material. In a storage position, the wing moldboard is pivoted close to the body or frame of the vehicle and is disposed parallel or relatively close to parallel to a side of the vehicle. In the storage position, the wing moldboard may be raised above the ground surface to avoid contact with the ground surface, to avoid contact with the front wheels of the vehicle, or for other purposes.

Existing support assemblies for a wing moldboard may be difficult for an operator to use without causing unwanted contact between the wing moldboard and various vehicle elements such as the side of the vehicle, mirrors mounted on the doors of the vehicle, and the front tires on the vehicle (particularly during turning) when the wing moldboard is in a storage position. Existing support assemblies may require an operator of the vehicle and the attached wing moldboard to coordinate movements of the support assembly using separate manual control inputs to control multiple hydraulic cylinders or other actuators to avoid unwanted contact with the above-mentioned vehicle elements.

For example, to avoid such unwanted contact, the operator may need to separately control a front support mechanism secured near a front portion of the wing moldboard, a travel-positioner mechanism which controls movement of the wing moldboard between a working position and a storage position, and a rear support mechanism secured near a rear portion of the wing moldboard. With such prior mechanisms, moving the wing moldboard from a working position to a storage position, without causing unwanted contact, requires that the operator perform the following steps First, the front support mechanism must be activated to raise the front portion of the wing moldboard about 3 feet about the ground. Second, the rear support mechanism must be activated to set the rear portion of the wing moldboard about 3 feet above the ground. Third, the travel-positioner mechanism must be activated to retract the wing moldboard toward the vehicle. Movement of the travel-positioner mechanism will change the balance of the wing moldboard, causing the rear portion of the wing moldboard to drop toward the ground. Fourth, the rear support mechanism must be activated to lift the rear portion of the wing moldboard and to retract the rear portion of the wing moldboard toward the truck. This process requires both operator skill and time to retract the wing moldboard to a desired storage position without unwanted contact with any part of the vehicle. The wing moldboard must be carried at a sufficient height to avoid contact with the front wheel of the vehicle during turns, but sufficiently now to avoid contact with side mirrors located on the door of the vehicle. The necessary coordination may make it difficult for an operator to avoid unwanted contact while accomplishing other purposes, such as efficient movement or rapid movement of the wing moldboard to a storage position or other raised position during an emergency situation, which may require rapid withdrawal of the wing moldboard from the area being plowed.

The present disclosure includes support assemblies for attaching a wing moldboard to a vehicle. The present disclosure also includes a support-wheel assembly for a moldboard. The support-wheel assembly may be employed to attach a wheel to a moldboard to support the moldboard when the moldboard is positioned close to a ground surface. The support-wheel assembly may allow control of an angle of the support wheel with respect to the moldboard and the direction of motion of the moldboard. The support-wheel assembly may also allow control of a vertical position of a wheel attached to the moldboard; the wheel may be positioned vertically to control an operating height of the moldboard with respect to the ground surface.

BRIEF SUMMARY OF THE DISCLOSURE

Briefly stated, one aspect of the present disclosure is directed to a support assembly for a wing moldboard. The support assembly includes a rearward base configured to be secured to a vehicle to pivot with respect to the vehicle about an upright axis. A lower boom has a proximal end portion and a distal end portion. The proximal end portion is configured to be secured to the rearward base to pivot with respect thereto about a lower-boom pivoting axis, with the lower-boom pivoting axis being horizontal. The lower boom is configured to extend outwardly with respect to the vehicle and upwardly with respect to the rearward base so that the distal end portion is located above the proximal end portion. An upper boom has an upper-boom proximal portion and an upper-boom distal portion. The upper-boom proximal portion is configured to be secured to the distal end portion of the lower boom to pivot the upper boom with respect to the lower boom about an upper-boom pivoting axis, the upper-boom pivoting axis being at least generally horizontal. The upper-boom distal portion extends at least partially downwardly from the distal end portion of the lower boom. A lower-boom mechanical actuator is configured to be operatively connected to the lower boom to drive the lower boom between a first lower-boom position with a distal end of the lower boom displaced a first horizontal distance from the rearward base, and a second lower-boom position with the distal end of the lower boom displaced a second horizontal distance from the rearward base, with the second horizontal distance being greater than the first horizontal distance. A rotation member has a rotation-member proximal portion and a rotation-member distal portion, the rotation-member proximal portion being configured to be operatively engaged with—for example, pivotably attached to—the rearward base, and the rotation-member distal portion being configured to be operatively engaged with—for example, pivotably attached to—the upper boom to pivot the upper boom with respect to the lower boom when the lower-boom mechanical actuator drives the lower boom between the first lower-boom position and the second lower-boom position.

In any embodiment of the support assembly, the wing moldboard may be adapted for plowing snow.

In any embodiment of the support assembly, the lower-boom mechanical actuator may comprise a hydraulic cylinder.

In any embodiment of the support assembly, the rotation member may have a rotation-member length and the rotation member may further comprise a rotation-member mechanical actuator configured to extend and contract the rotation-member length.

In any embodiment of the support assembly, the rotation-member mechanical actuator may comprise a hydraulic cylinder.

In any embodiment of the support assembly, the lower-boom mechanical actuator may comprise a hydraulic cylinder.

In any embodiment of the support assembly, the upper boom may have a pivot arm projecting at least partially toward the vehicle and operatively engaged with the rotation-member distal end portion.

In any embodiment of the support assembly, the wing moldboard may have a forward portion, a rearward portion, and a lower edge, with the rearward portion being supported by the upper-boom distal portion.

In any embodiment of the support assembly, the support assembly may have a ground-proximity configuration wherein the lower edge of the wing moldboard is placed either in contact with a level-ground surface or less than about 1 foot distance above the level-ground surface, and a storage configuration wherein the lower edge of the wing moldboard is placed between ground level and 40 inches above the level-ground surface and aligned with a body of the vehicle (and may be within 2 feet, 1 foot, or half a foot, or a lesser distance of a side of the vehicle), so that the support assembly is selectively movable between the ground-proximity configuration and the storage configuration by extension and retraction of the lower-boom mechanical actuator, and a vertical position of the rearward portion of the wing moldboard is determined at least in part by a degree of extension of the lower-boom mechanical actuator.

In any embodiment of the support assembly, the support assembly may have a ground-proximity configuration wherein the lower edge of the wing moldboard is placed either in contact with the level-ground surface or less than six inches above the level-ground surface, and a storage configuration wherein the lower edge of the wing moldboard is placed between ground level and 40 inches above the level-ground surface and aligned with a body of the vehicle (and may be within 2 feet, 1, feet, or half a foot, or a lesser distance of a side of the vehicle), so that the support assembly is selectively movable between the ground-proximity configuration and the storage configuration by extension and retraction of the lower-boom mechanical actuator.

In any embodiment of the support assembly, the support assembly may have a ground-proximity configuration wherein the lower edge of the wing moldboard is placed either in contact with the level-ground surface or less six inches above the level-ground surface, and a benching configuration wherein the lower edge of the wing moldboard is placed at least six inches above the level-ground surface.

In any embodiment of the support assembly may have a ground-proximity configuration wherein the lower edge of the wing moldboard is placed either in contact with the level-ground surface or less than about 1 foot, six inches, three inches, or another selected distance above the level-ground surface, and a benching configuration wherein the lower edge of the wing moldboard is placed at least 1 foot, 2 feet, 3 feet, or a greater distance above the level-ground surface, and wherein the rotation radius in the ground-proximity configuration is greater than the rotation radius in the benching configuration, so that the support assembly is selectively movable between the ground-proximity configuration and the benching configuration by extension and retraction of the rotation-member mechanical actuator.

In any embodiment of the support assembly, the support assembly may further comprise a central leveling link operatively engaged with—for example, pivotably attached to—the lower boom. A moldboard-support link may be operatively engaged with—for example, pivotably attached to—the upper-boom distal portion of the upper boom, and the moldboard-support link may be configured to engage and support the moldboard to pivot with the moldboard-support link. An outer leveling link may have an outer-leveling-link proximal portion and an outer-leveling-link distal portion, the outer-leveling-link proximal portion being configured to be operatively engaged with—for example, pivotably attached to—a first portion of the central leveling link, and the outer-leveling-link distal portion being configured to be operatively engaged with—for example, pivotably attached to—the moldboard-support link. An inner leveling link may have an inner-leveling-link proximal portion and an inner-leveling-link distal portion, the inner-leveling-link proximal portion being configured to be operatively engaged with—for example, pivotably attached to—the rearward base. The inner-leveling-link distal portion may be configured to be operatively engaged with—for example, pivotably attached to—the a second portion of the central leveling link. The inner leveling link, the central leveling link, and the outer leveling link may be configured to pivot the moldboard-support link with respect to the lower boom when the lower-boom mechanical actuator drives the lower boom between the first lower-boom position and the second lower-boom position, so that the moldboard-support link maintains a selected angular orientation of the moldboard during motion of the lower boom.

In any embodiment of the support assembly, the support assembly may further comprise a forward moldboard-support assembly including a forward hinge mount movable from a first height to a second height. A forward moldboard hinge may be operatively connected to the forward hinge mount.

In any embodiment of the support assembly, the forward moldboard hinge may include a proximal leaf element configured to be operatively connected to the forward hinge mount. A distal leaf element may be configured to be operatively connected to the proximal leaf element and to the wing moldboard.

Any embodiment of the support assembly may be included in a plowing system comprising a vehicle; a wing moldboard operatively connected to the vehicle; and the support assembly. The support assembly is operatively connected to both the vehicle and the wing moldboard, thereby operatively connecting the wing moldboard to the vehicle. The support assembly may include a forward moldboard-support assembly.

In any embodiment of the support assembly, the forward moldboard-support assembly may include a forward hinge mount movable from a first height to a second height. A forward moldboard hinge may be operatively connected to the forward hinge mount. The forward moldboard hinge may include a proximal leaf element configured to be operatively connected to the forward hinge mount. A distal leaf element may be configured to be operatively connected to the proximal leaf element and to the wing moldboard.

A plowing system may include a vehicle, a wing moldboard operatively connected to the vehicle, and any embodiment of a support assembly disclosed herein. The support assembly may be operatively connected to both the vehicle and the wing moldboard, thereby operatively connecting the wing moldboard to the vehicle.

In any embodiment of the support assembly, a support-wheel assembly may be provided for mounting to a moldboard, including a wing moldboard. A frame base is fixed to the moldboard.

A travel-angle frame is attached to the frame base to pivot with respect to the moldboard about a travel-angle axis. A travel-angle actuator is configured to pivot the travel-angle frame with respect to the frame base. A spindle is mounted upon the travel-angle frame. A wheel is rotatably mounted upon the spindle.

In any embodiment of the support-wheel assembly, the travel-angle frame may comprise a travel-angle-actuator anchor configured to engage a distal end of the travel-angle actuator. A spindle mount may be provided for operatively engaging the spindle, the spindle mount being non-rotatably attached with respect to the travel-angle frame to rotate therewith about the travel-angle axis. The travel-angle actuator may be configured to drive the travel-angle frame to adjust a travel angle of the wheel.

In any embodiment of the support-wheel assembly, the travel-angle actuator may be a cylinder.

In any embodiment of the support-wheel assembly, a proximal end of the travel-angle actuator may engage a proximal anchor, the proximal anchor being operatively connected to the moldboard.

In any embodiment of the support-wheel assembly, the support-wheel assembly may further comprise a wheel-height actuator configured to move the wheel vertically with respect to the travel-angle frame and thereby to position the wheel at a selected vertical position with respect to the moldboard.

In any embodiment of the support-wheel assembly, the support-wheel assembly may further comprise a spindle arm operatively connected to the spindle. The spindle arm may define a spindle portion including the spindle, an intermediate portion extending transversely from the spindle portion, and a mounting portion extending transversely from the intermediate portion. The spindle arm may be pivotably mounted in the spindle mount. The wheel-height actuator may be configured to pivot the spindle arm about the spindle mount, rotating the spindle portion of the spindle arm to position the wheel at the selected vertical position.

In any embodiment of the support-wheel assembly, the wheel-height actuator may include a cylinder.

In certain embodiments of the support-wheel assembly, the support-wheel assembly may further comprise a crank arm extending transversely from the spindle arm, the crank arm having a crank-arm anchor configured to engage a distal end of the wheel-height actuator.

In certain embodiments of the support-wheel assembly, a proximal end of the wheel-height actuator engages a wheel-height anchor operatively connected to the travel-angle frame.

In certain embodiments, a plowing system may comprise a vehicle; a moldboard operatively connected to the vehicle, the moldboard having a wheel-engaging configuration wherein a lower edge of moldboard is placed less than about 18 inches above a level-ground surface; and the support-wheel assembly as disclosed herein. The support assembly may be operatively connected to the moldboard to support the moldboard when the moldboard is in the wheel-engaging configuration.

BRIEF DESCRIPTION OF THE SEVERAL VIEWS OF THE DRAWINGS

The following detailed description of the embodiments of the disclosure will be better understood when read in conjunction with the appended drawings. For the purpose of illustration, what is shown in the drawings are exemplary embodiments; however, the disclosed snowplow is not limited to the arrangements and instrumentalities shown.

In the drawings.

DETAILED DESCRIPTION

Figure 1:
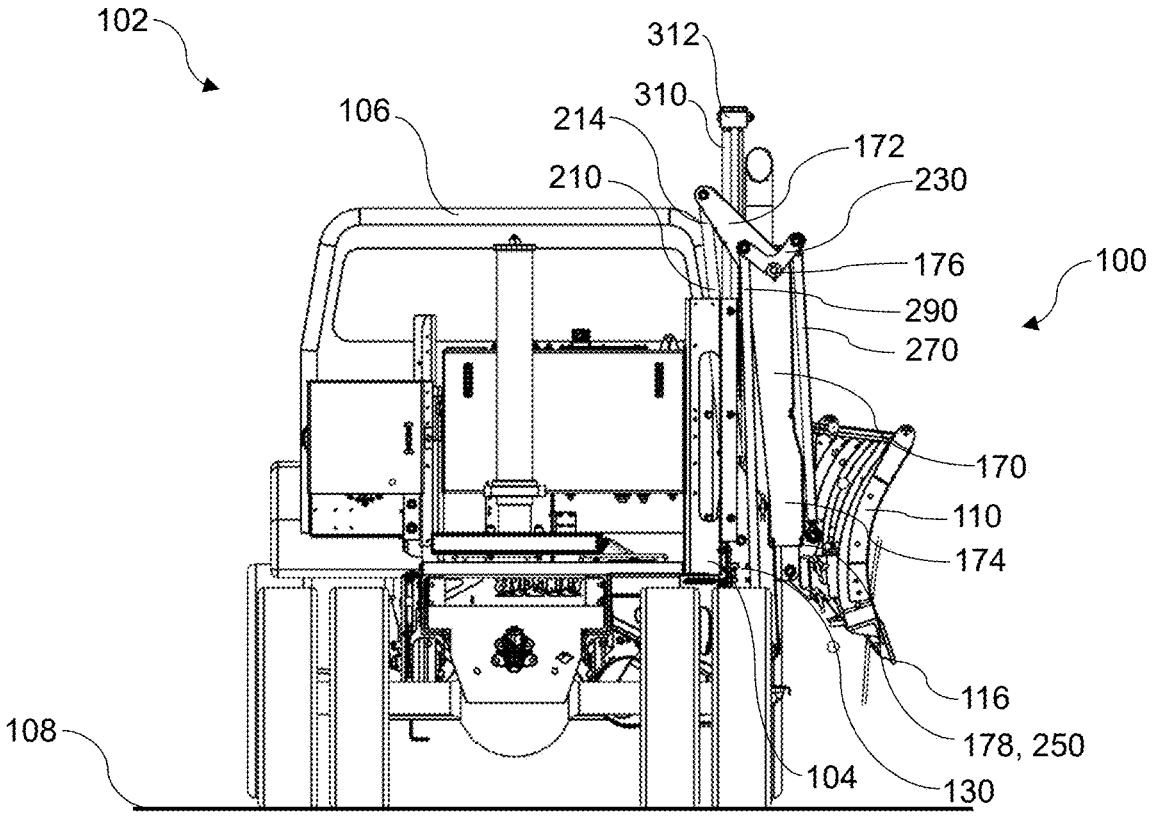
FIG. 1 is a rear elevational view of a support assembly including a wing moldboard, all according to the present disclosure, in a mounted configuration on a vehicle, with the wing moldboard in a storage position.

Reference will now be made in detail to exemplary embodiments of the disclosed snowplow, examples of which are illustrated in the accompanying drawings. The terminology used in the description provided herein is for the purpose of describing the particular embodiment only and is not intended to be limiting.

As used herein, the singular forms "a" and "an" and "the" are intended to include the plural forms as well, unless the context clearly indicates otherwise. The words "and/or" as used herein refers to and encompasses any and all possible combinations of one or more of the associated listed items. The words "comprises" and/or "comprising," when used herein, specify the presence of the stated features, integers, steps, operations, elements, components, and/or groups, but do not preclude the presence or addition of one or more other features, integers, steps, operations, elements, components, and/or groups thereof.

It should also be understood that the terms "about," "approximately," "generally," "substantially" and like terms, used herein when referring to a dimension or characteristic of a component, indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

The words "right," left," "lower," "upper," "front" and "rear" designate directions in the drawings to which reference is made. The words "inwardly" and "outwardly" refer to directions toward and away from, respectively, the geometric center of the seal, and designated parts thereof. As used herein, the terms "proximal" and "distal" are relative terms referring to locations or elements that are closer to (proximal) or farther from (distal) with respect to other elements.

Although the words first, second, etc., are used herein to describe various elements, these elements should not be limited by these words. These words are only used to distinguish one element from another. For example, a first end could be termed a second end without departing from the scope of the present disclosure.

As used throughout the present disclosure, a vertical position of a support assembly or portion thereof, stated with respect to a "level-ground surface," is to be determined considering the tires or tracks of the vehicle carrying the support assembly as if resting on a level-ground surface, and any moldboards and other elements resting on or above the level-ground surface. For example, if a moldboard attached to a vehicle is in a ground-proximity configuration described as being 3 inches above a level-ground surface, then the moldboard is positioned so that, with the tires or tracks of the vehicle resting on a level-ground surface (with jacks or stabilizers not deployed), a lower portion (such as a lower edge) of the moldboard is 3 inches above the level-ground surface.

The terminology defined above includes the words noted above, derivatives thereof, and words of similar import.

Figure 34:
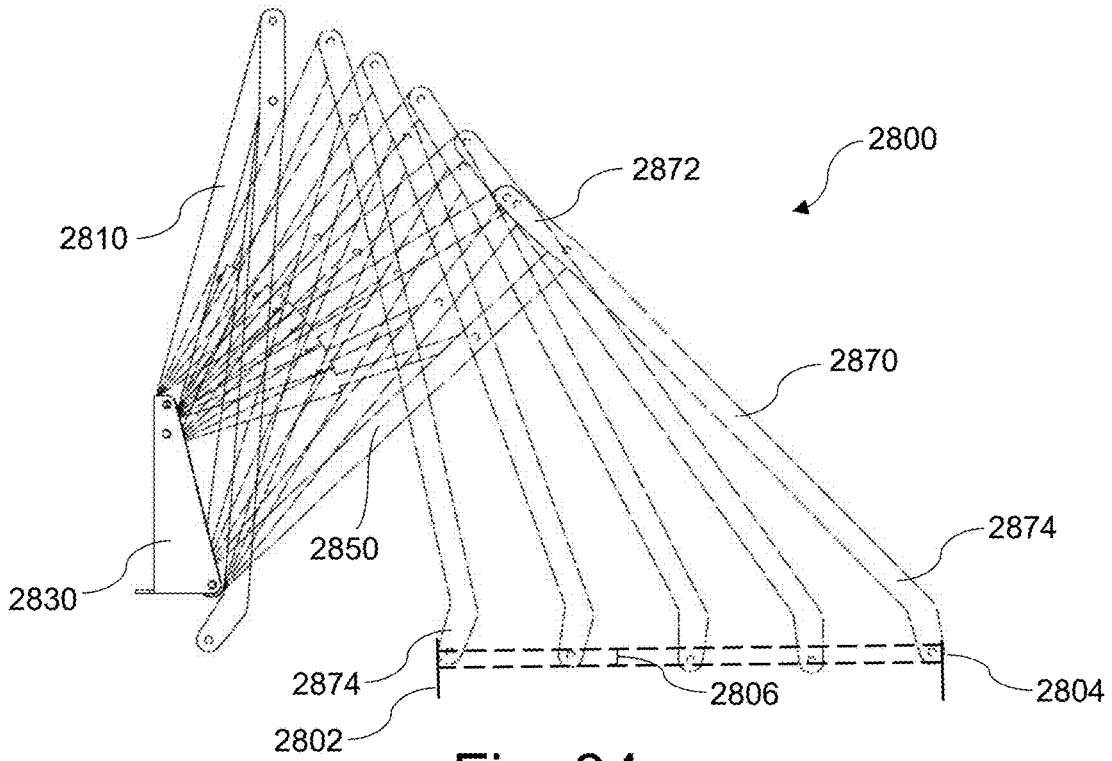
FIG. 34 is a partial right elevational multiple view of a further embodiment of a support assembly according to the present disclosure, showing paths of movements for components of the support assembly during movement between the storage position and ground-proximity configurations or working positions thereof.
Figure 35:
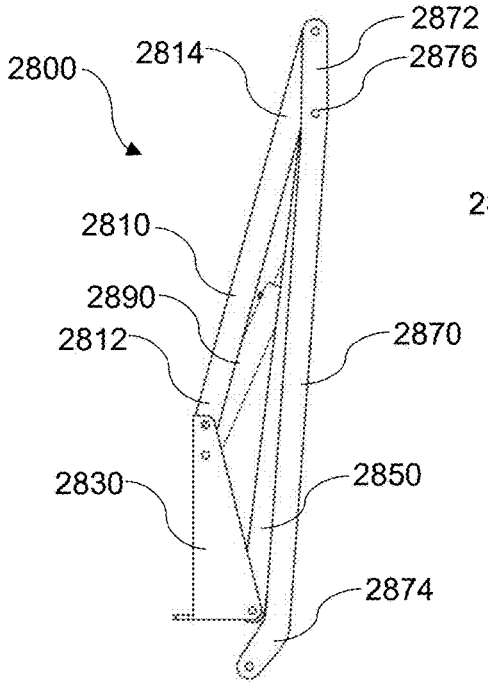
FIG. 35 is a right elevational partial view of the support assembly of FIG. 34 in a storage position.
Figure 36:
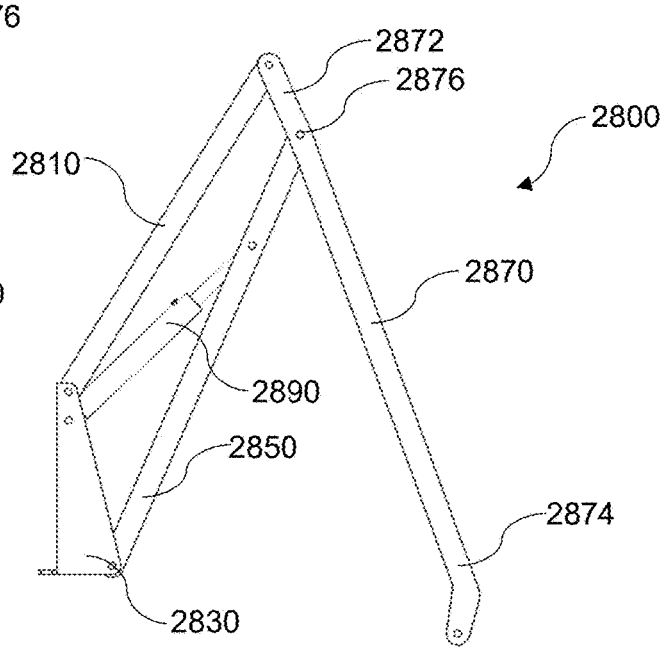
FIG. 36 is a right elevational partial view of the support assembly of FIG. 34 in a working position, with the lower cylinder in an extended state as compared to the storage position.
Figure 37:
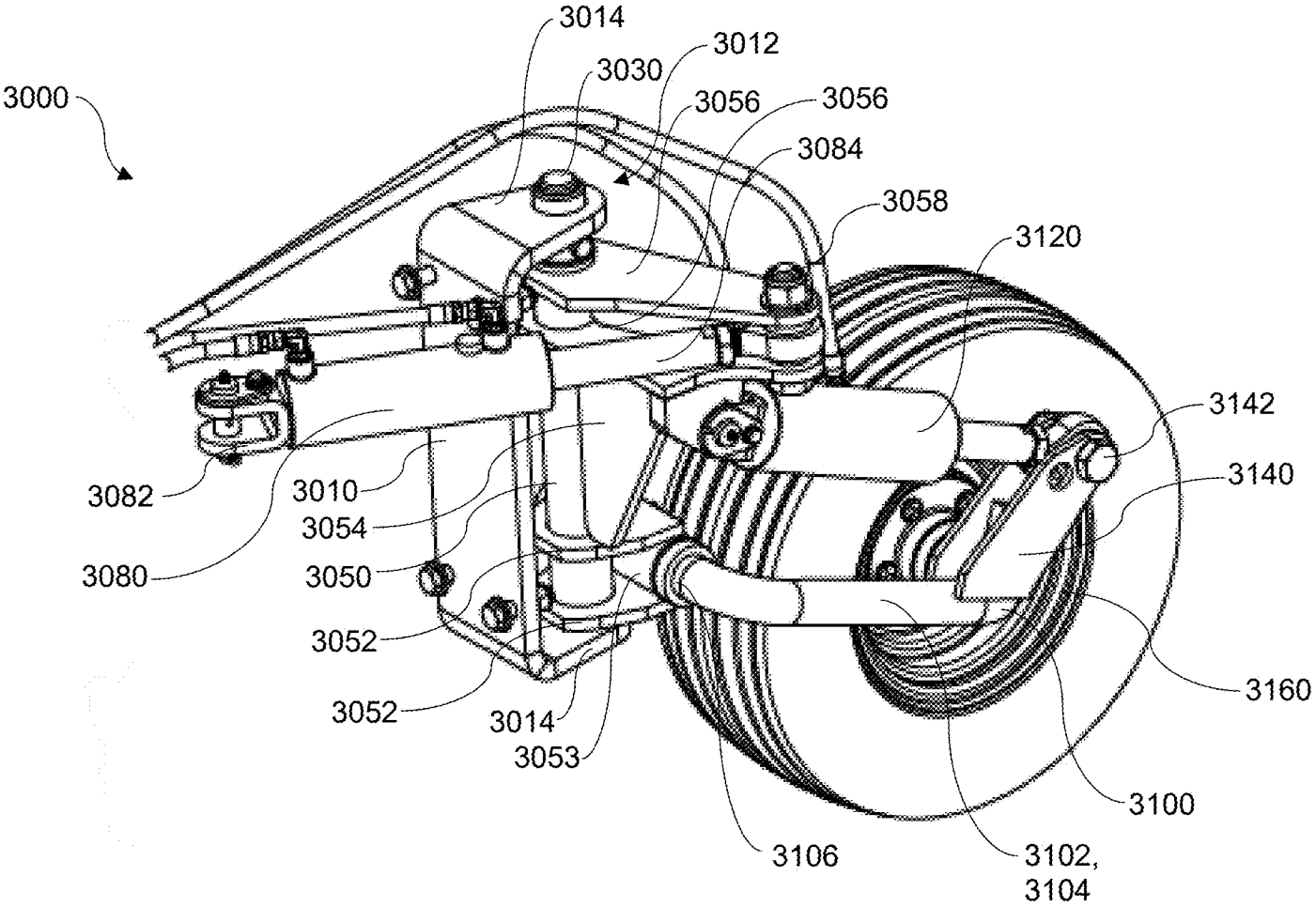
FIG. 37 is a front right upper perspective view of support-wheel assembly according to the present disclosure.

Referring to the drawings in detail, wherein like numerals indicate like elements throughout, an embodiment of a support assembly 100 for a wing moldboard 110 is shown in FIGS. 1-13B. A second embodiment of a support assembly 1100 is shown in FIGS. 14-22. A third embodiment of a support assembly 2100 is shown in FIGS. 23-27. A fourth embodiment of a support assembly 2500 is shown in FIGS. 28A-33. A fifth embodiment of a support assembly 2800 is shown in FIGS. 34-36. A further embodiment of a support assembly in the form of a support-wheel assembly 3000 is shown in FIGS. 37-46.

Figure 13A:
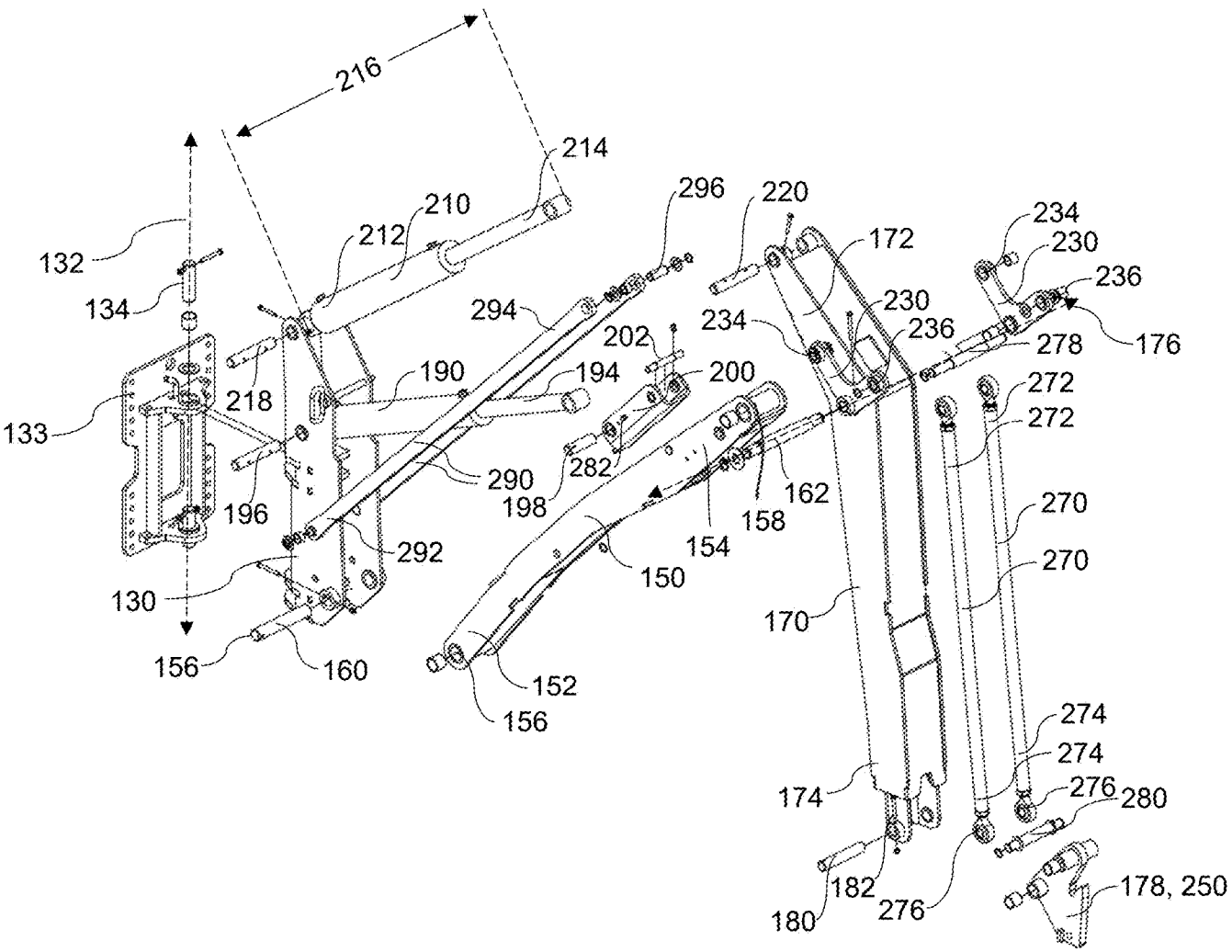
FIG. 13A is a partial right exploded perspective view of the support assembly of FIG. 1.

Referring to FIGS. 1-13B, the support assembly 100 includes a rearward base 130 configured to be secured to a vehicle 102 or a frame 104 or other suitable mounting point thereon to pivot with respect to the vehicle 102 about an upright axis 132. In the embodiment of FIGS. 1-13B, the rearward base 130 is pivotably attached to a mount 133 by a pin 134 (FIG. 13A). The upright axis 132 (FIG. 1) is shown in FIGS. 1-13B as being essentially vertical with the vehicle resting on a level-ground surface 108, but the upright axis 132 may angled with respect to vertical.

Figure 13B:
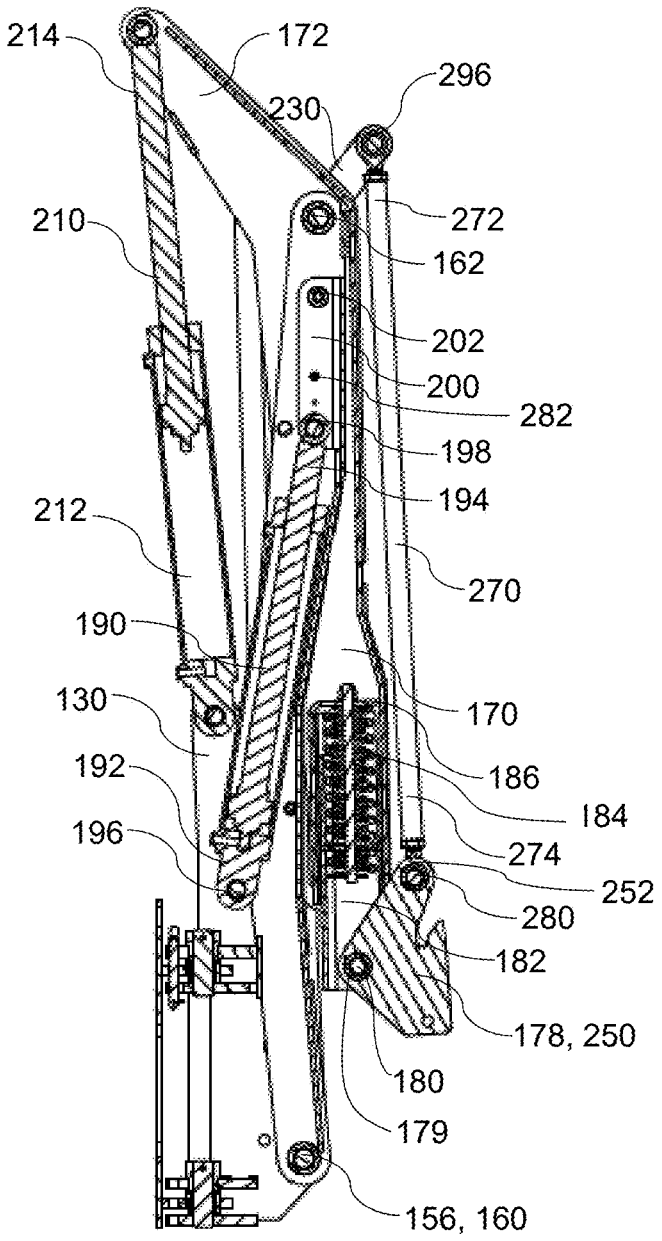
FIG. 13B is a right elevational sectional view of the support assembly of FIG. 1.
Figure 14:
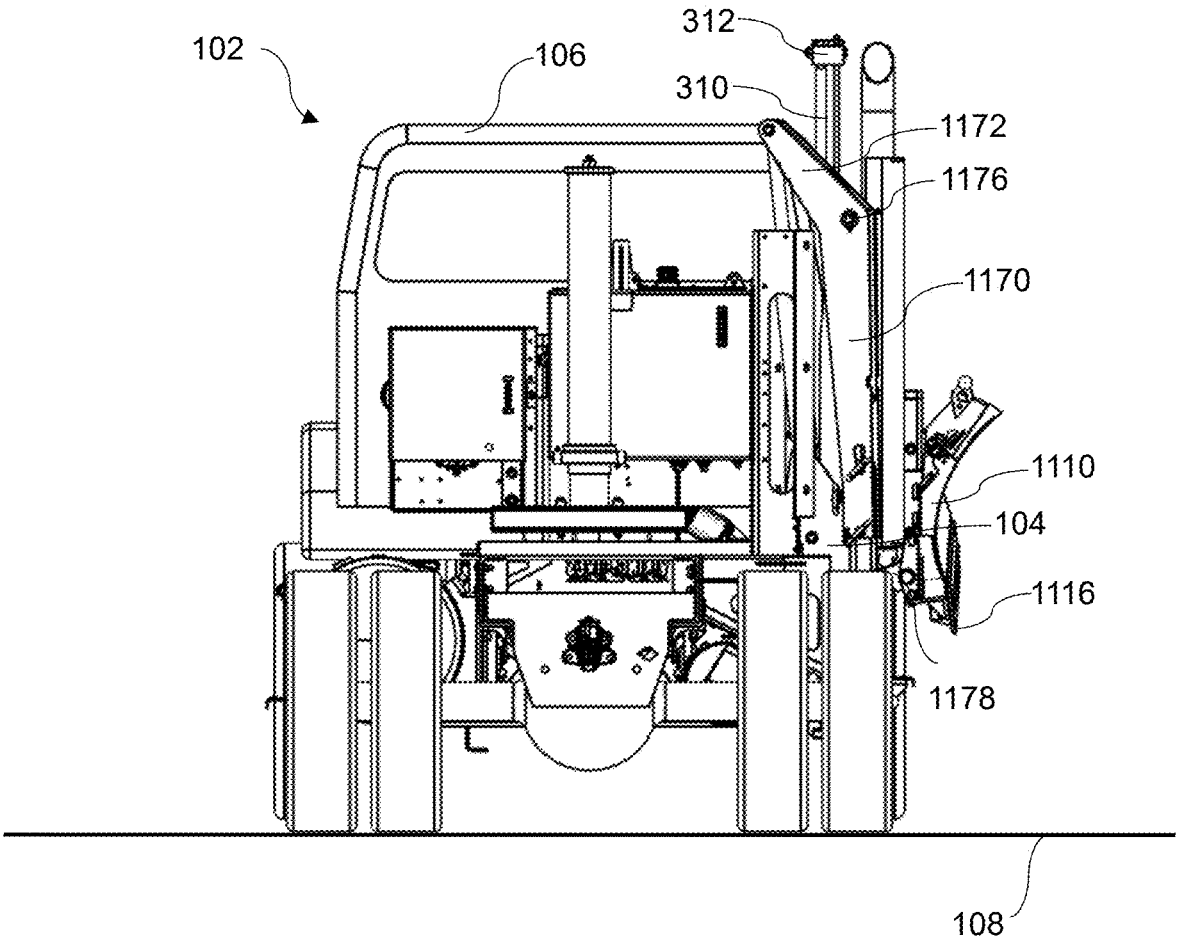
FIG. 14 is a rear elevational view of a further embodiment of a support assembly including a wing moldboard, all according to the present disclosure, in a mounted configuration on a vehicle, with the wing moldboard in a storage position.
Figure 15:
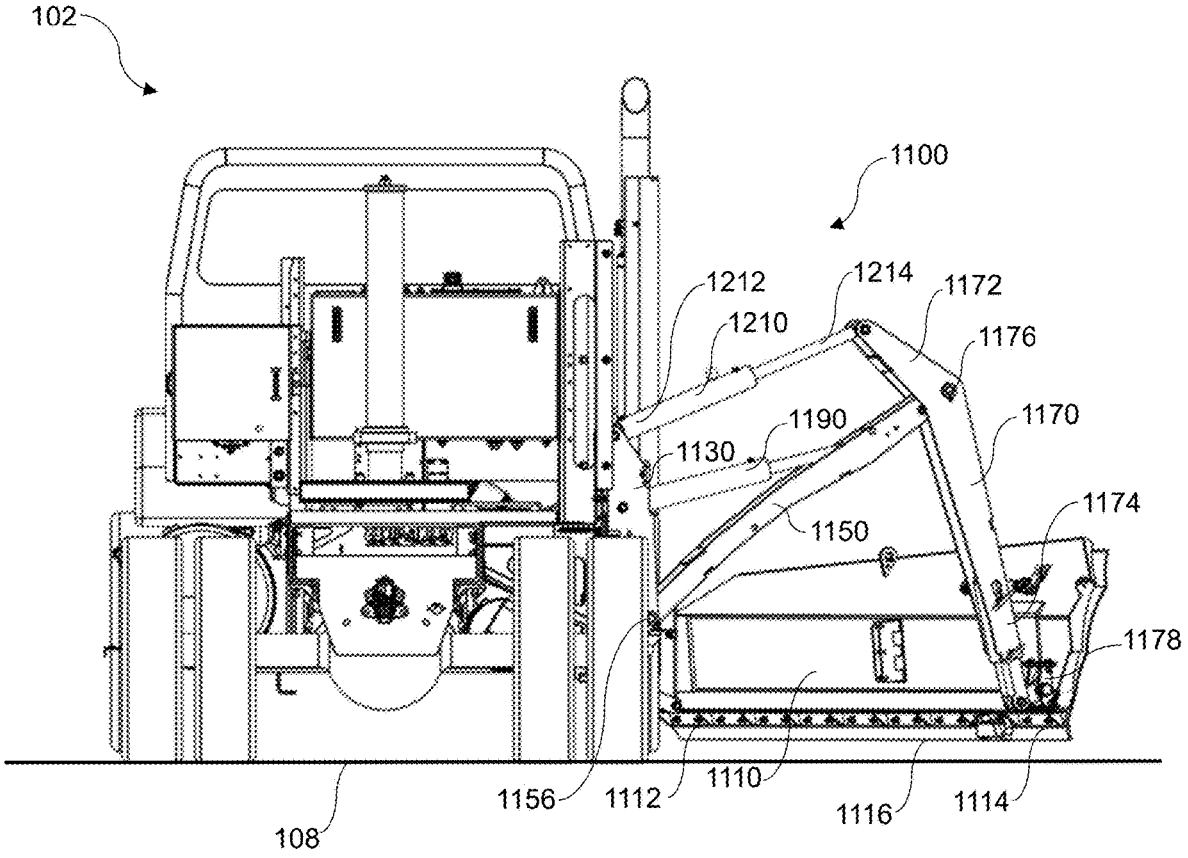
FIG. 15 is a rear elevational view of the support assembly of FIG. 14, with the wing moldboard held in a first ground-proximity configuration wherein the wing moldboard is partially extended outwardly from the vehicle.

A lower boom 150 (FIG. 2) of the support assembly 100 has a proximal end portion 152 and a distal end portion 154. The proximal end portion 152 is configured to be secured to the rearward base 130 to pivot with respect thereto about a lower-boom pivoting axis 156, with the lower-boom pivoting axis 156 being horizontal or generally horizontal. The proximal end portion 152 may be secured to the rearward base 130 by a pin 160 (FIGS. 13A and 13B). The lower-boom pivoting axis 156 coincides, in the illustrated embodiment of FIGS. 1-13B, with a central axis of a pin 160 and a hole in which the pin 160 is mounted within the rearward base 130 (FIG. 13A).

Figure 2:
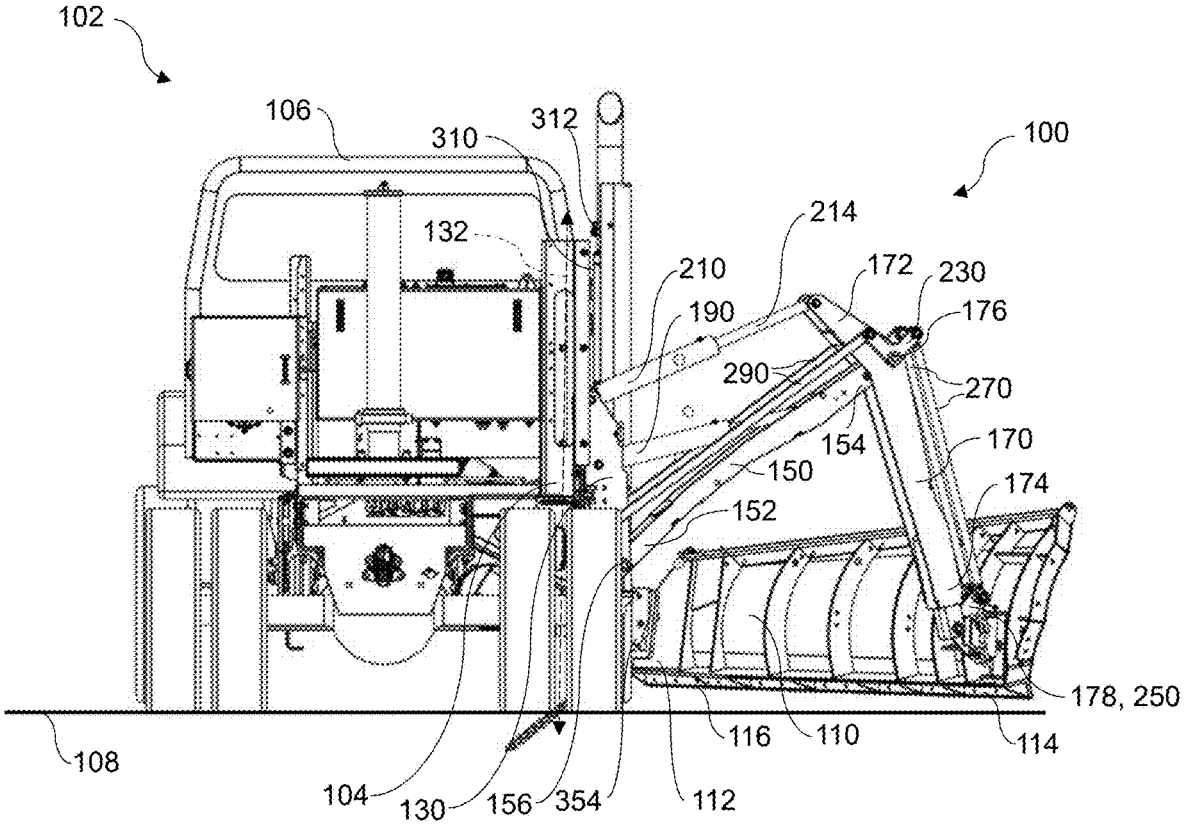
FIG. 2 is a rear elevational view of the support assembly of FIG. 1, with the wing moldboard held in a first ground-proximity configuration wherein the wing moldboard is partially extended outwardly from the vehicle.
Figure 3:
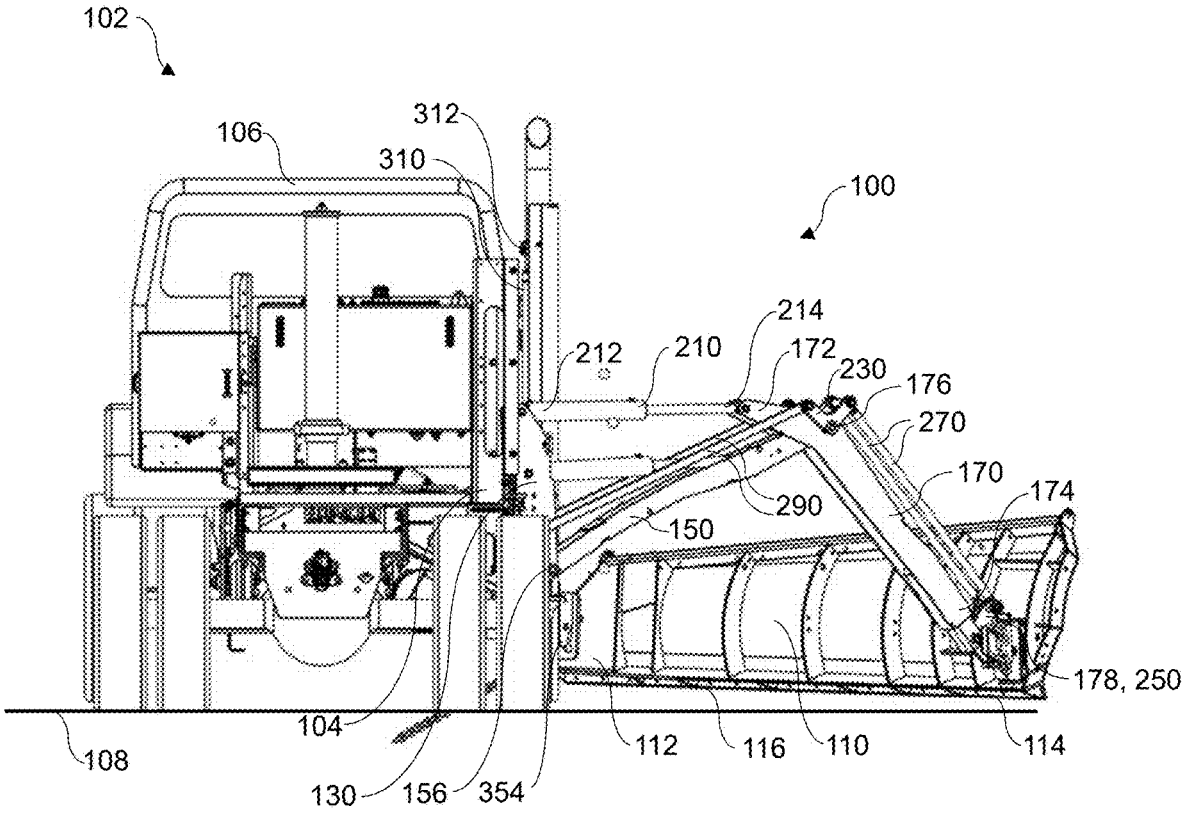
FIG. 3 is a rear elevational view of the support assembly of FIG. 1, with the wing moldboard held in a second ground-proximity configuration with the wing moldboard fully extended outwardly from the vehicle.
Figure 4:
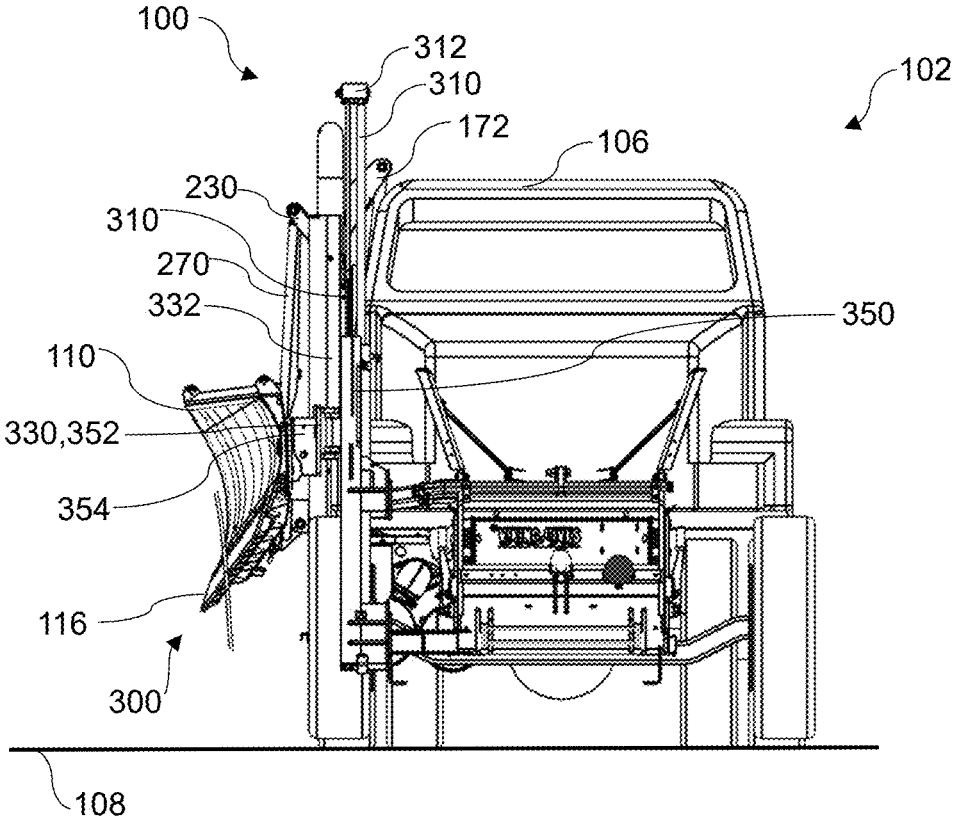
FIG. 4 is a front elevational view of the support assembly of FIG. 1, with the wing moldboard in the storage position.
Figure 5:
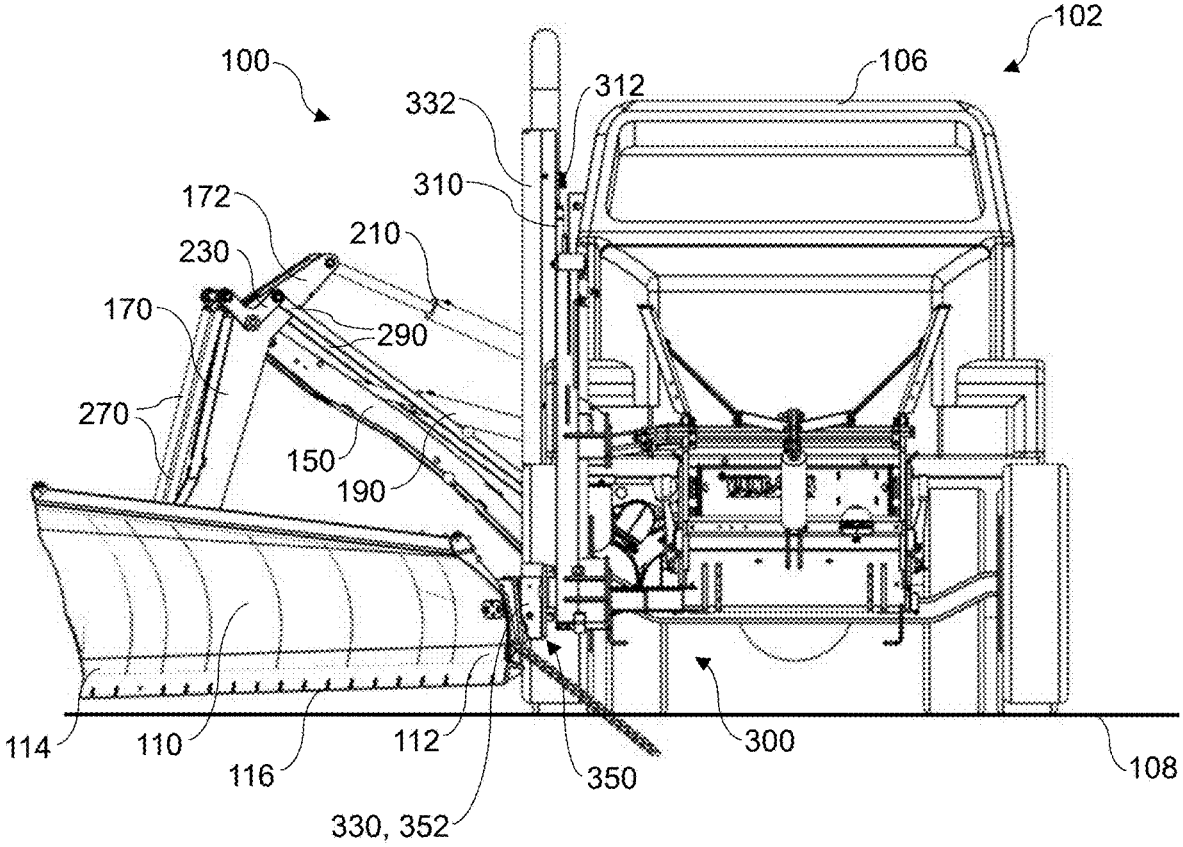
FIG. 5 is a front elevational view of the support assembly of FIG. 1, with the wing moldboard in the a first ground-proximity configuration wherein the wing moldboard is partially extended outwardly from the vehicle.
Figure 6:
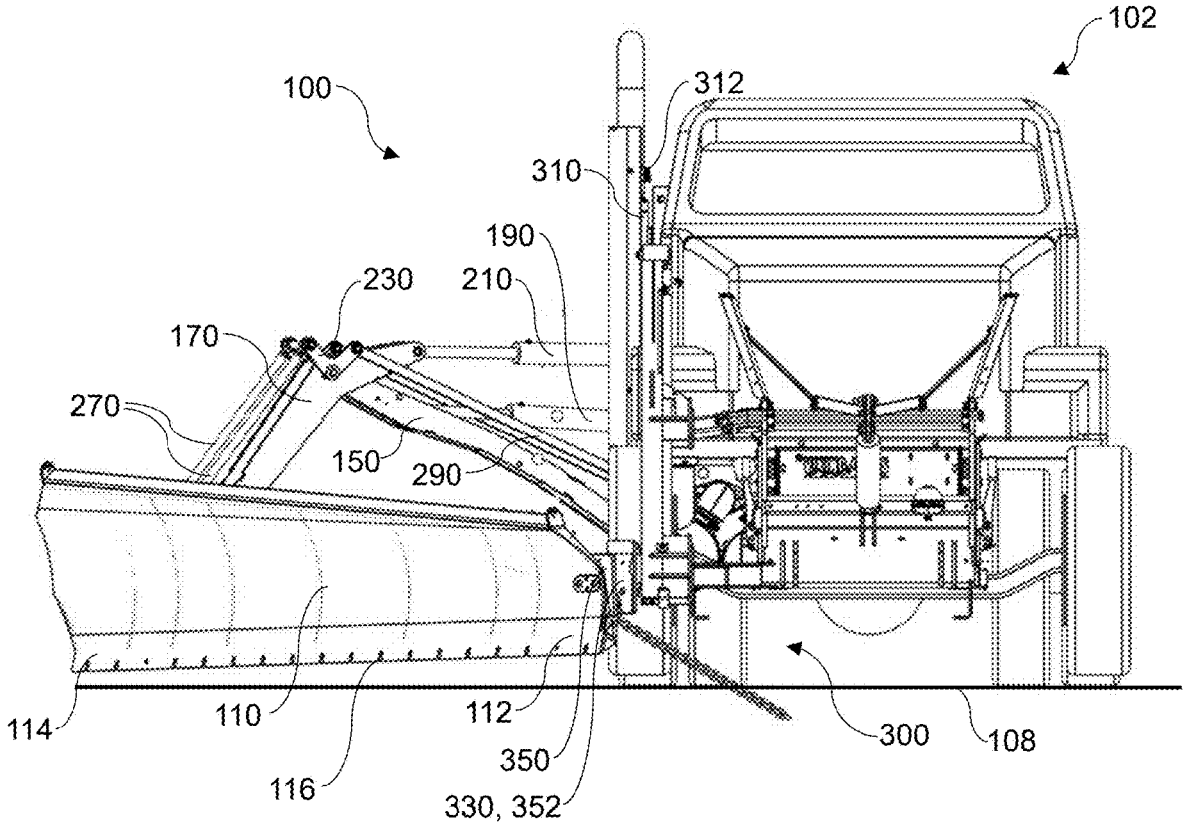
FIG. 6 is a front elevational view of the support assembly of FIG. 1, with the wing moldboard in the a second ground-proximity configuration with the wing moldboard fully extended outwardly from the vehicle.
Figure 7:
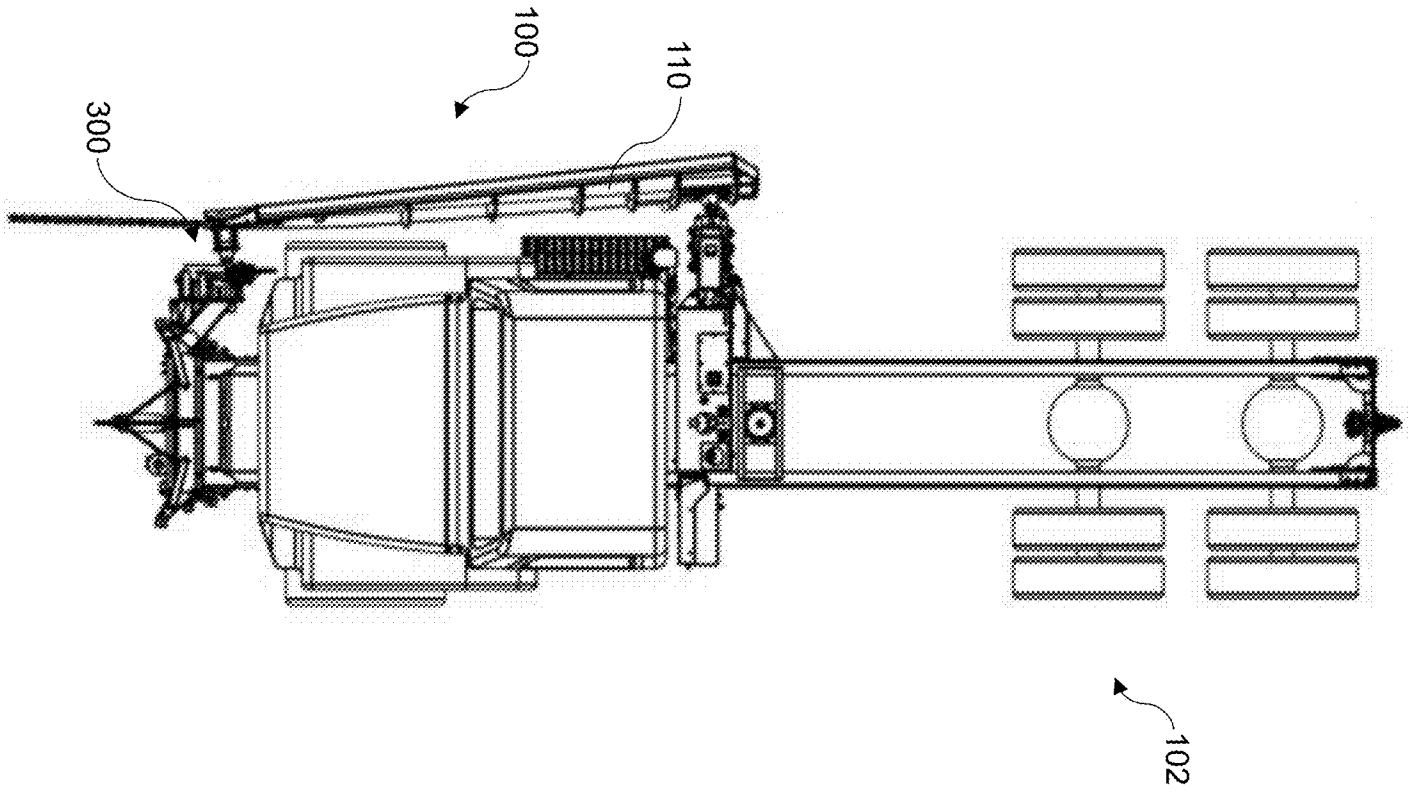
FIG. 7 is a top plan view of the support assembly of FIG. 1, with the wing moldboard in the storage position.
Figure 8:
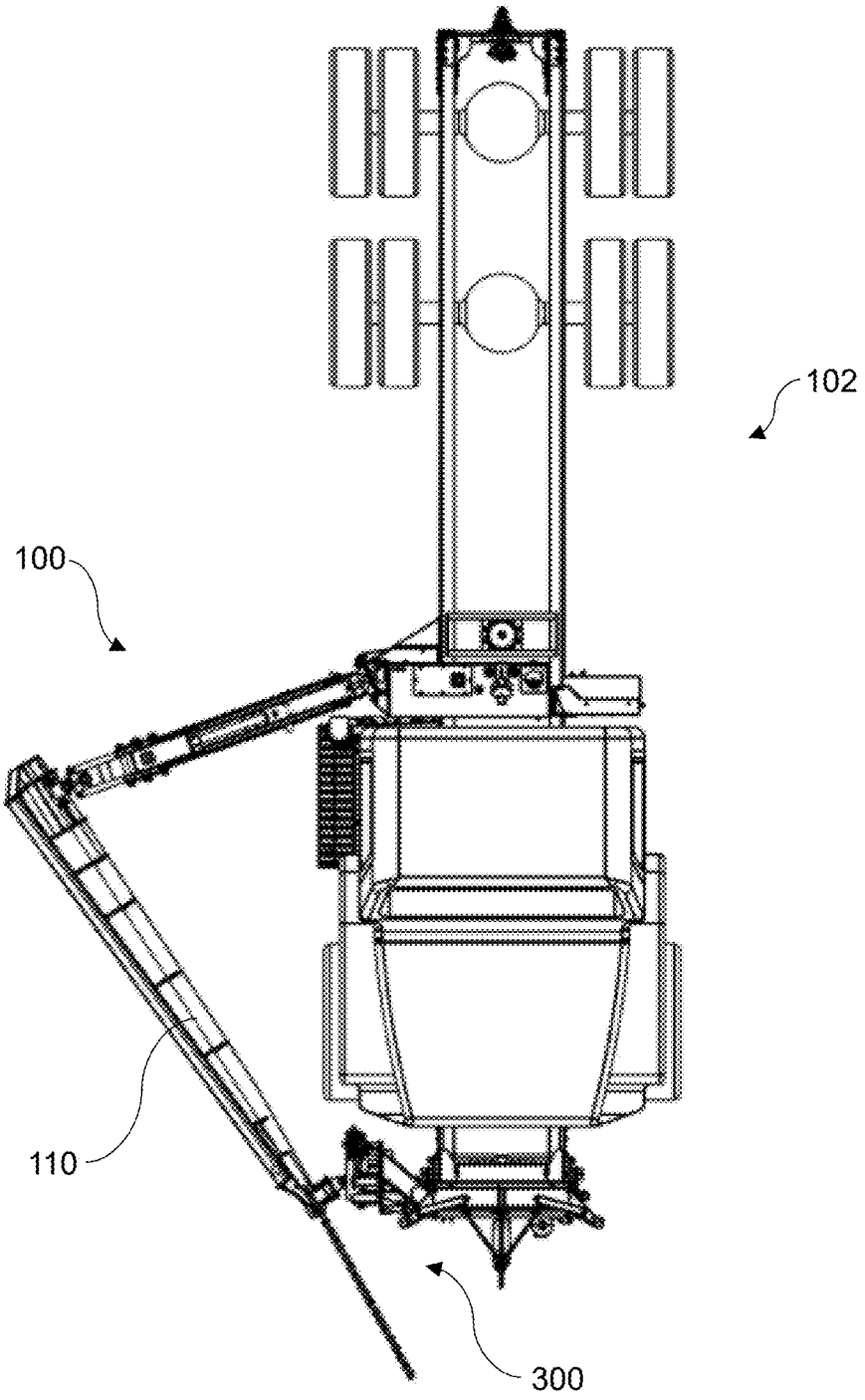
FIG. 8 is a top plan view of the support assembly of FIG. 1, with the wing moldboard in the first ground-proximity configuration wherein the wing moldboard is partially extended outwardly from the vehicle.
Figure 9:
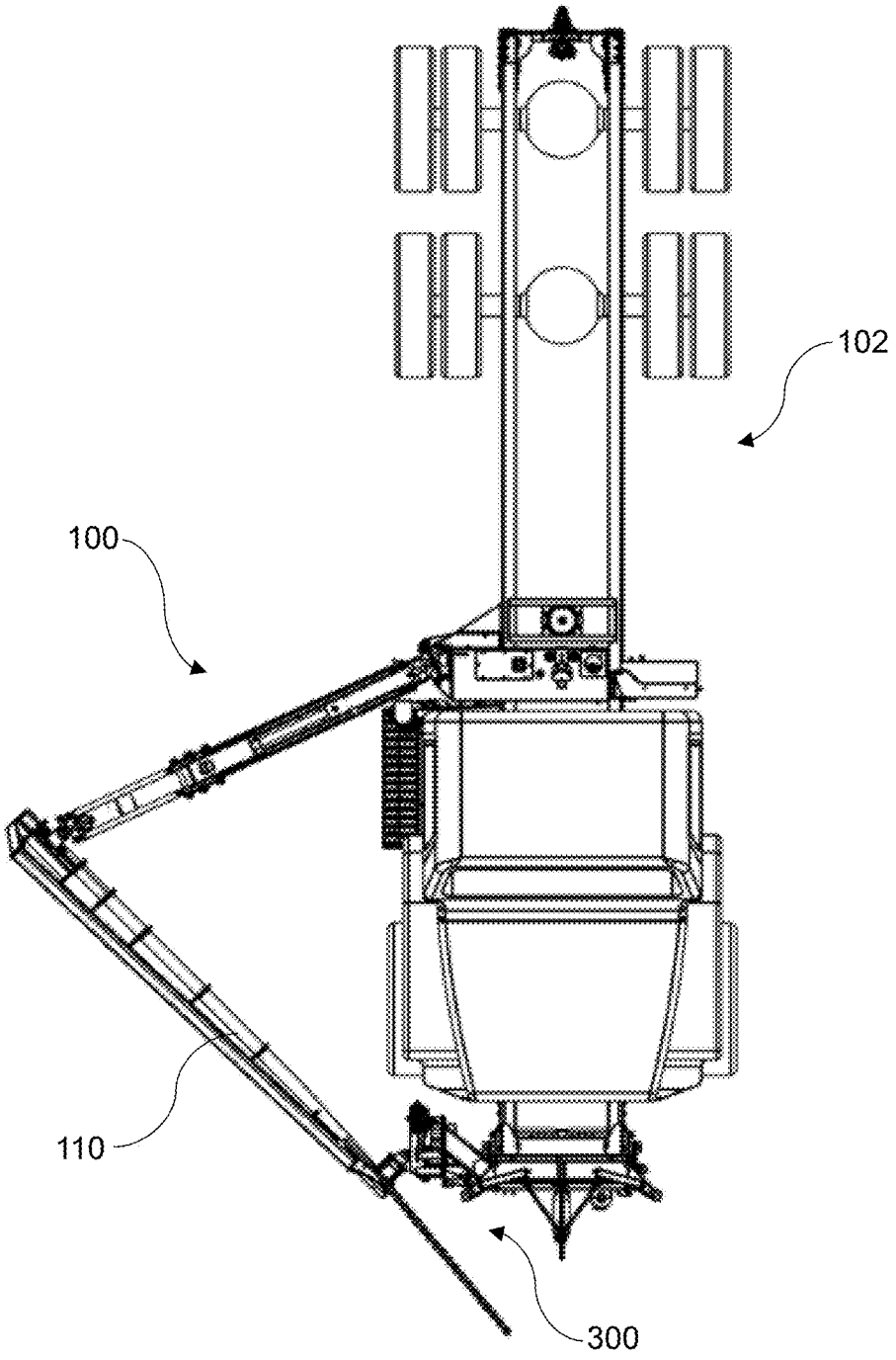
FIG. 9 is a top plan view of the support assembly of FIG. 1, with the wing moldboard in the second ground-proximity configuration with the wing moldboard fully extended outwardly from the vehicle.
Figure 10:
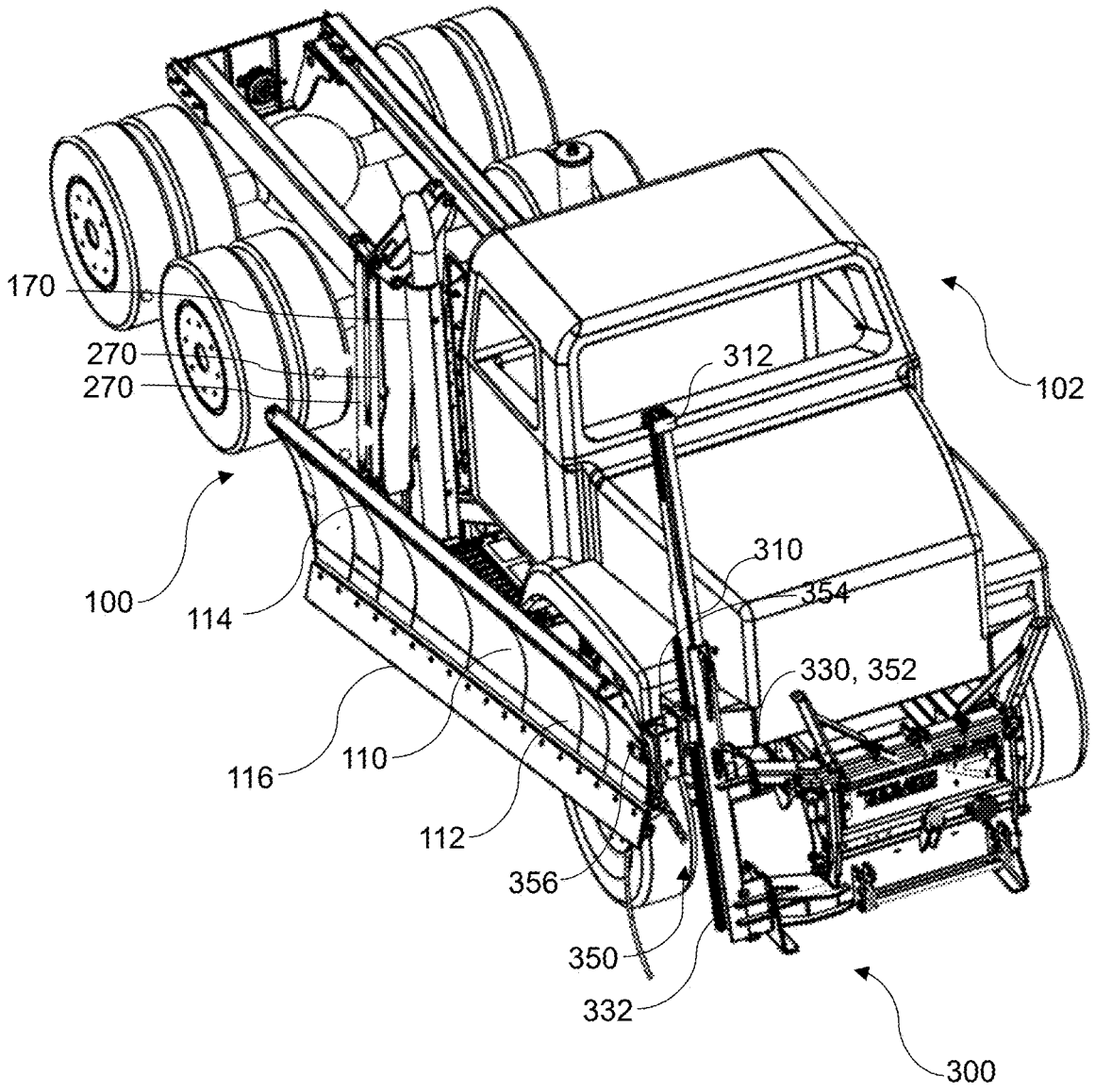
FIG. 10 is a right front upper perspective view of the support assembly of FIG. 1, with the wing moldboard in the storage position.
Figure 11:
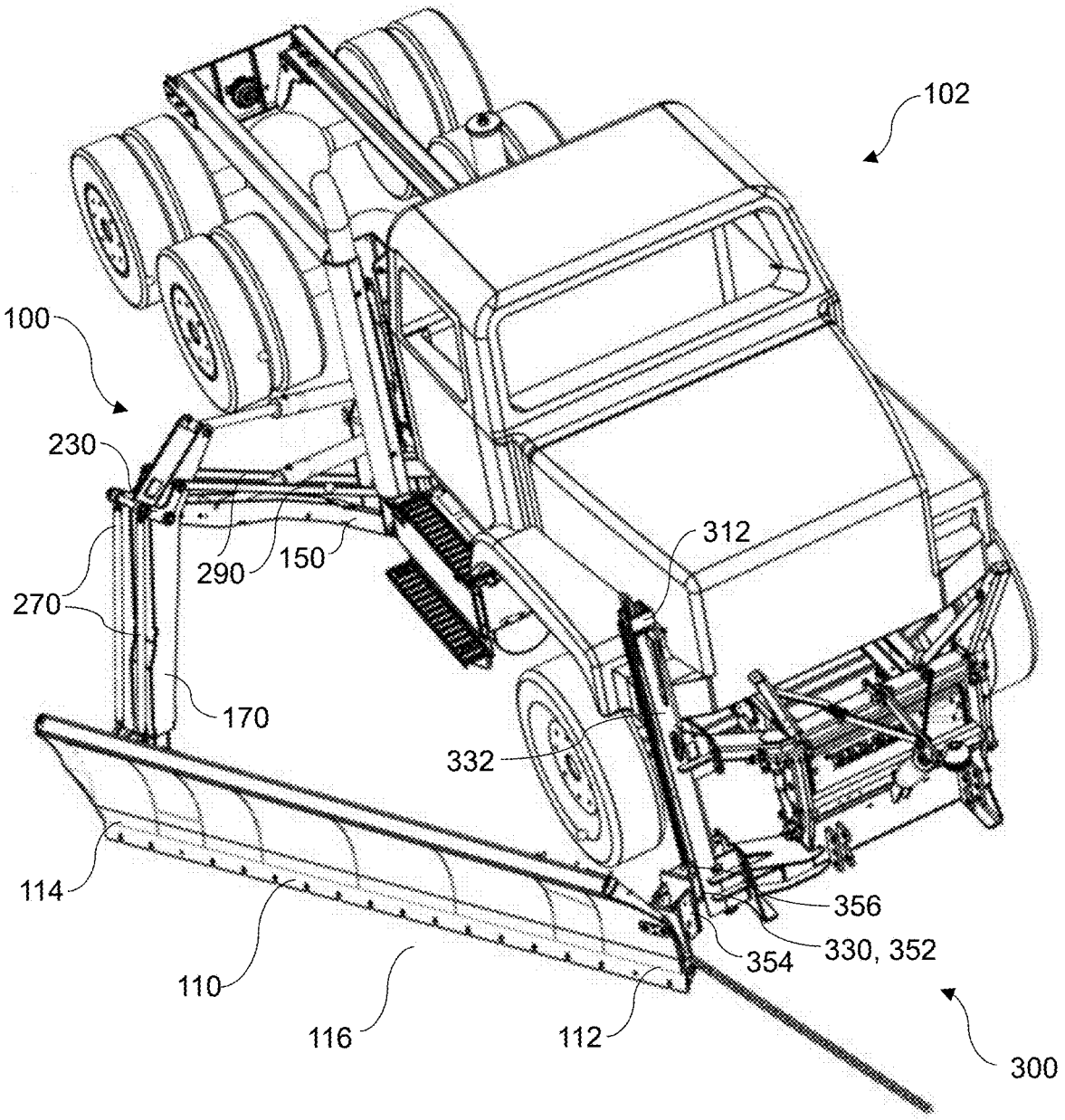
FIG. 11 is a right front upper perspective view of the support assembly of FIG. 1, with the wing moldboard in the first ground-proximity configuration wherein the wing moldboard is partially extended outwardly from the vehicle.
Figure 12:
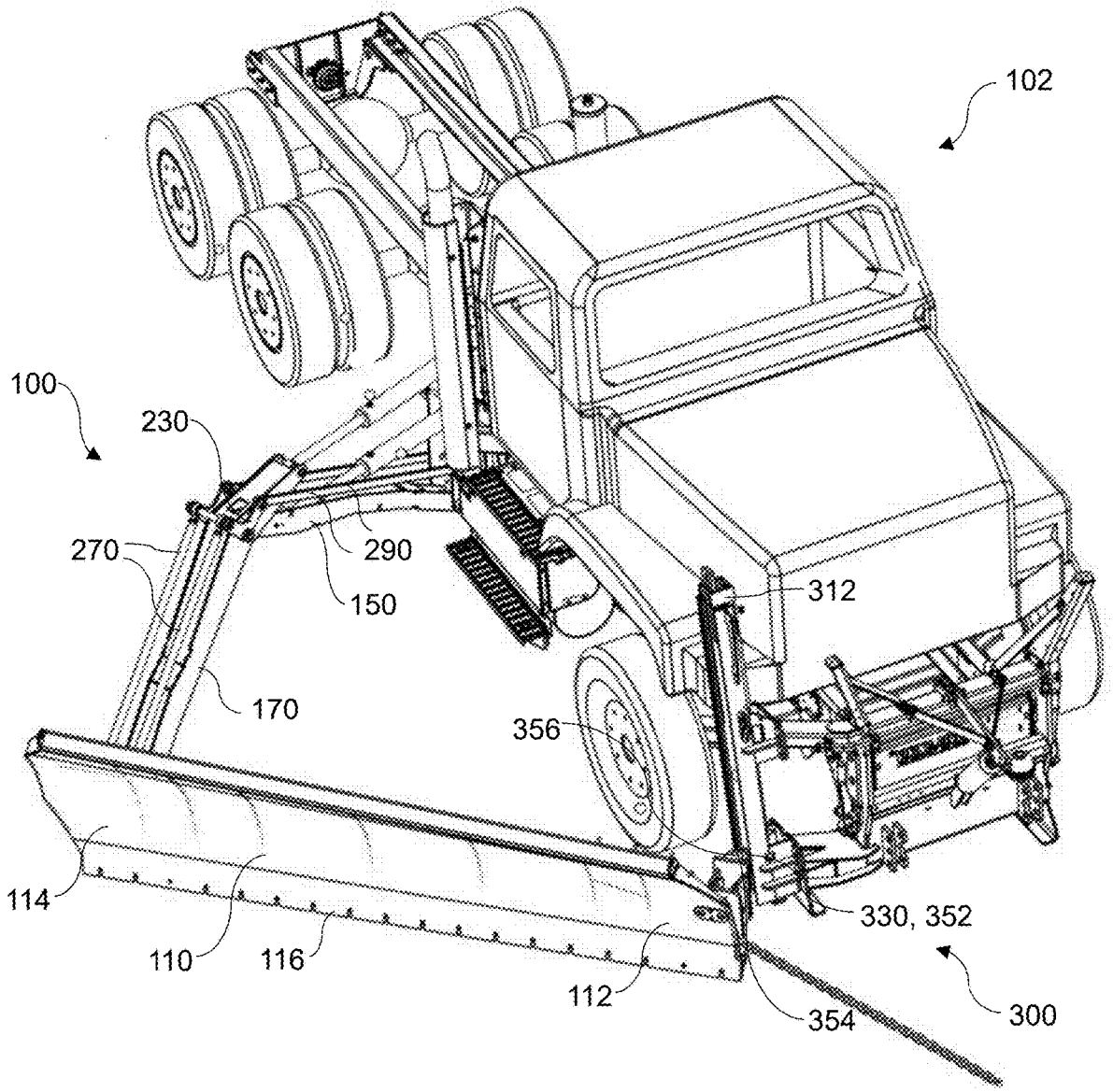
FIG. 12 is a right front upper perspective view of the support assembly of FIG. 1, with the wing moldboard in the second ground-proximity configuration with the wing moldboard fully extended outwardly from the vehicle.

Referring to FIG. 2, the lower boom 150 extends outwardly with respect to the vehicle 102 and upwardly with respect to the rearward base 130 so that the distal end portion 154 is located above the proximal end portion 152. This mode of attachment between the lower boom 150 and the rearward base 130 may allow the lower boom 150 to take an upright or nearly-upright stowed position, as shown in FIG. 1, FIG. 4, FIG. 7, FIG. 10, and to take a working position, as shown in FIG. 2, FIG. 3, FIG. 5, FIG. 6, FIG. 8, FIG. 9, FIG. 11, and FIG. 12, with the lower boom 150 extended outwardly from the vehicle 102—more particularly, extended from a body 106 or frame 104 or other portion of the vehicle 102.

An upper boom 170, 1170, 2170, 2570, 2870 is operatively attached to the lower boom 150 and has an upper-boom proximal portion 172 and an upper-boom distal portion 174 and may be so attached by a pin 162. The upper-boom proximal portion 172 is configured to be secured to the distal end portion 154 of the lower boom 150 to pivot the upper boom 170, 1170, 2170, 2570, 2870 with respect to the lower boom 150, with the pivoting occurring about an upper-boom pivoting axis 176. The upper-boom pivoting axis 176 (FIG. 1) may be at least generally horizontal and may correspond with an axis of the pin 162 or a shaft connecting the lower boom 150 to the upper boom 170, 1170, 2170, 2570, 2870. The upper-boom distal portion 174 extends at least partially downwardly from or with respect to the distal end portion 154 of the lower boom 150. As a result, embodiments of support assemblies disclosed herein are not, or at least are less likely, to be subject to unwanted contact between the wing moldboard 110 and the vehicle 102, and do not require that an operator take care to retract the wing moldboard 110 in a particular sequence or fashion to avoid unwanted contact. Instead, the support assembly 100 of the present disclosure allows the operator to retract the wing moldboard 110 rapidly by manually controlling a single actuator, as the configuration of the support assembly 100 may be selected to prevent unwanted contact between the wing moldboard 110 and parts of the vehicle 102.

The lower boom 150 and the upper boom 170, 1170, 2170, 2570, 2870 may be configured by size and shape, and interconnected pivotably or rotatably, so that the upper-boom distal portion 174 travels a flat or relatively flat path (relatively close to being parallel with a level-ground surface 108), while the upper-boom distal portion 174 and the wing moldboard 110 attached thereto are also held at an appropriate height to avoid unwanted contact with the vehicle 102, when the wing moldboard 110 is being moved to or stored in the storage position.

In the embodiment of FIGS. 1-13B, a lower-boom mechanical actuator 190 in the form of a lower cylinder is configured to be operatively connected to the lower boom 150 to drive the lower boom 150 between a first lower-boom position with a fixed portion such as a distal end 158 of the lower boom 150 displaced a first horizontal distance from the rearward base 130, and a second lower-boom position with the fixed portion (distal end 158) of the lower boom 150 displaced a second horizontal distance from the rearward base 130, with the second horizontal distance being greater than the first horizontal distance. In the embodiment of FIGS. 1-13B, the lower-boom mechanical actuator has a proximal end portion 192 and a distal end portion 194 and is operatively attached to the rearward base 130 by a pin 196. The lower-boom mechanical actuator 190 is operatively attached to the lower boom 150 by being pivotably attached by a pin 198 to a connector link 200. The connector link 200 is in turn pivotably attached to the lower boom 150 by a pin 202. A shear pin 282 may secure the connector link 200 to the lower boom 150 so that the connector link 200 does not ordinarily pivot with respect to the lower boom 150. The shear pin 282, of which two generally are used, may be selected and configured (by size, material, notching, or the like) so that the shear pin 282 has a selected strength or impact resistance, so that upon a sudden movement or striking of the wing moldboard 110, the shear pin 282 may sacrificially fail rather than transmit an excessive force to inner leveling link inner leveling link 290, the upper cylinder 210, the lower-boom mechanical actuator 190, or other portions of the support assembly 100. Note that the first and second horizontal distances are relative positions and may be defined in terms of the distal end 158, or any other fixed portion of the lower boom 158—preferably a portion of the lower boom located on the distal end portion 154 thereof. In the illustrated embodiment, the lower-boom mechanical actuator 190 is a hydraulic cylinder, but the lower-boom mechanical actuator 190 may take the form of a pneumatic cylinder, an electric motor, or any other suitable mechanism known in the art for driving the lower boom 150 between the first lower-boom position and the second lower-boom position. For examples of such positions and horizontal distances, compare the stowed position (as in FIGS. 1, 4, 7, and 10) to the ground-proximity configuration (as in FIGS. 2, 5, 8, and 11). As a further example, compare a first ground-proximity configuration, which in the identified views is a retracted configuration (FIGS. 2, 5, 8, and 11) to a second ground-proximity configuration (FIGS. 3, 6, 9, and 12).

A rotation member, which is an upper cylinder 210 in the embodiment of FIGS. 1-13B, has a rotation-member proximal portion in the form of an upper-cylinder proximal portion 212 and a rotation-member distal portion in the form of an upper-cylinder distal portion 214. In the illustrated embodiment, the upper cylinder 210 is a hydraulic cylinder, but the upper cylinder 210 may also take the form of a pneumatic cylinder, an electric motor, or any other suitable mechanism known in the art for driving the lower boom 150 between the first lower-boom position and the second lower-boom position. Alternatively, the rotation member may take the form of other mechanical actuators known in the art, including screw-type, magnetic, or other mechanical actuators. As an alternative to the upper cylinder 210 or other mechanical actuators that may be used as a rotation member, the rotation member may also be a solid link (as discussed below with respect to FIGS. 14-36) or may be a tension member such as a cable or chain. In any embodiment of the support assembly 100, 1100, 2100, 2500, 2800, the support assembly 100, 1100, 2100, 2500, 2800 may further comprise a forward moldboard-support assembly including a forward hinge mount movable from a first height to a second height. In the support assembly 100 of FIGS. 1-13B, referring to FIG. 4-6, the forward moldboard-support assembly 300 includes the forward hinge mount 330, which is movably mounted on a mast 332. The forward hinge mount 330 moves lengthwise along on the mast 332 and may be raised and lowered by a forward-support mechanical actuator 310, which is operatively connected to slider 312, the slider 312 in turn being connected to the forward hinge mount 330. Alternatively, the forward-support mechanical actuator 310 may be operatively connected to the forward hinge mount 330 via a cable and pulley to a drive block (not shown), with the drive block driven by a mechanical actuator. In the support assembly 100, a forward moldboard hinge 350 is operatively connected to the forward hinge mount 330 to travel along the mast 332 therewith. In the forward moldboard-support assembly 300, the forward moldboard hinge 350 includes a proximal leaf element 352 connected to, and in this case integrally formed with, the forward hinge mount 330, and a distal leaf element 354 configured to be operatively connected to the forward hinge mount 330 by, for example, a pin 356. Thus FIGS. 1-13B show a plowing system comprising the vehicle 102, the wing moldboard 110 operatively connected to the vehicle 102, the support assembly 100, and the forward moldboard-support assembly 300 portions of the vehicle 102. An "emergency lift" actuator such as a button or lever may be provided to initiate, based on a single input, an immediate lifting of the wing moldboard 110 portions of the vehicle 102. 178 (FIGS. 2, 3, 13A, and 13B) and may have a selected amount of free vertical The upper cylinder 210 may be extended or retracted to select a ground-proximity configuration. When the upper cylinder 210 is so configured, a movement of the support assembly 100 from the ground-proximity configuration to the storage configuration may be driven or determined solely by retraction of the lower-boom mechanical actuator 190 (shown as a lower cylinder). See, for example, FIGS. 4-6. A benching configuration is shown with respect to the second embodiment of the support assembly 1100 in FIGS. 17 and 21.

The support assembly 100 has a ground-proximity configuration wherein the lower edge of the wing moldboard 110 is placed either in contact with the level-ground surface (FIGS. 2, 3, 5, 6, 8, 9, 11, and 12), and a benching configuration (not shown separately, but analogous to the configuration shown in FIGS. 17 and 21) wherein the lower edge of the wing moldboard 110 is placed at least six inches above the level-ground surface. The rotation-member length 216 (FIG. 13A) of the upper cylinder 210 in the ground-proximity configuration is greater than the rotation-member length 216 in the benching configuration, so that the support assembly 100 is selectively movable between the ground-proximity configuration and the benching configuration by extension and retraction of the rotation-member mechanical actuator, such as the upper cylinder 210.

The support assembly 100 may further comprise a central leveling link 230 (FIGS. 2, 3, 5, 6, and 11-13B) operatively engaged with the lower boom 150—for example, pivotably attached thereto. Each central leveling link 230 has a lower mounting hole 232, a proximal mounting hole 234, and the distal mounting hole 236. Here two central leveling links 230 are shown and are pivotably attached to the lower boom 150 by the pin 160, which passes through the lower mounting hole 232 of each central leveling link 230.

A moldboard-support link 250, which may include or take the form of the mounting link 178 (FIG. 13A) may be operatively engaged with—for example, pivotably attached to—the upper-boom distal portion 174 of the upper boom 170. The moldboard-support link 250 may be configured to engage and support the wing moldboard 110 so that the wing moldboard 110 pivots with the moldboard-support link 250. An outer leveling link 270 (two are shown) may have an outer-leveling-link proximal portion 272 and an outer-leveling-link distal portion 274 (FIG. 13A). The outer-leveling-link proximal portion 272 may be configured to be operatively engaged with a portion of the central leveling link 230. In the embodiment shown, each outer-leveling link proximal portion 272 is pivotably attached to the distal mounting hole 236 of a respective central leveling link 230 by a pin 278. Each outer-leveling-link distal portion 274 is configured to be operatively engaged with the moldboard-support link 178, 250. In the embodiment shown, each outer-leveling-link distal portion 274 is pivotably attached by a pin 280 passing through an upper mounting hole 252 of the moldboard-support link 250/mounting link 178 and through a mounting hole 276 in each outer-leveling-link distal portion 274. Any other pin disclosed herein may be configured as a shear pin to in the same manner, in order to reduce forces transmitted to connected components.

An inner leveling link 290 may operatively engage the central leveling link 230 by way of the proximal mounting hole 234 and have an inner-leveling-link proximal portion 292 and an inner-leveling-link distal portion 294 (FIG. 13A). The inner-leveling-link proximal portion 292 may be configured to be operatively engaged with the rearward base 130; here each inner-leveling-link proximal portion 292 is pivotably attached to the rearward base 130 by a bolt. The inner-leveling-link distal portion 294 may be configured to be operatively engaged with a portion of the central leveling link 230; here each inner-leveling-link distal portion 294 is respectively pivotably attached to the proximal mounting hole 234 of the central leveling link 230 by a respective pin 296 (only one pin 296 is shown in FIG. 13B). The inner leveling link 290, the central leveling link 230, and the outer leveling link 270 may be configured to pivot the moldboard-support link 178, 250 with respect to the lower boom 150 when the lower-boom mechanical actuator 190 (here the lower cylinder 190) drives the lower boom 150 between the first lower-boom position and the second lower-boom position, so that the moldboard-support link 178, 250 maintains a selected angular orientation of the moldboard 110 during motion of the support assembly and the lower boom 150 thereof. The outer leveling link 270 may be conveniently formed as a rod, and the inner leveling link 290 may be conveniently formed as a bar (as shown); both may take other shapes providing the necessary stiffness and strength and being of dimensions compatible with the other components of the support assembly 100. In other embodiments, a mounting link may be provided that is not connected to a central leveling link via an outer leveling link; and the inner and outer leveling links may be omitted.

As noted above, disclosed herein are a second embodiment of a support assembly 1100 (FIGS. 14-22); a third embodiment of a support assembly 2100 (FIGS. 23-27); a fourth embodiment of a support assembly 2500 (FIGS. 28A-33); and a fifth embodiment of a support assembly 2800 (FIGS. 34-36). Many elements of the second, third, fourth, and fifth embodiments are substantially identical to similarly numbered elements in of the first embodiment of the support assembly 100. Unless specifically stated or shown otherwise herein, similarly numbered elements of the various embodiments interconnect and function in the same manner as their counterparts in the first embodiment. For example, each support assembly 100, 1100, 2100, 2500, 2800 includes a lower boom 150, 1150, 2150, 2550, 2850 and an upper boom 170, 1170, 2170, 2570, 2870.

Referring to FIGS. 14-36, a support assembly 1100, 2100, 2500, 2800 includes a rearward base 1130, 2130, 2530, 2830 configured to be secured to a vehicle 102 or a frame 104 (or a frame 2104 of FIGS. 23-25) or other suitable mounting point thereon to pivot with respect to the vehicle 102 about an upright axis 1132. The upright axis 1132 (FIG. 16) is shown as being essentially vertical with the vehicle 102 resting on a level-ground surface, but the upright axis 1132 may be angled with respect to vertical.

A lower boom 1150, 2150, 2550, 2850 of the support assembly 1100, 2100, 2500, 2800 has a proximal end portion 1152 and a distal end portion 1154; the end portions are shown but not specifically called out in each embodiment. The proximal end portion 1152 is configured to be secured to the rearward base 1130, 2130, 2530, 2830 to pivot with respect thereto about a lower-boom pivoting axis 1156, with the lower-boom pivoting axis 1156 being horizontal or generally horizontal.

The lower boom 1150, 2150, 2550, 2850 extends outwardly with respect to the vehicle 102 and upwardly with respect to the rearward base 1130, 2130, 2530, 2830 so that the distal end portion 1154 is located above the proximal end portion 1152. This mode of attachment between the lower boom 1150, 2150, 2550, 2850 and the rearward base 1130, 2130, 2530, 2830 may allow the lower boom 1150, 2150, 2550, 2850 to take an upright or nearly-upright stowed position, as shown in FIGS. 14, 18, 22, 23, 26, 28A, 34, and 35, and to take a working position, as shown in FIGS. 15-17, 19-21, 24, 25, 27, 28A, 29-34, and 35, with the lower boom 1150, 2150, 2550, 2850 extended outwardly from the rearward base 1130, 2130, 2530, 2830 and the vehicle 102 (not shown in some embodiments, but the rearward base 1130, 2130, 2530, 2830 is attached thereto)-more particularly, extended from a body 106 or frame 104 or other portion of the vehicle 102.

An upper boom 1170, 2170, 2570, 2870 is operatively attached to the lower boom 1150, 2150, 2550, 2850 and has an upper-boom proximal portion 1172, 2172, 2572, 2872 and an upper-boom distal portion 1174, 2174, 2574. The upper-boom proximal portion 1172, 2172, 2572 is configured to be secured to the distal end portion 1154 of the lower boom 1150, 2150, 2550, 2850 to pivot the upper boom 1170, 2170, 2570, 2870 with respect to the lower boom 1150, 2150, 2550, 2850, with the pivoting occurring about an upper-boom pivoting axis 176. The upper-boom pivoting axis 176 (FIG. 1) may be at least generally horizontal and may correspond with an axis of a pin or shaft connecting the lower boom 1150, 2150, 2550, 2850 to the upper boom 1170, 2170, 2570, 2870. The upper-boom distal portion 1174, 2174, 2574, 2874 extends at least partially downwardly from or with respect to the distal end portion 1154 of the lower boom 1150, 2150, 2550, 2850. As a result, embodiments of the support assembly 1100, 2100, 2500, 2800 disclosed herein are not, or at least are less likely, to be subject to unwanted contact between the wing moldboard 1110, 2110 and the vehicle 102, and do not require that an operator take care to retract the wing moldboard 1110, 2110 in a particular sequence or fashion to avoid unwanted contact. Instead, the support assembly 1100, 2100, 2500, 2800 of the present disclosure allows the operator to retract the wing moldboard 1110, 2110 rapidly by manually controlling a single actuator, as the configuration of the support assembly 1100, 2100, 2500, 2800 may be selected to prevent unwanted contact between the wing moldboard 1110, 2110 and parts of the vehicle 102 throughout a range of motion of the support assembly 1100, 2100, 2500, 2800.

Figure 16:
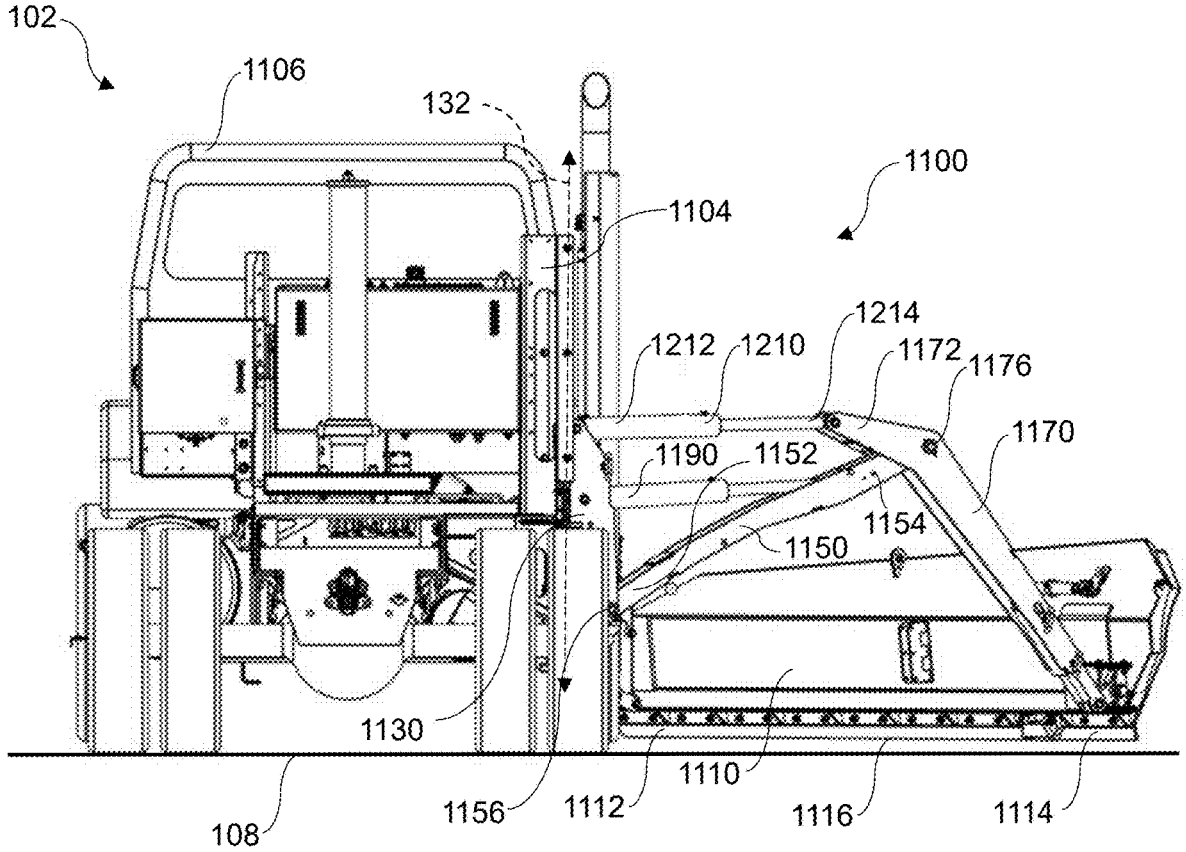
FIG. 16 is a rear elevational view of the support assembly of FIG. 14, with the wing moldboard held in a second ground-proximity configuration with the wing moldboard fully extended outwardly from the vehicle.
Figure 20:
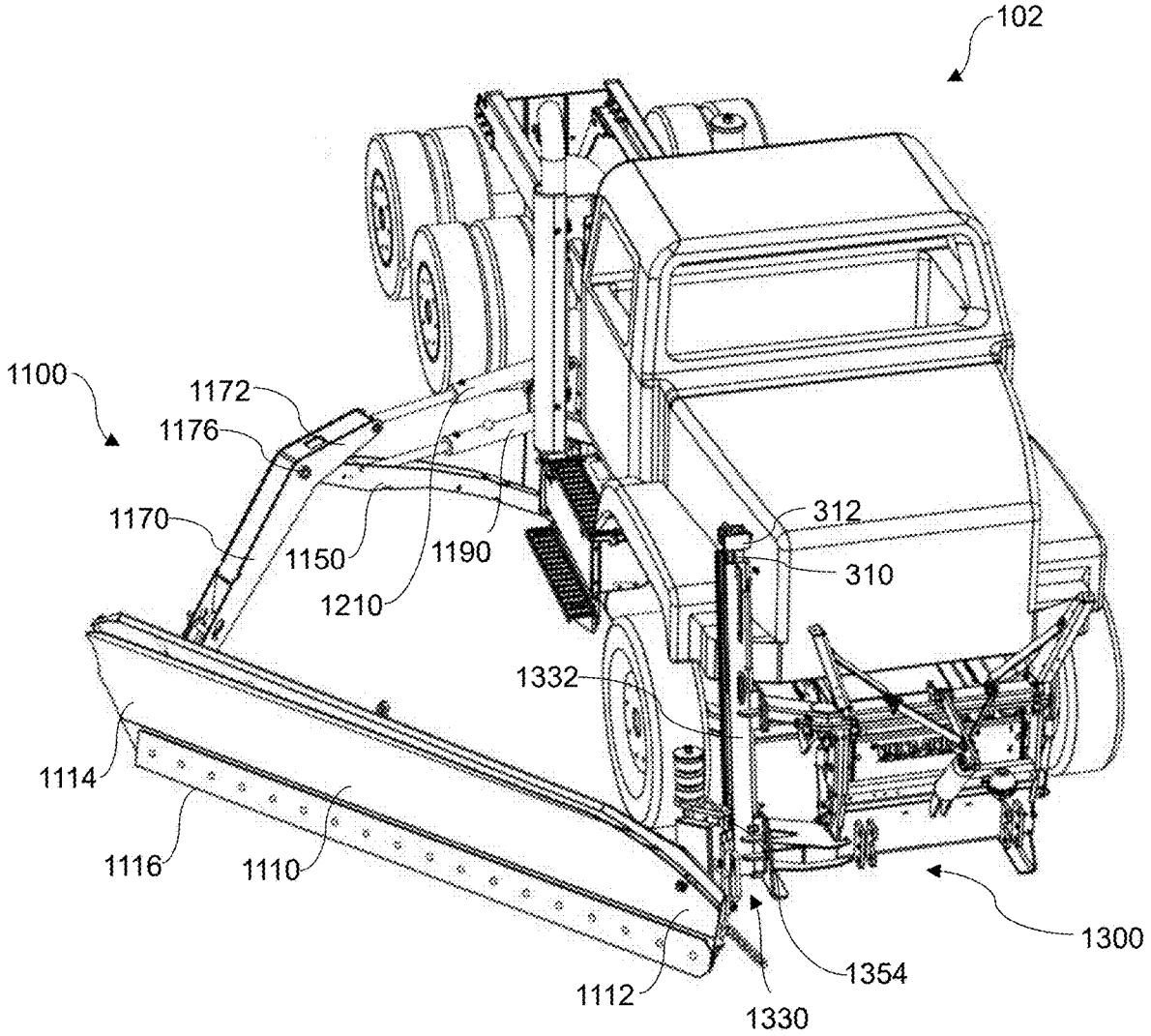
FIG. 20 is a right front upper perspective view of the support assembly of FIG. 14, with the wing moldboard in the second ground-proximity configuration with the wing moldboard fully extended outwardly from the vehicle.

The lower boom 1150, 2150, 2550, 2850 and the upper boom 1170, 2170, 2570, 2870 may be configured by size and shape, and interconnected pivotably or rotatably, so that the upper-boom distal portion 1174, 2174, 2574, 2874 travels a relatively flat path (relatively close to being parallel with a level-ground surface), while the upper-boom distal portion 1174, 2174, 2574, 2874 and the attached wing moldboard 1110, 2110 are also held at an appropriate height to avoid unwanted contact with the vehicle 102, when the wing moldboard 1110, 2110 is being moved to or stored in the storage position. As noted above, In the embodiments of FIGS. 14-36, a lower-boom mechanical actuator 190 is configured to be operatively connected to the lower boom 1150, 2150, 2550, 2850 to drive the lower boom 1150, 2150, 2550, 2850 between a first lower-boom position with a distal end 158 of the lower boom 1150, 2150, 2550, 2850 displaced a first horizontal distance from the rearward base 130, and a second lower-boom position with the distal end 158 (FIG. 13A) or other fixed portion of the lower boom 1150, 2150, 2550, 2850 displaced a second horizontal distance from the rearward base 130, with the second horizontal distance being greater than the first horizontal distance. In the illustrated embodiment, the lower-boom mechanical actuator 190 is a hydraulic cylinder, but the lower-boom mechanical actuator 190 may take the form of a pneumatic cylinder, an electric motor, or any other suitable mechanism known in the art for driving the lower boom 150 between the first lower-boom position and the second lower-boom position. For examples of such positions and horizontal distances, compare the stowed position (as in FIGS. 14 and 18) to the ground-proximity configuration (as in FIGS. 15, 16, 19, and 20). As a further example, compare a first ground-proximity configuration or retracted configuration (FIGS. 15 and 19) to a second ground-proximity configuration (FIGS. 16 and 20).

A rotation member is an upper cylinder 1210, 2510 in the embodiments of FIGS. 14-33; in the embodiment of FIGS. 34-36, the rotation member is a link 2810 of a fixed length. Each rotation member 1210, 2210, 2510, 2810 has a rotation-member proximal portion 1212, 2212, 2512, 2812 and a rotation-member distal portion in the form of an upper-cylinder distal portion upper-boom distal portion. In the illustrated embodiments, the upper cylinder 1210, 2510 is a hydraulic cylinder, but the upper cylinder 1210, 2510 may also take the form of a pneumatic cylinder, an electric motor, or any other suitable mechanism known in the art for driving the lower boom 150 between the first lower-boom position and the second lower-boom position. Alternatively, the rotation member 1210, 2510, 2810 may take the form of other mechanical actuator known in the art, including screw-type, magnetic, or other mechanical actuators. As an alternative to the disclosed mechanical actuators, the rotation member may take the form of a solid link or may be a tension member such as a cable or chain.

The rotation member 1210, 2210, 2510, 2810 may be configured to be operatively engaged with (here pivotably attached to) the rearward base 1130, 2130, 2530, 2830 and the rotation-member distal portion 1214, 2214, 2514, 2814 may be configured to be operatively engaged with (here pivotably attached to) the upper boom 1170, 2170, 2570, 2870. By exerting a tensile force on the upper boom 1170, 2170, 2570, 2870 (in particular, the upper-boom proximal portion thereof), the rotation member can pivot the upper boom 1170, 2170, 2570, 2870 with respect to the lower boom 1150, 2150, 2550, 2850 when the lower-boom mechanical actuator (shown as lower cylinder 1190, 2190, 2590, 2890) drives the lower boom 1150, 2150, 2550, 2850 between any first lower-boom position and any second lower-boom position. See, for example, FIGS. 15 and 16. The resulting movement of the upper-boom distal portion 1174, 2174, 2574, 2874 can drive the wing moldboard 1110, 2110 in a flat or relatively flat path over a portion of the range of motion of the support assembly 1100, 2100, 2500, 2800, increasing a width of a working range of the wing moldboard 1110, 2110 mounted on the support assembly 1100, 2100, 2500, 2800, in which the wing moldboard 1110, 2110 is held less than six inches above the a level-ground surface. The movement of the upper-boom distal portion 1174, 2174, 2574, 2874, and thus the movement of the attached wing moldboard 1110, 2110, may be considered to be a compound curve, particularly if the rotation member (upper cylinder 1210, 2510, and the lower-boom mechanical actuator 1190, 2290, 2590 are operated in alternating, sequential fashion, so that the upper-boom pivoting axis is located, at various times during a movement of the wing moldboard 1110, 2110, in two or more locations from which the upper boom 1170, 2170, 2570, 2870 may pivot upon the distal portion 1154 of the lower boom 1150, 2150, 2550, 2850.

Further, movement of the upper cylinder 1210, 2510 and the lower-boom mechanical actuator 1190, 2290, 2590 may be phased or otherwise controlled in cooperation to control movement of the upper-boom distal portion 1174, 2174, 2574, 2874, and thus to control movement of the wing moldboard 1110, 2110. For example, if it is desired to move the wing moldboard 1110, 2110 above the ground immediately, such as to clear an obstacle that the wing moldboard is approaching, the upper cylinder 1210, 2510 may be activated, alone or in conjunction with a lifting mechanism of the forward moldboard-support assembly 300, rapidly lifting the wing moldboard 1110, 2110 to a benching position (see FIG. 17) six inches or more above a level-ground surface. Thus lifting of the wing moldboard 1110, 2110 may be accomplished without following the multi-step procedure described above in the Background section, allowing for an emergency avoidance maneuver to be accomplished more quicky and with less risk of unwanted contact between the wing moldboard mechanism of the forward moldboard-support assembly 300, rapidly lifting the wing moldboard 1110, 2110 and portions of the vehicle 102.

In the support assembly 1100, 2100, 2500, 2800, and in any embodiment of a support assembly including a rotation member 1210, 2210, 2510, 2810, the rotation member has a rotation-member length—for example, length 216 (FIG. 13A). Extending or contracting the rotation-member length can alter the movement of the upper-boom distal portion 1174, 2174, 2574 and the wing moldboard 1110, 2110 in response to movement of the lower boom 1150, 2150, 2550. Moreover, extending and contracting the rotation-member length can alter the position of upper-boom distal portion 1174, 2174, 2574 and the wing moldboard 1110, 2110, such as by moving the wing moldboard 1110, 2110 between a ground-proximity configuration and a benching configuration.

Figure 17:
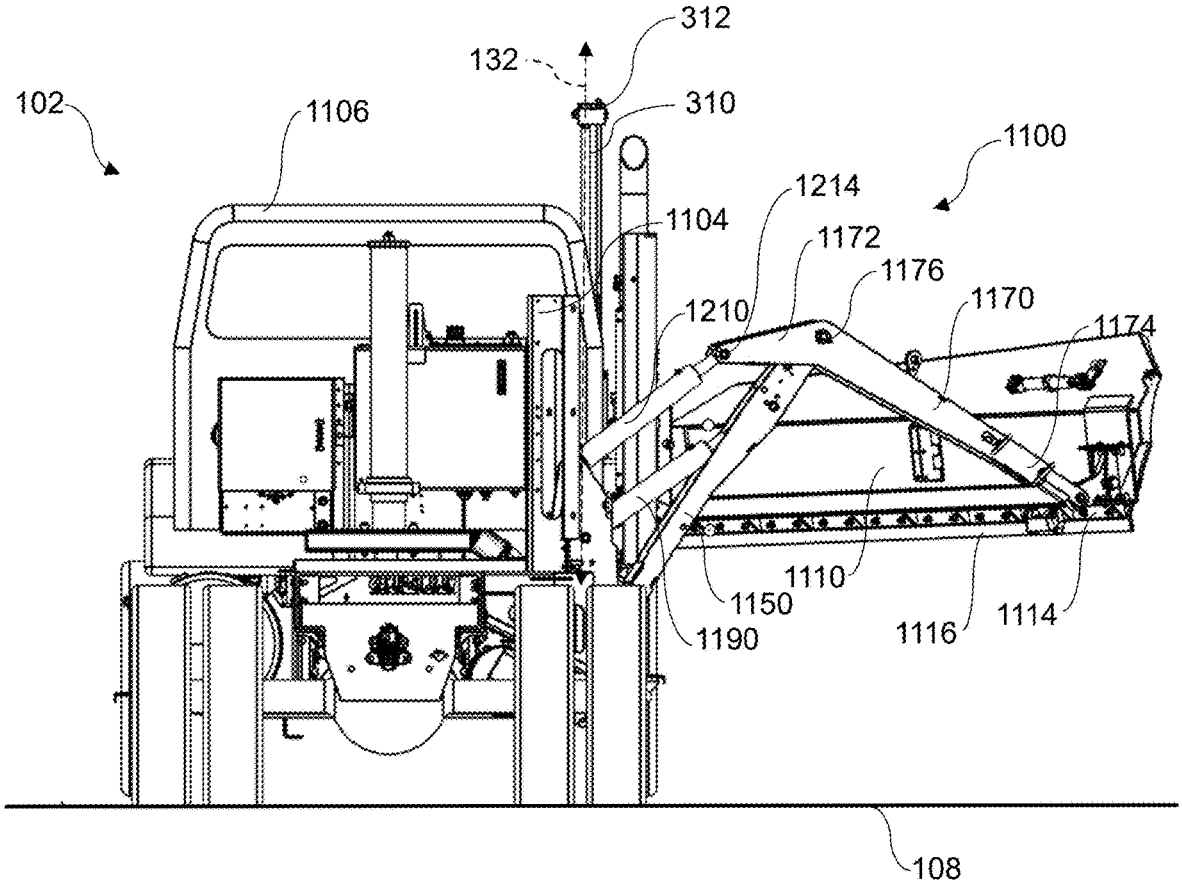
FIG. 17 is a rear elevational view of the support assembly of FIG. 14, with the wing moldboard held in a benching position with the wing moldboard fully extended outwardly from the vehicle and raised above a surface of the ground.
Figure 18:
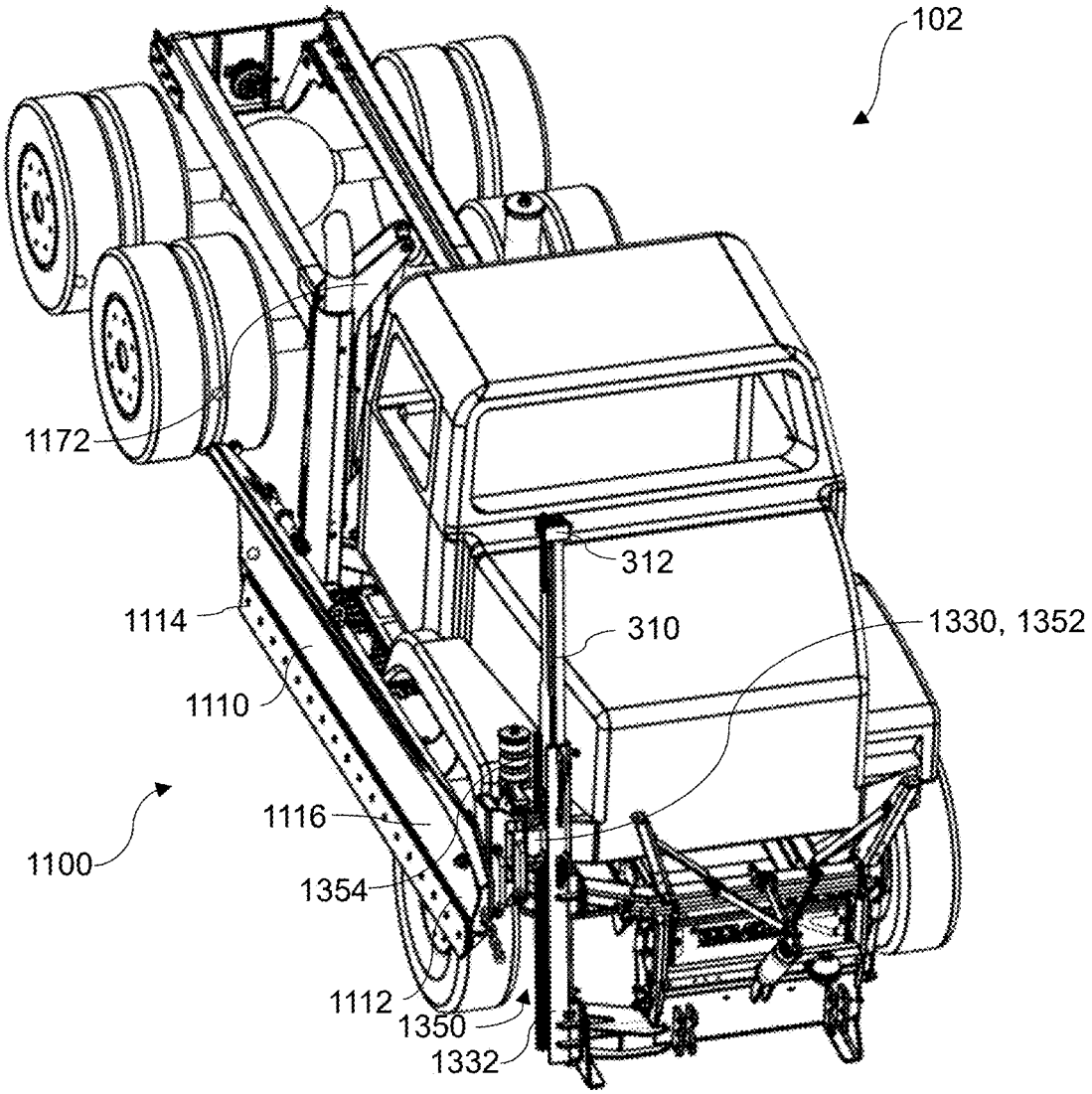
FIG. 18 is a right front upper perspective view of the support assembly of FIG. 14, with the wing moldboard in the storage position.
Figure 19:
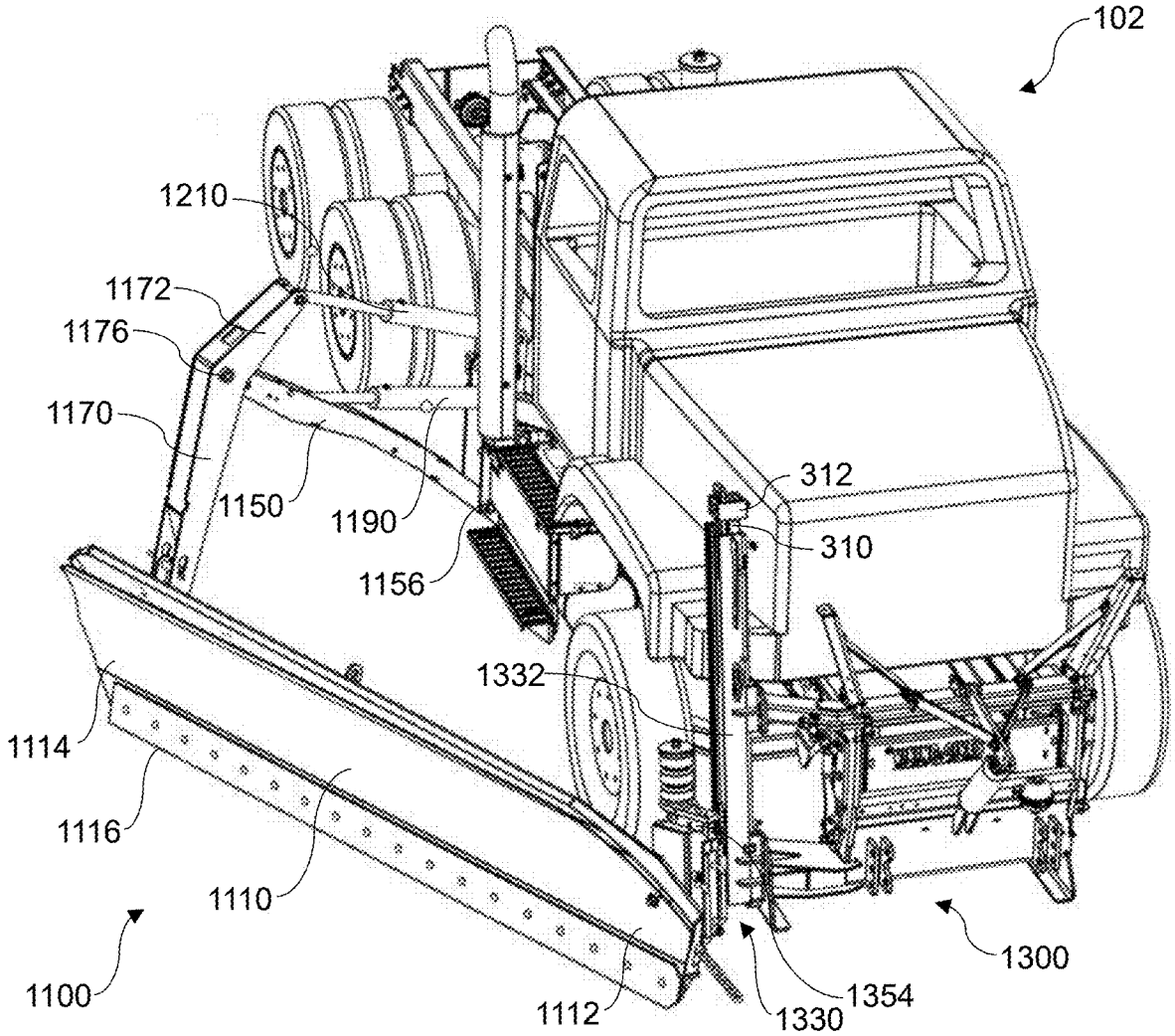
FIG. 19 is a right front upper perspective view of the support assembly of FIG. 14, with the wing moldboard in the first ground-proximity configuration wherein the wing moldboard is partially extended outwardly from the vehicle.
Figure 21:
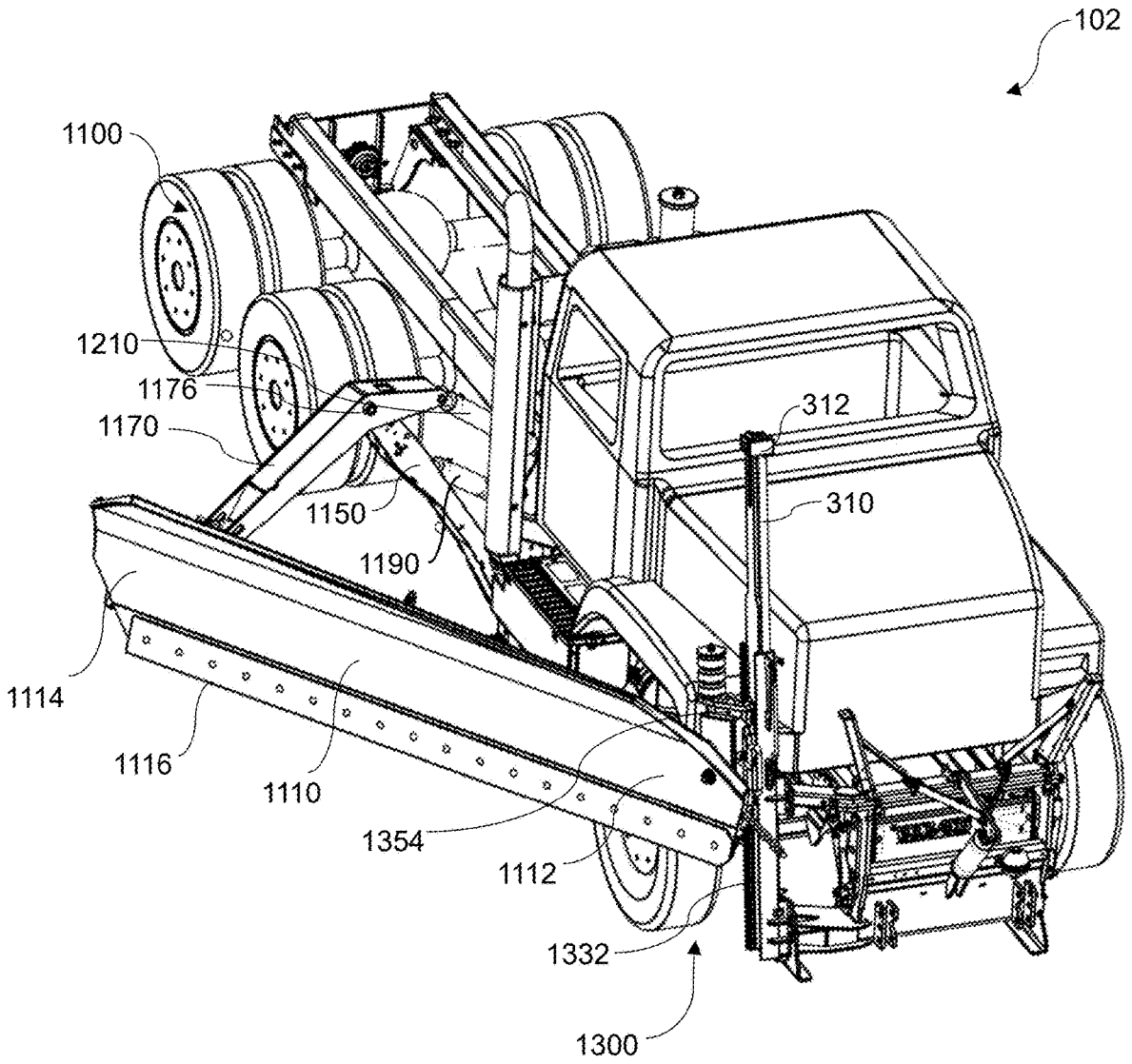
FIG. 21 is a right front upper perspective view of the support assembly of FIG. 14 with the wing moldboard held in a benching position with the wing moldboard fully extended outwardly from the vehicle and raised above the surface of the ground.
Figure 22:
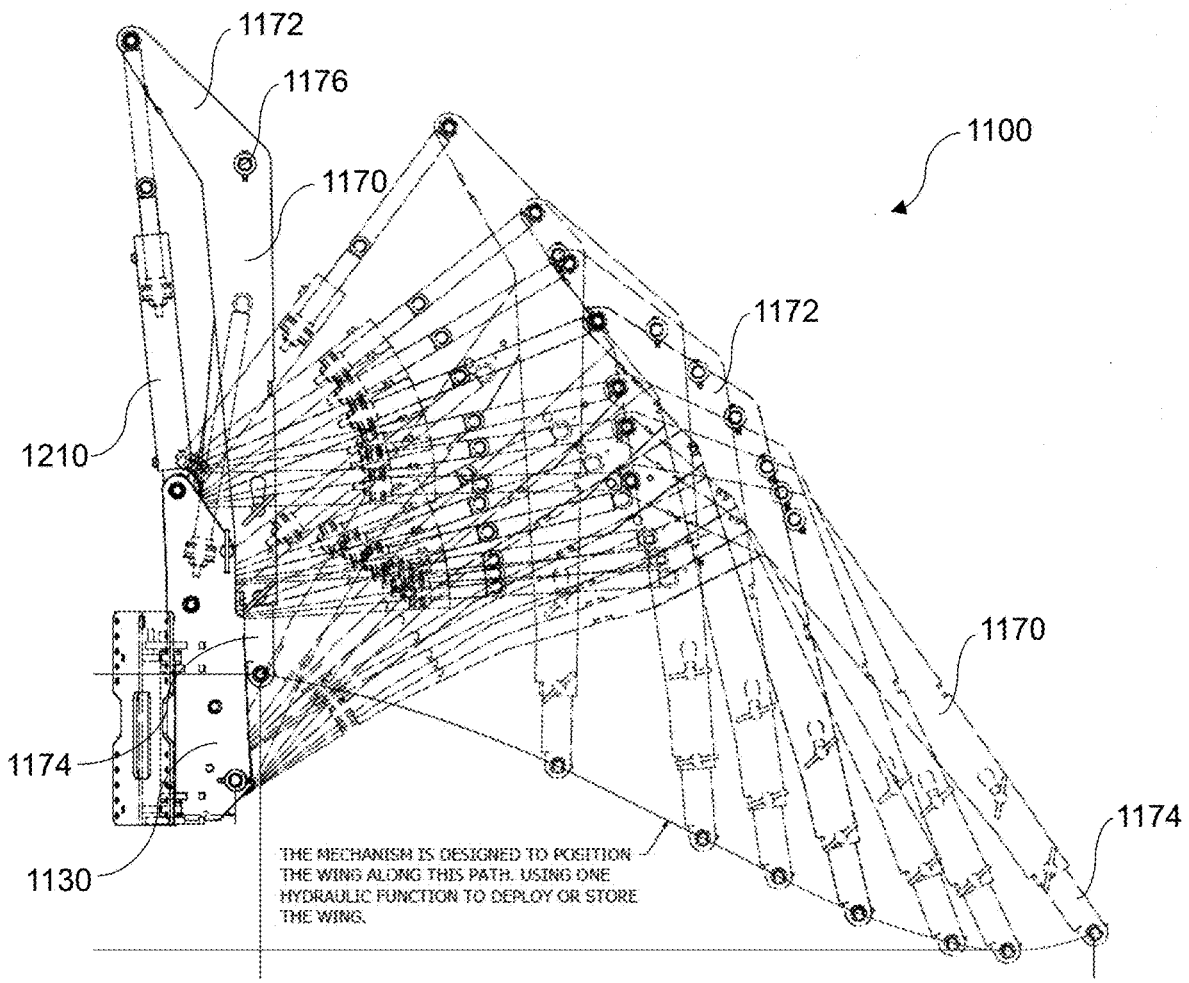
FIG. 22 is a partial right elevational multiple view of the support assembly of FIG. 14, showing paths of movements for components of the support assembly during movement between the storage position and the ground-proximity configuration.
Figure 25:
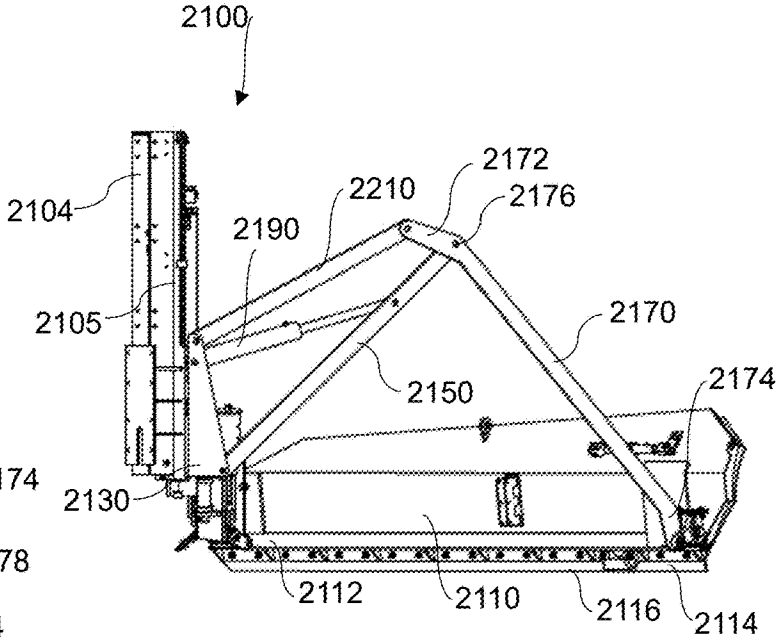
FIG. 25 is a right elevational view of the support assembly of FIG. 23, with the wing moldboard held in a second ground-proximity configuration or retracted configuration with the wing moldboard fully extended outwardly from the vehicle frame.
Figure 24:
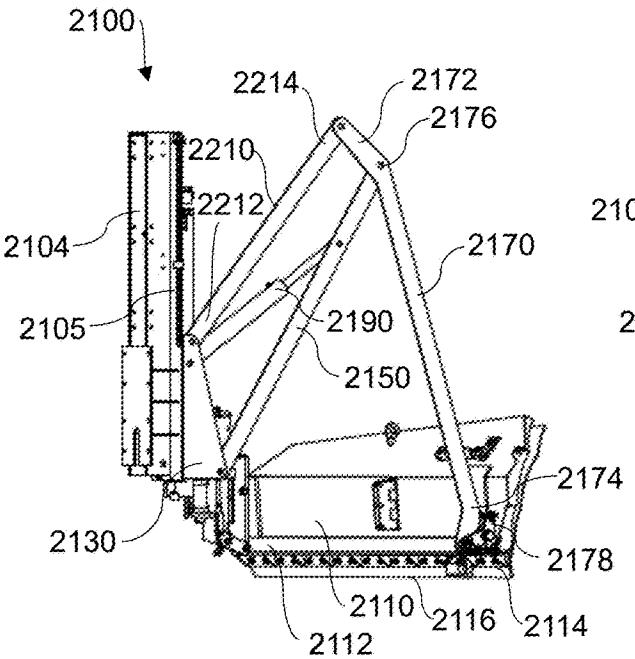
FIG. 24 is a right elevational view of the support assembly of FIG. 23, with the wing moldboard held in a first ground-proximity configuration wherein the wing moldboard is partially extended outwardly from the vehicle frame.
Figure 23:
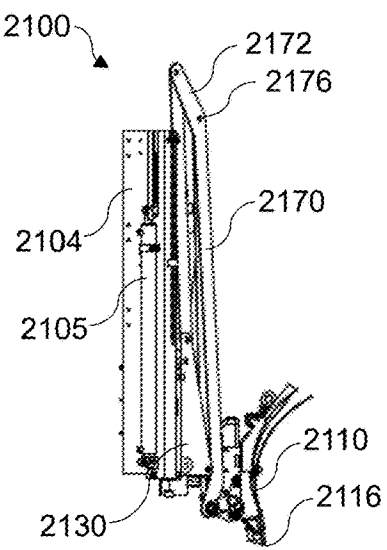
FIG. 23 is a right elevational view of a further embodiment of a support assembly including a wing moldboard, all according to the present disclosure, in a mounted configuration on a portion of a vehicle frame, with the wing moldboard in a storage position.
Figure 27:
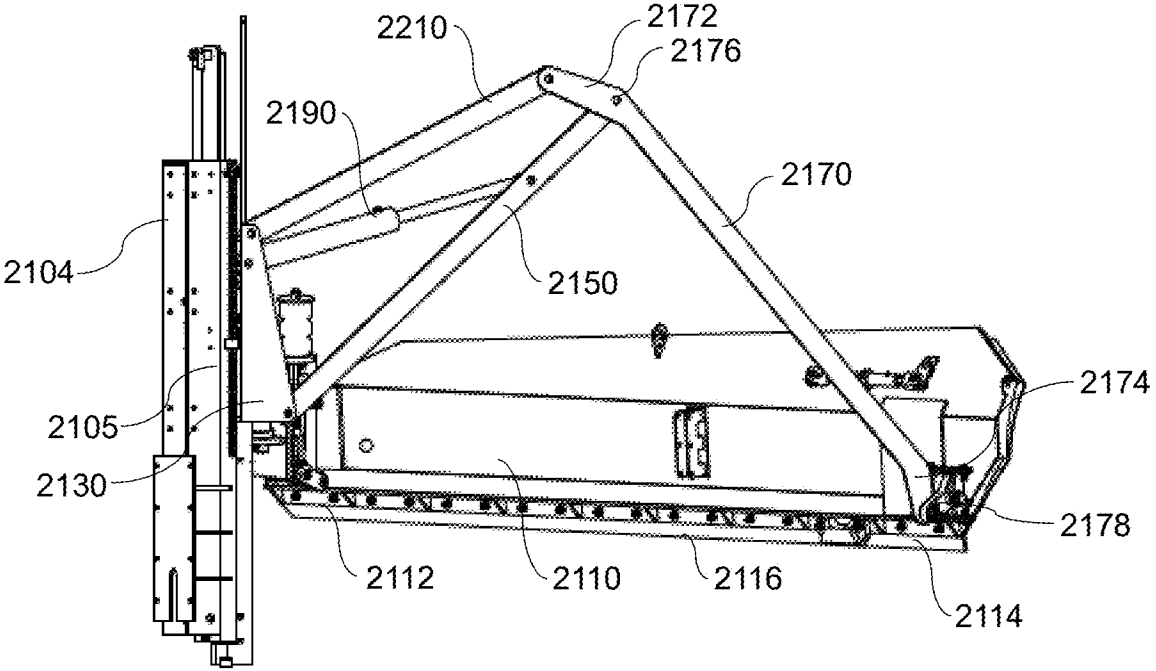
FIG. 27 is a right elevational view of the support assembly of FIG. 23, with the wing moldboard held in second storage position, with the wing moldboard held higher than in the storage position of FIG. 23.
Figure 26:
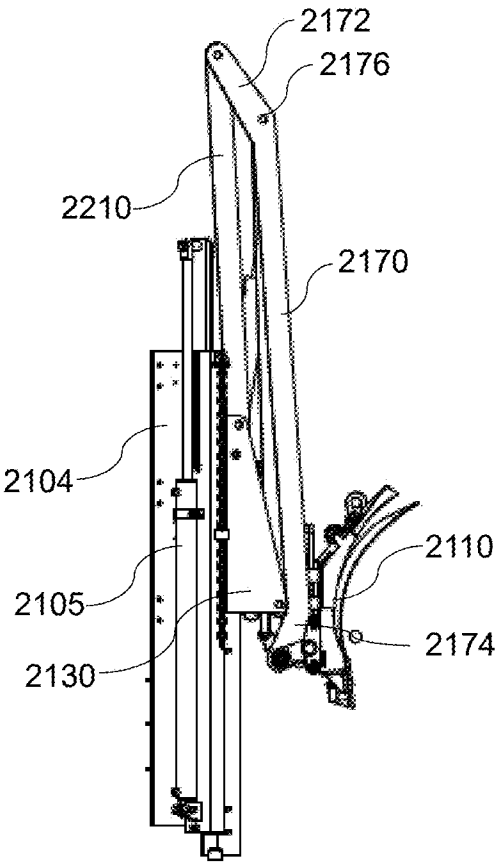
FIG. 26 is a right elevational view of the support assembly of FIG. 23, with the wing moldboard held in a raised storage position with the wing moldboard fully extended outwardly from the vehicle and raised above a surface of the ground.

Referring to FIGS. 16, 17, and 20-22, the wing moldboard 1110 is moved from the ground-proximity configuration of FIGS. 16 and 20 to the (slightly retracted) benching configuration of FIGS. 17 and 21 by a simultaneous contraction of the lower-boom mechanical actuator 1190 and the upper cylinder 1210. Alternatively, the wing moldboard 1110 may be raised to a benching configuration by contracting the upper cylinder 1210 alone, without contracting the lower cylinder 1190. Further, upper-boom distal portion 1174 (and hence any moldboard carried thereon) can be moved from a storage position to a working position by action of a single hydraulic function controlling the lower-boom mechanical actuator such as the lower cylinder 1190. Similarly, referring to FIGS. 23-33, the wing moldboard 2110, or the upper boom 2570 carrying the same, is moved from the ground-proximity configuration to the (slightly retracted) benching configuration of FIGS. 17 and 21 by a simultaneous contraction of the lower cylinder 2590 and the upper cylinder 2510. Alternatively, the wing moldboard 2110 may be raised to a benching configuration by contracting the upper cylinder 1210, 2510 alone, without contracting the lower cylinder 1190, 2590. Further, the upper-boom distal portion 1174, 2574 (and hence any moldboard carried thereon) can be moved from a storage position to a working position by action of a single hydraulic function controlling the lower cylinder 1190, 2590.

In the support assemblies 2100, 2800 of FIGS. 23-27 and 34-36, the rotation member is a fixed link 2210, 2810. The upper-boom distal portion 2214, 2814 (and hence any moldboard carried thereon) can be moved from a storage position to a working position by action of a single hydraulic function controlling the lower cylinder 2190, 2890. To provide a benching position, the support assembly 2100 includes a rearward base 2130 mounted to be movable vertically (such as by sliding on a vertical track) by an actuator such as a hydraulic cylinder 2105, as in the illustrated embodiment. With the rearward base 2130 so mounted, the wing moldboard 2110 may be displaced vertically for benching, or in an emergency to avoid an obstacle, by control of a single hydraulic element, the hydraulic cylinder 2105, without following the procedure set forth in the Background section.

Referring again to FIGS. 14-36, the upper boom 1170, 2170, 2570, 2870 may have a pivot arm formed by the upper-boom proximal portion 1172, 2172, 2572, 2872 projecting at least partially toward the vehicle 102 and operatively engaged with the rotation-member distal portion 1214, 2214, 2514, 2814. The pivot arm is formed as an upper-boom proximal portion 1172, 2172, 2572, 2872 which forms a moment arm exerting a torque to rotate the upper boom 1170, 2170, 2570, 2870 with respect to the upper-boom pivoting axis 1176, 2176, 2576, 2876.

The wing moldboard 1110, 2110 has a forward portion 1112, 2112, a rearward portion 1114, 2114, and a lower edge 1116, 2116, with the rearward portion 1114, 2114 being supported by the upper-boom distal portion 1174, 2174, 2574, 2874. The rearward portion 1114, 2114 of the wing moldboard 1110, 2110 may be connected to the upper-boom distal portion 1174, 2174, 2574, 2874 by a mounting link 1178, 2178 (not shown in views omitting the moldboard) providing a selected amount of free vertical motion or "float" between the wing moldboard 1110, 2110 and the upper-boom distal portion 1174, 2174, 2574, 2874. When the wing moldboard 1110, 2110 is held above the ground, the weight of the wing moldboard 1110, 2110 moves the mounting link 1178, 2178 to a lower end of its range of motion. When the lower edge 1116, 2116 of the wing moldboard 1110, 2110 strikes the ground or another obstacle, force exerted by the obstacle drives the wing moldboard 1110, 2110 and the mounting link 1178, 2178 upwardly. Unless and until the mounting link 1178, 2178 reaches an upper end of its range of motion, the obstacle acts only indirectly on the upper boom 1170, 2170, 2570, 2870. As a result, when the wing moldboard 1110, 2110 strikes the ground or another obstacle and is displaced less than the range of motion of the mounting link 1178, 2178 the impact with the obstacle has no effect, or at least a reduced effect, on the upper boom 1170, 2170, 2570, 2870, and the displacement is absorbed at least in part by movement of the mounting link 1178, 2178.

The support assembly 1100, 2100, 2500, 2800 has a ground-proximity configuration wherein the lower edge of the wing moldboard 1110, 2110 (or a wing moldboard mounted to the upper boom) is placed either in contact with the ground or less than about 6 inches distance above the ground, and a storage configuration wherein the lower edge of the wing moldboard 1110, 2110 is placed between ground level and 40 inches above the ground and within 2 feet, 1, feet, or half a foot, or a lesser distance of a side of the vehicle. The support assembly 1100, 2100, 2500, 2800 is selectively movable between the ground-proximity configuration and the storage configuration by extension and retraction of the lower-boom mechanical actuator (the lower cylinder 1190, 2190, 2590, 2890). In each such configuration, a vertical position of the wing moldboard 1110, 2110 is determined at least in part by a degree of extension of the lower-boom mechanical actuator.

Referring to FIGS. 14-33, the upper cylinder 1210, 2210, 2510 may be extended or retracted to select a ground-proximity configuration. When the upper cylinder 1210, 2210, 2510 is so configured, a movement of the support assembly 1100, 2100, 2500 from the ground-proximity configuration to the storage configuration may be driven or determined solely by retraction of the lower-boom mechanical actuator or lower cylinder 1190, 2190, 2590. A benching configuration is shown with respect to the support assembly 1100 in FIGS. 17 and 21; a similar benching configuration is shown with respect to the support assembly 2500 in FIG. 33.

The support assembly 100, 1100 has a ground-proximity configuration wherein the lower edge of the wing moldboard 1110, 2110 is placed either in contact with the level-ground surface (FIGS. 2, 3, 5, 6, 8, 9, 11, and 12), and a benching configuration (not shown separately, but analogous to the configuration shown in FIGS. 17 and 21) wherein the lower edge of the wing moldboard 1110, 2110 is placed at least six inches above the level-ground surface. The rotation-member length 216 (FIG. 13A) of the upper cylinder 210 in the ground-proximity configuration is greater than the rotation-member length 216 in the benching configuration, so that the support assembly 100 is selectively movable between the ground-proximity configuration and the benching configuration by extension and retraction of the rotation-member mechanical actuator, such as the upper cylinder 210.

The support assembly 100 may further comprise a central leveling link 230 (FIGS. 2, 3, 5, 6, and 11-13B) operatively engaged with—for example, pivotably attached to—the lower boom 1150, 2150, 2550, 2850. A moldboard-support link 250 in the form of a mounting link 178 (FIG. 13A) may be operatively engaged with—for example, pivotably attached to—the upper-boom distal portion 1174, 2174, 2574, 2874 of the upper boom 1170, 2170, 2570, 2870, the moldboard-support link 250 configured to engage and support the moldboard 1110, 2110 to pivot with the moldboard-support link 250. An outer leveling link 270 (two are shown) may have an outer-leveling-link proximal portion 272 and an outer-leveling-link distal portion 274 (FIG. 13A), the outer-leveling-link proximal portion 272 being configured to be operatively engaged with—for example, pivotably attached to—a first portion of the central leveling link 230, and the outer-leveling-link distal portion 274 being configured to be operatively engaged with—for example, pivotably attached to—the moldboard-support link 178, 250. An inner leveling link 290 may have an inner-leveling-link proximal portion 292 and an inner-leveling-link distal portion 294 (FIG. 13A), the inner-leveling-link proximal portion 292 being configured to be operatively engaged with—for example, pivotably attached to—the rearward base 130. The inner-leveling-link distal portion 292 may be configured to be operatively engaged with—for example, pivotably attached to—a second portion of the central leveling link 230. The inner leveling link 290, the central leveling link 230, and the outer leveling link 270 may be configured to pivot the moldboard-support link 178, 250 with respect to the lower boom 1150, 2150, 2550, 2850 when the lower-boom mechanical actuator (here the lower cylinder 190) drives the lower boom 1150, 2150, 2550, 2850 between the first lower-boom position and the second lower-boom position, so that the moldboard-support link 178, 250 maintains a selected angular orientation of the moldboard 1110, 2110 during motion of the support assembly and the lower boom 1150, 2150, 2550, 2850 thereof. Note that the central leveling link 230, the outer leveling link 270, the inner leveling link 290 may be used with other embodiments of the support assembly 1100, 2100, 2500, 2800, with the mounting link 1178, 2178 being connected as the same fashion as the moldboard-support link 250 to be held in a selected orientation as explained above.

In any embodiment of the support assembly 100, 1100, 2100, 2500, 2800, the support assembly 100, 1100, 2100, 2500, 2800 may further comprise a forward moldboard-support assembly including a forward hinge mount movable from a first height to a second height. In the support assembly 100 of FIGS. 1-13B, referring to FIG. 4-6, the forward moldboard-support assembly 300 includes the forward hinge mount 330, which is movably mounted on a mast 332. The forward hinge mount 330 moves along a track on the mast 332 and may be raised and lowered by being connected via a cable and pulley to drive block, with the drive block in turn driven by a hydraulic cylinder. The drive block may be driven by any conventional mechanism, such a hydraulic cylinder or another type of mechanical actuator. In the support assembly 100, a forward moldboard hinge 350 is operatively connected to the forward hinge mount 330 to travel along the mast 332 therewith. In the support assembly 100, the forward moldboard hinge 350 includes a proximal leaf element 352 connected to, and in this case integrally formed with, the forward hinge mount 330, and a distal leaf element 354 configured to be operatively connected to the forward hinge mount 330 by, for example, a pin 356.

Thus FIGS. 1-13B show a plowing system comprising the vehicle 102, the wing moldboard 1110, 2110 operatively connected to the vehicle 102, and the support assembly 100.

In any embodiment of the support assembly 100, 1100, 2100, 2500, 2800, the upper boom may have a pivot arm projecting at least partially toward the vehicle 102 and operatively engaged with the rotation-member distal end portion.

In any embodiment of the support assembly 100, 1100, 2100, 2500, 2800, the wing moldboard 1110, 2110 may have a forward portion 112, a rearward portion 114, and a lower edge 116, with the rearward portion 114 being supported by the upper-boom distal portion 174, 1174, 2174, 2574, 2874.

In any embodiment of the support assembly 100, 1100, 2100, 2500, 2800, the support assembly 100 may have a ground-proximity configuration wherein the lower edge of the wing moldboard 1110, 2110 is placed either in contact with the ground or less than about six inches above the ground, and a storage configuration wherein the lower edge of the wing moldboard 1110, 2110 is placed between ground level and 40 inches above the ground and aligned with a body of the vehicle (and may be within 2 feet, 1, feet, or half a foot, or a lesser distance of a side of the vehicle), so that the support assembly 100, 1100, 2100, 2500, 2800 is selectively movable between the ground-proximity configuration and the storage configuration by extension and retraction of the lower-boom mechanical actuator (such as the lower cylinder 190, 1190, 2190, 2590, 2890), and a vertical position of the wing moldboard 1110, 2110 is determined by a degree of extension of the lower-boom mechanical actuator.

In any embodiment of the support assembly 100, 1100, 2100, 2500, 2800, the support assembly 100, 1100, 2100, 2500, 2800 may have a ground-proximity configuration wherein the lower edge of the wing moldboard 1110, 2110 is placed either in contact with the level-ground surface or less than six inches above the level-ground surface, and a storage configuration wherein the lower edge of the wing moldboard 1110, 2110 is placed between ground level and 40 inches above the level-ground surface and aligned with a body of the vehicle (and may be within 2 feet, 1, feet, or half a foot, or a lesser distance of a side of the vehicle), so that the support assembly 100, 1100, 2100, 2500, 2800 is selectively movable between the ground-proximity configuration and the storage configuration by extension and retraction of the lower-boom mechanical actuator. A movement of the support assembly 100, 1100, 2100, 2500, 2800 from the ground-proximity configuration to the storage configuration may be driven or determined by retraction of the lower-boom mechanical actuator, so that a movement of the support assembly from the ground-proximity configuration to the storage configuration may be driven or determined solely by retraction of the lower-boom mechanical actuator such as the lower cylinder 190, 1190, 2190, 2590, 2890).

In any embodiment of the support assembly 100, 1100, 2100, 2500, 2800, the support assembly 100, 1100, 2100, 2500, 2800 may have a ground-proximity configuration wherein the lower edge of the wing moldboard 1110, 2110 is placed either in contact with the level-ground surface or less than six inches above the level-ground surface, and a benching configuration wherein the lower edge 1116, 2116 of the wing moldboard 1110, 2110 is placed at least six inches above the level-ground surface. The rotation-member length of the rotation member 1210, 2510 in the ground-proximity configuration (where adjustable) may be greater than the rotation-member length in the benching configuration, so that the support assembly 1100, 2500 is selectively movable between the ground-proximity configuration and the benching configuration by extension and retraction of the rotation-member mechanical actuator (upper cylinder 1210, 2510).

Any embodiment of the support assembly 1100, 2100, 2500, 2800 may further comprise a central leveling link 230, moldboard-support link 250, outer leveling link 270, and inner leveling link 290 operatively engaged with the lower boom and the moldboard as in the embodiment of FIGS. 1-13B.

The support assembly 1100, 2100, 2500, 2800 may further comprise a forward moldboard-support assembly 1300 including a forward hinge mount 1330 movable from a first height to a second height, as shown in FIGS. 18-21. The forward hinge mount 1330 may be raised and lowered by any conventional mechanism, such hydraulic cylinder or other mechanical actuator. The forward hinge mount 1330 moves lengthwise along the mast 1332 and may be raised and lowered by being connected via a cable and pulley to drive block, with the drive block in turn driven by a hydraulic cylinder. Alternatively, the forward hinge mount 1330 may be driven directly. The drive block or the forward hinge mount 1330 may be driven by any conventional mechanism, such a hydraulic cylinder or another type of mechanical actuator. A forward moldboard hinge 1350 may be operatively connected to the forward hinge mount 1330. The forward moldboard hinge 1350 may include a proximal leaf element 1352 configured to be operatively connected to the forward hinge mount 1330, and a distal leaf element 1354 configured to be operatively connected to the proximal leaf element 1352 and to the wing moldboard 1110. In the support assembly 1100, the forward moldboard hinge 1350 includes a proximal leaf element 1352 connected to, and in this case integrally formed with, the forward hinge mount 1330, and a distal leaf element 1354 configured to be operatively connected to the forward hinge mount 1330 by, for example, a pin.

In any embodiment of the support assembly 1100, 2100, 2500, 2800 may be incorporated into a plowing system comprising a vehicle 102; a wing moldboard 1110, 2110 operatively connected to the vehicle; and the support assembly 1100, 2100, 2500, 2800, the support assembly 1100, 2100, 2500, 2800 being operatively connected to both the vehicle 102 and the wing moldboard 1110, 2110, thereby operatively connecting the wing moldboard 1110, 2110 to the vehicle 102.

Figure 28A:
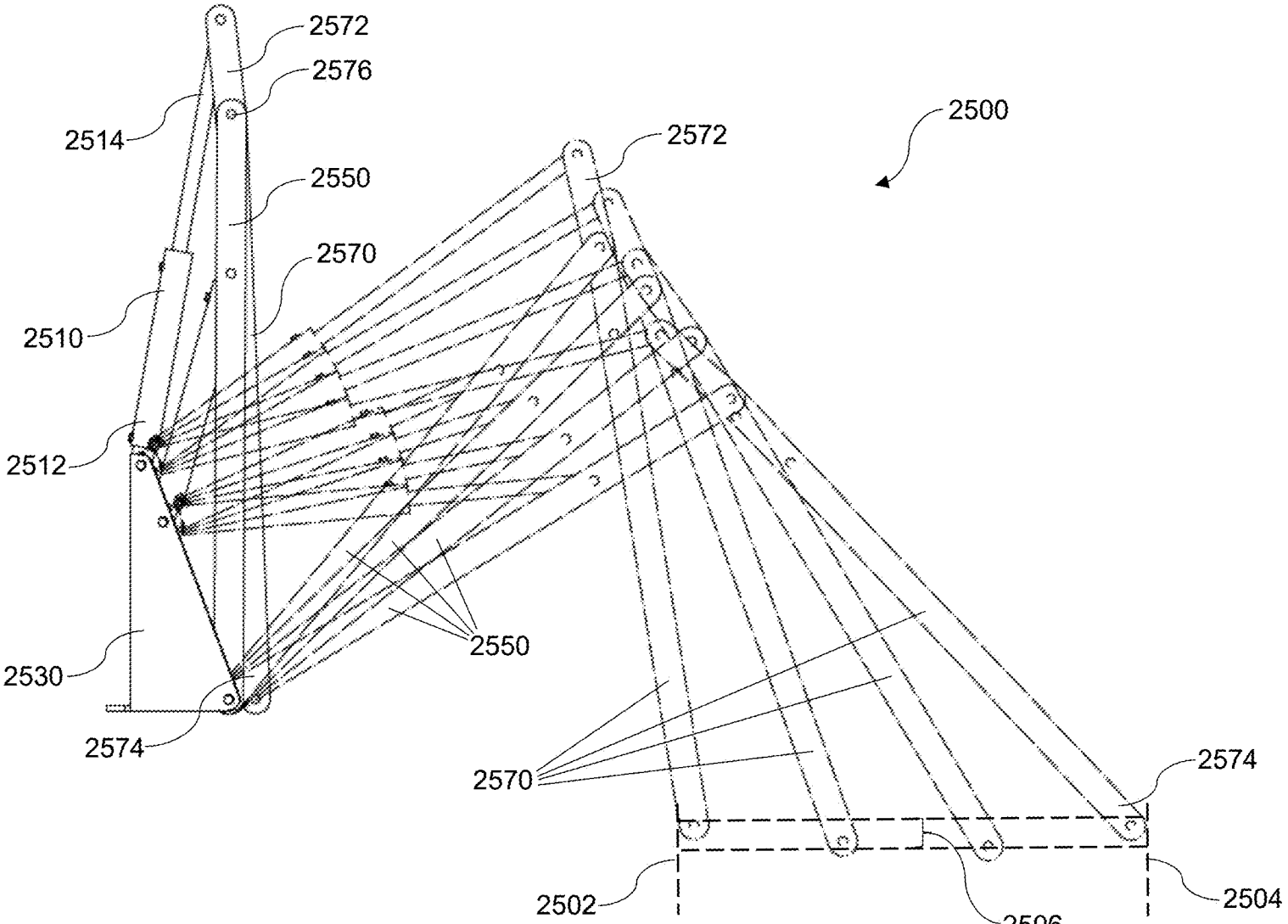
FIG. 28A is a partial right elevational multiple view of a further embodiment of a support assembly according to the present disclosure, showing paths of movements for components of the support assembly during movement between the storage position and ground-proximity configurations or working positions thereof.
Figure 28B:
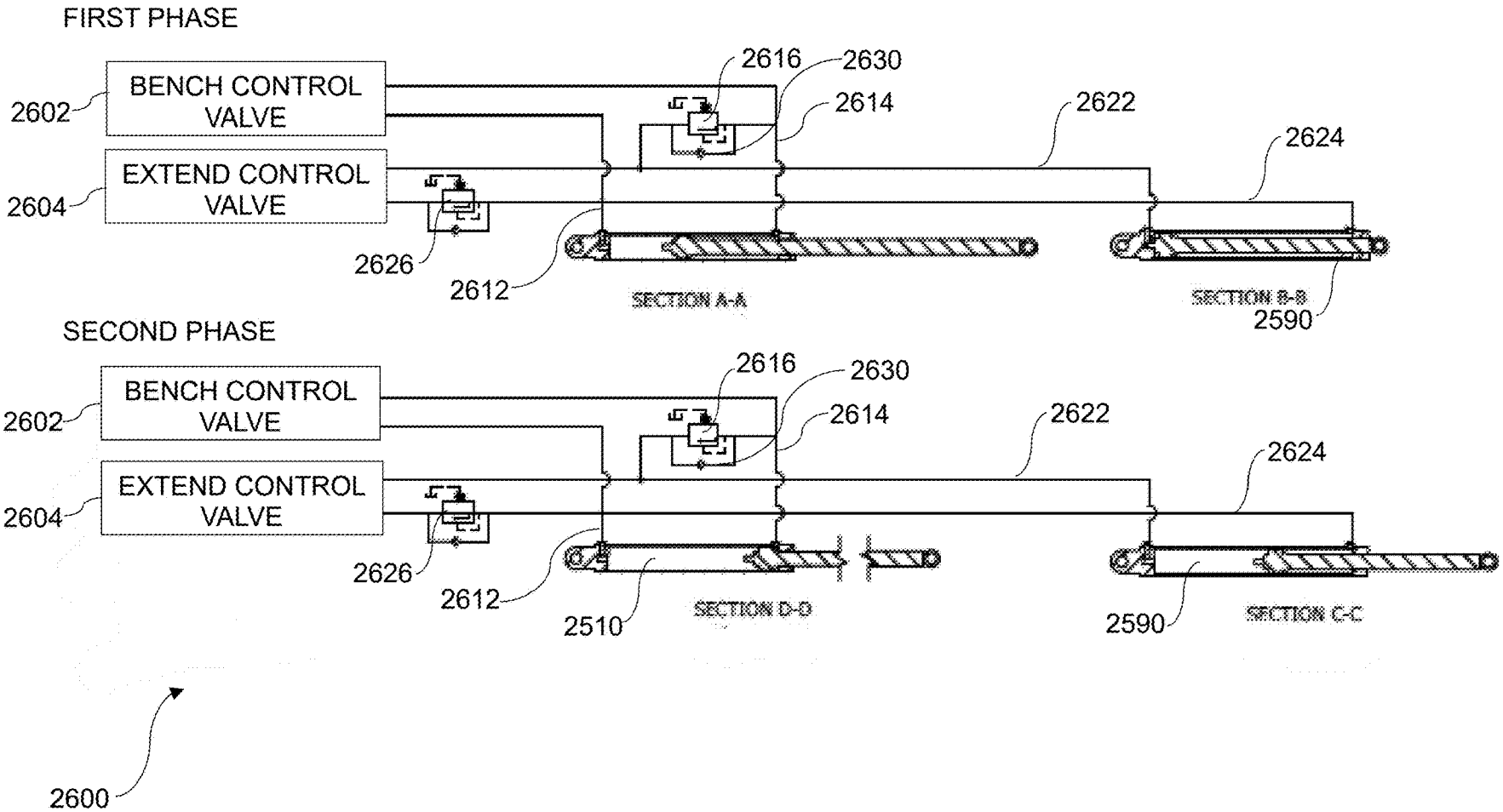
FIG. 28B is a partially schematic, partially sectional view of a control arrangement for the support assembly of FIG. 28A.
Figure 29:
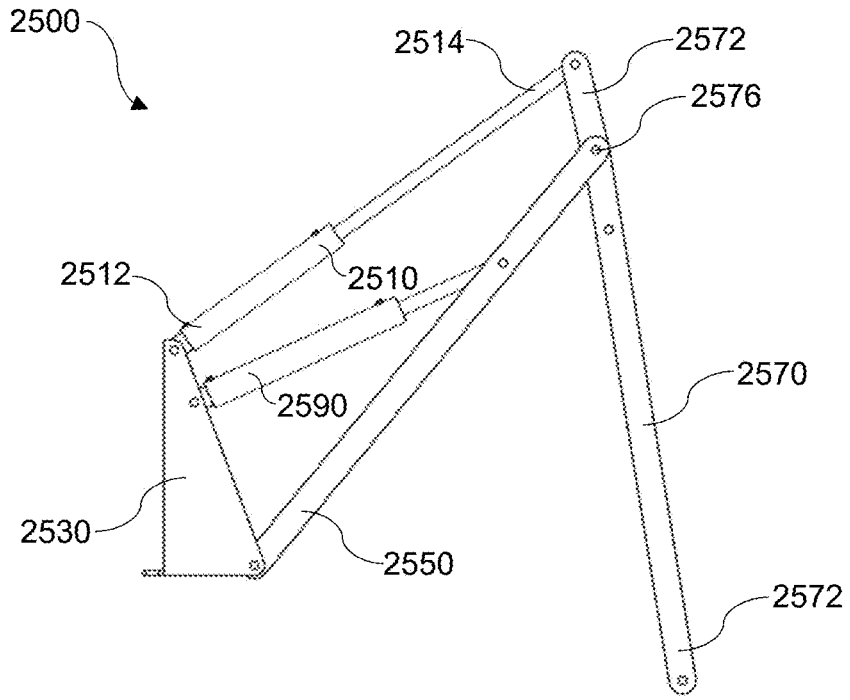
FIG. 29 is a right elevational partial view of the support assembly of FIG. 28A in a first position.
Figure 30:
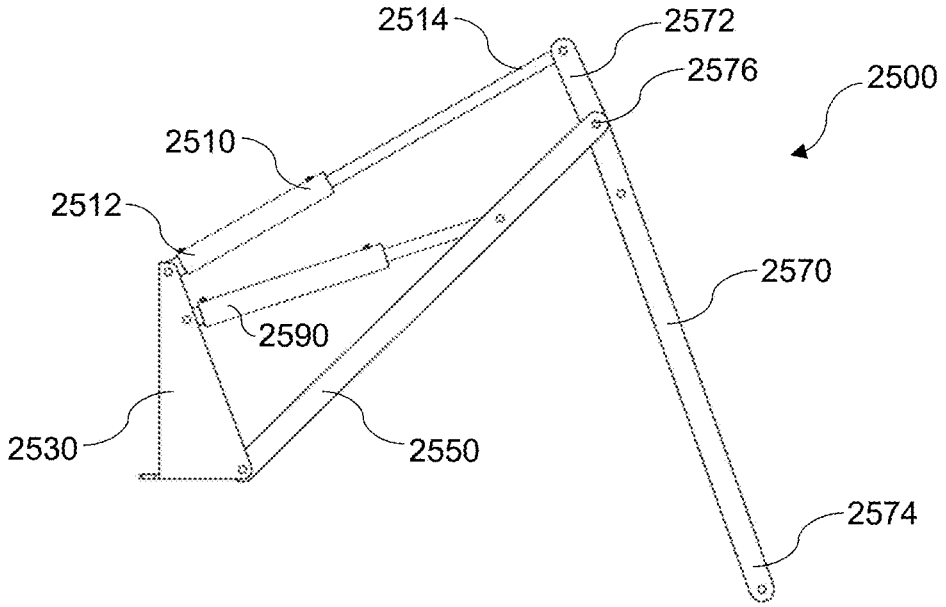
FIG. 30 is a right elevational partial view of the support assembly of FIG. 28A in a second position, with the lower boom extended outwardly as compared to the first position.
Figure 31:
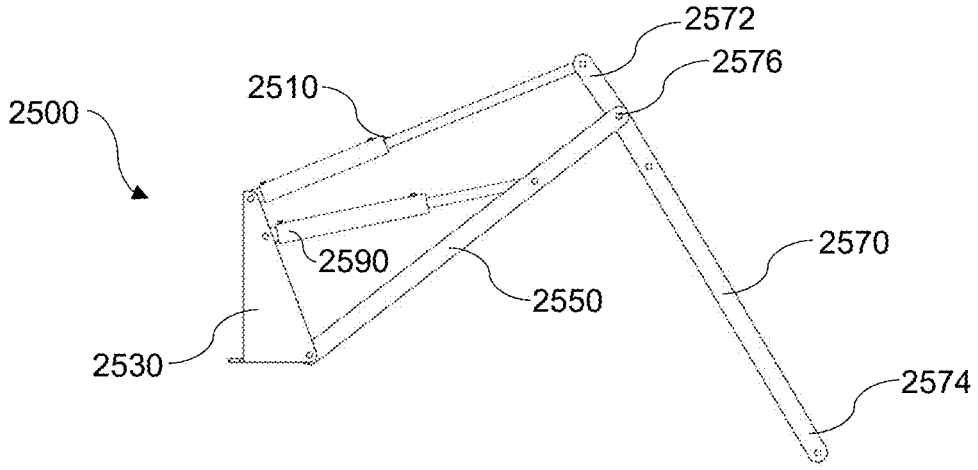
FIG. 31 is a right elevational partial view of the support assembly of FIG. 28A in a third position, wherein the upper cylinder 2510 is in a contracted state as compared to the second position.
Figure 32:
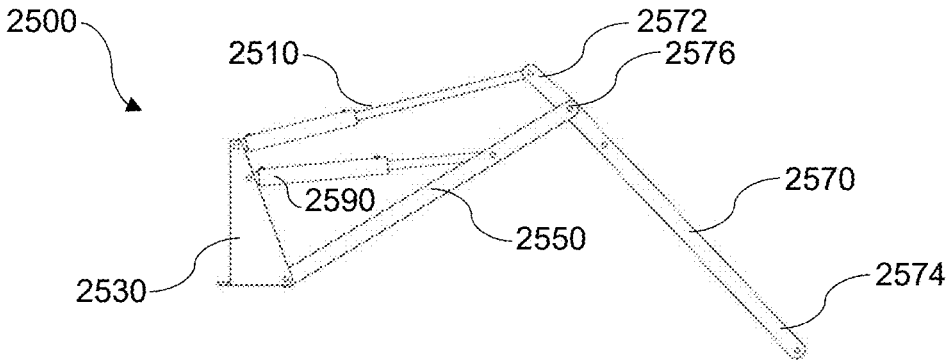
FIG. 32 is a right elevational partial view of the support assembly of FIG. 28A in a fourth position, wherein the upper cylinder 2510 is in a contracted state as compared to the third position.
Figure 33:
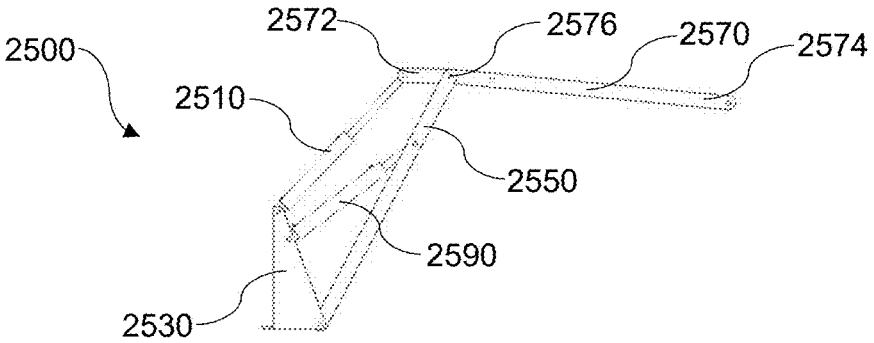
FIG. 33 is a right elevational partial view of the support assembly of FIG. 28A in a fifth position, wherein the upper cylinder 2510 and the lower cylinder 2590 are each in a contracted state as compared to the fourth position.

Referring to FIG. 28B, in any embodiment of the support assembly 100, 1100, 2500 having both a lower cylinder 190, 1190, 2590 (2590 as shown) and an upper cylinder 210, 1210, 2510, a control arrangement 2600 may be provided interconnecting the lower cylinder 190, 1190, 2590 (2590 as shown) and the upper cylinder 210, 1210, 2510 for coordinated control thereof. An extend control valve 2604 may be provided to selectively permit and block hydraulic flow to the lower cylinder 2590 via an extension line 2622 and a contraction line 2624, which provides both a return to the extend control valve 2604 and a parallel connection to a accumulator 2626. A bench control valve 2602 may be provided to selectively permit and block hydraulic flow to the upper cylinder 2510 via an extension line 2612 and a contraction line 2614. In the control arrangement 2600, the contraction line 2624 provides a return to the bench control valve 2602, a parallel connection to a accumulator 2616, and a further parallel connection 2630 to the extension line 2622. As a result of this arrangement, by opening the extend control valve 2604, a phased movement may be provided wherein the upper cylinder 2510 fully extends and then, once the upper cylinder is 2510 is fully extended, maintaining the extend control valve 2604 in the open state provides hydraulic fluid through the extension line 2622 to extend the lower cylinder 2590. The phased movement may be provided in response to a single control input—for example, an input opening the bench control valve 2602 and supplying hydraulic fluid to extend the upper cylinder 2510. The same or a similar control scheme may be implemented through an electronic controller, which could provide the phased movement through electronic control of the bench control valve 2602 and the extend control valve 2604.

In any embodiment of the support assembly 100, 1100, 2100, 2500, 2800, the lower-boom mechanical actuator may comprise a lower cylinder 190, 1190, 2190, 2590, 2890 as shown in FIGS. 1-36. As in the devices of FIGS. 1-36, the rotation-member mechanical actuator may take the form of a hydraulic cylinder 210, 1210, 2110, 2510, 2810, or of other mechanical actuators known in the art, as discussed above.

In another aspect, referring to FIGS. 37-46, a support assembly 3000 is disclosed for mounting to a lower portion of a moldboard 3110. The support assembly 3000 comprises a frame base 3010 fixed to the moldboard 3110. A travel-angle frame 3012 is attached to the frame base 3010 to pivot with respect to the moldboard 3110 about a travel-angle axis 3030.

The travel-angle frame 3012 may be, and is in the illustrated embodiment, includes a main member, which may take the form of a shaft 3050, which may be pivotably attached to the frame base 3010. In the illustrated embodiment, the shaft 3050 is captured between two projections 3014 of the frame base 3010. A pair of travel-angle links 3056 are non-rotatably fixed with respect to the shaft 3050 so that when the travel-angle links 3056 are driven to pivot about the travel-angle axis 3030, the travel-angle links 3056 drive the shaft 3050 to rotate as well. The travel-angle links 3056 are disposed on the shaft 3050 in alignment with one another and at least essentially parallel to one another (and essentially perpendicular to the shaft 3050). The travel-angle links 3056 may be joined by a bolt 3058 offset from the shaft 3050. The travel-angle frame 3012 also includes an anchor 3054 non-rotatably fixed with respect to the shaft 3050 to rotate therewith, and carrying an anchor body 3055, which is a plate with an aperture therein.

A spindle 3100 is mounted upon the travel-angle frame 3012 non rotatably with respect thereto, so that an angle between the spindle 3100 and the moldboard 3110 changes when the travel-angle frame pivots about the travel-angle axis 3030. A spindle arm 3102 is attached to the spindle 3100 and, as in the illustrated embodiment, may be integrally formed therewith. The spindle arm 3102 may define a spindle portion including the spindle 3100, an intermediate portion 3104 extending transversely from the spindle portion, and a mounting portion 3106 extending transversely from the intermediate portion. In the illustrated embodiment, the travel-angle frame 3012 has a spindle mount 3053, secured to the shaft 3050 by a pair of links 3052, for rotatably engaging a mounting portion 3106 of the spindle arm 3102. The spindle mount 3053 and the links 3052 are non-rotatably attached with respect to the shaft 3050 to form a part of the travel-angle frame 3012, rotating therewith about the travel-angle axis 3030, so that the travel-angle actuator 3080 may drive the travel-angle frame 3012 to adjust a travel angle of the wheel 3160 with respect to the moldboard 3110. A wheel 3160 rotatably mounted upon the spindle 3100.

A wheel-height actuator 3120 is configured to position the spindle 3100 vertically with respect to the travel-angle frame 3012 and thereby to position the wheel 3160 at a selected vertical position with respect to the moldboard 3110. In the illustrated embodiment, the wheel-height actuator 3120 is a hydraulic cylinder. The wheel-height actuator 3120 is operatively connected to both the anchor body 3055 of the travel-angle frame 3012 and to a crank arm 3140 attached to and extending transversely from the spindle arm 3102. The crank arm has a crank-arm anchor 3142 in the form of a bolt configured to engage a distal end of the wheel-height actuator 3120. The wheel-height actuator 3120 is thus configured to exert a torque on the spindle arm 3102 via the crank arm 3140, causing the spindle arm 3102 to rotate with respect to the spindle mount 3053.

The spindle arm 3102 may define a spindle portion including the spindle 3100, an intermediate portion 3104 extending transversely from the spindle portion and the spindle 3100, and a mounting portion 3106 extending transversely from the intermediate portion. The spindle arm 3102 is pivotably mounted in the spindle mount 3053. The wheel-height actuator 3120 may be configured to pivot the spindle arm 3102 about the spindle mount 3053, rotating the spindle arm 3102 about the spindle mount 3053 to position the wheel 3160 at the selected vertical position.

A travel-angle actuator 3080 in the form of a hydraulic cylinder is configured to pivot the travel-angle frame 3012 with respect to the frame base 3010. The travel-angle actuator 3080 has a proximal end portion 3082 operatively attached to the moldboard 3110 at an moldboard anchor 3114 (FIG. 38) and a distal end portion 3084 operatively attached to the travel-angle frame 3012 by engaging the bolt 3058 joining the travel-angle links 3056. By extending and retractive the travel-angle actuator 3080, an angular position of the wheel 3160 with respect to the moldboard 3110 may be controlled.

Figure 38:
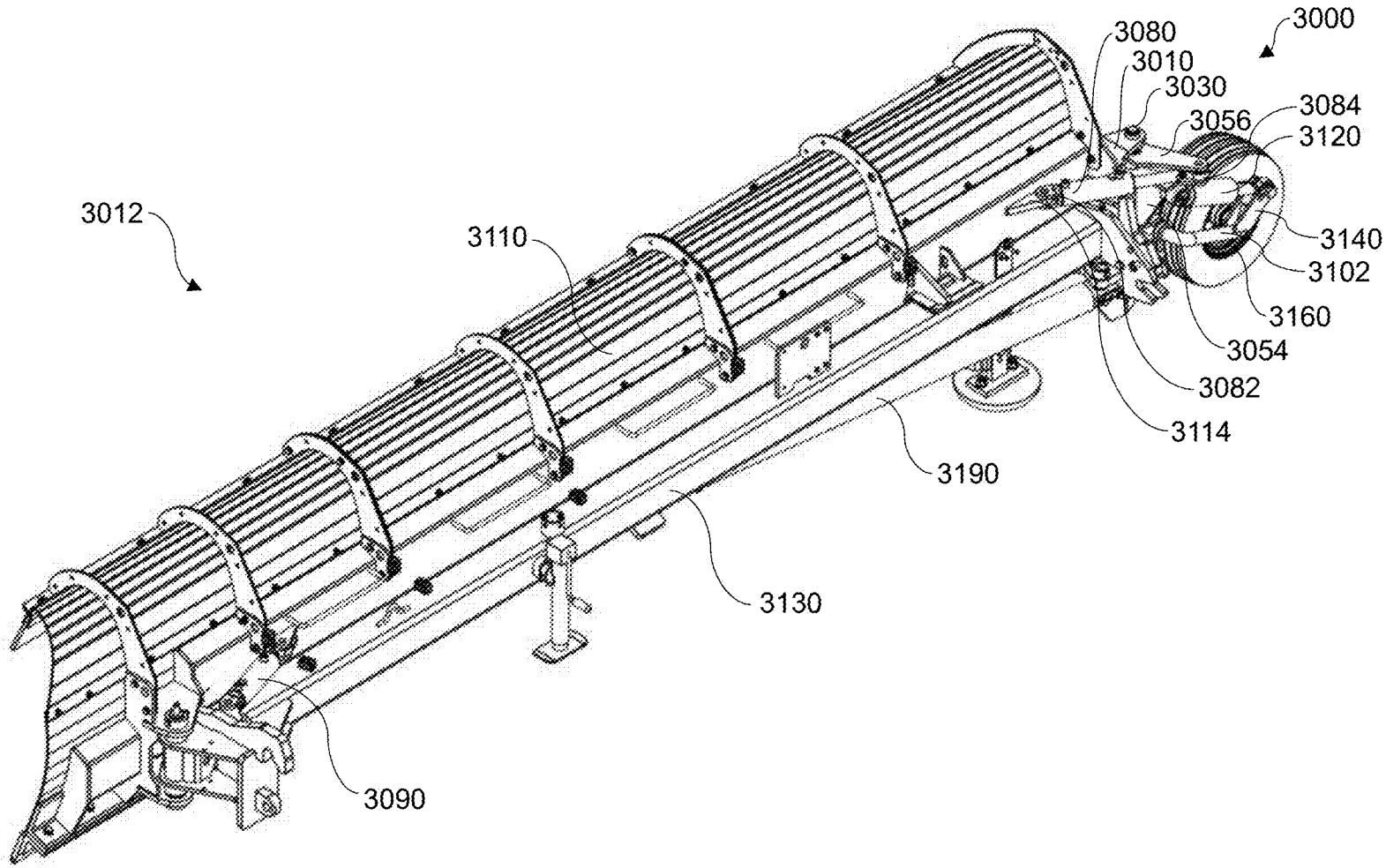
FIG. 38 is a front right upper perspective view of the support-wheel assembly of FIG. 37 in a mounted position on a moldboard, according to the present disclosure, with the moldboard in a retracted position.
Figure 39:
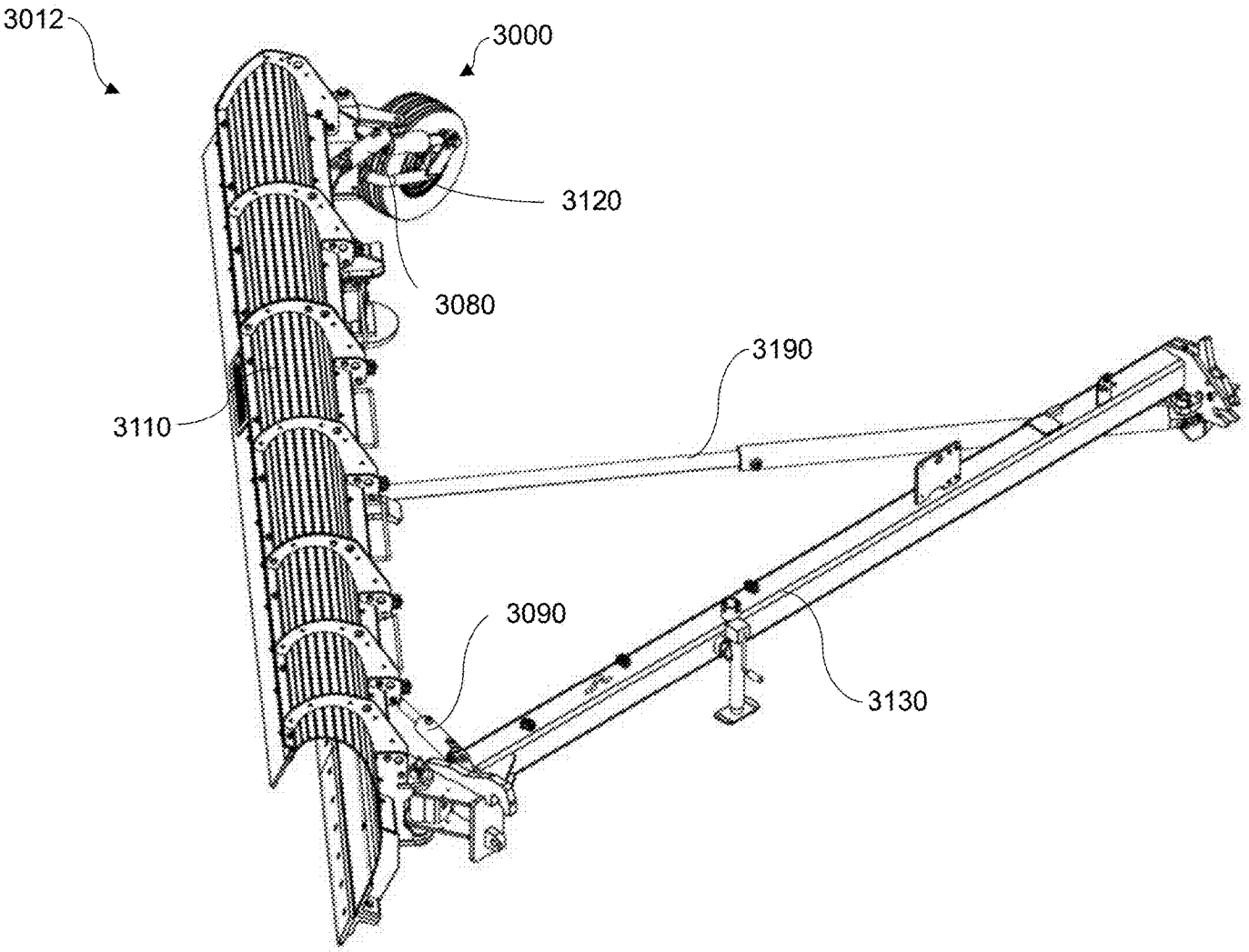
FIG. 39 is a front right upper perspective view of the support-wheel assembly of FIG. 37 in a mounted position on a moldboard, according to the present disclosure, with the moldboard in an extended position.
Figure 40:
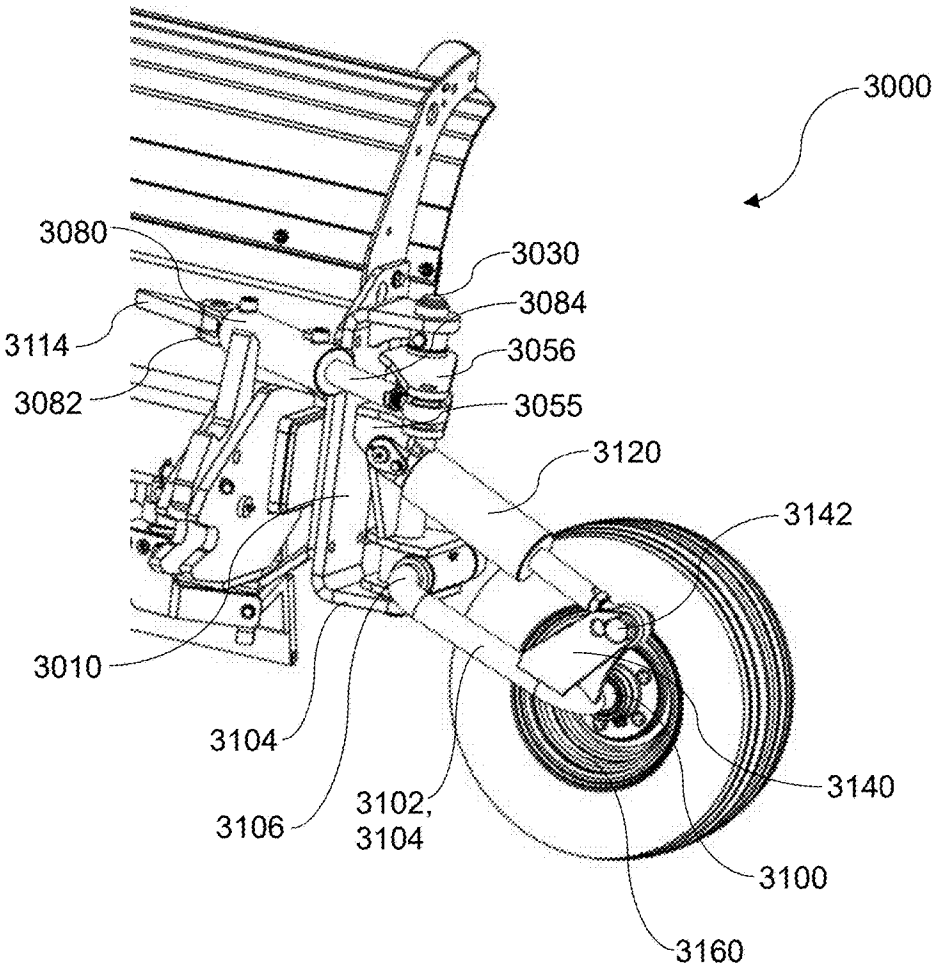
FIG. 40 is a right rear perspective view of the support-wheel assembly of FIG. 37 in a mounted position on a moldboard, according to the present disclosure.
Figure 41:
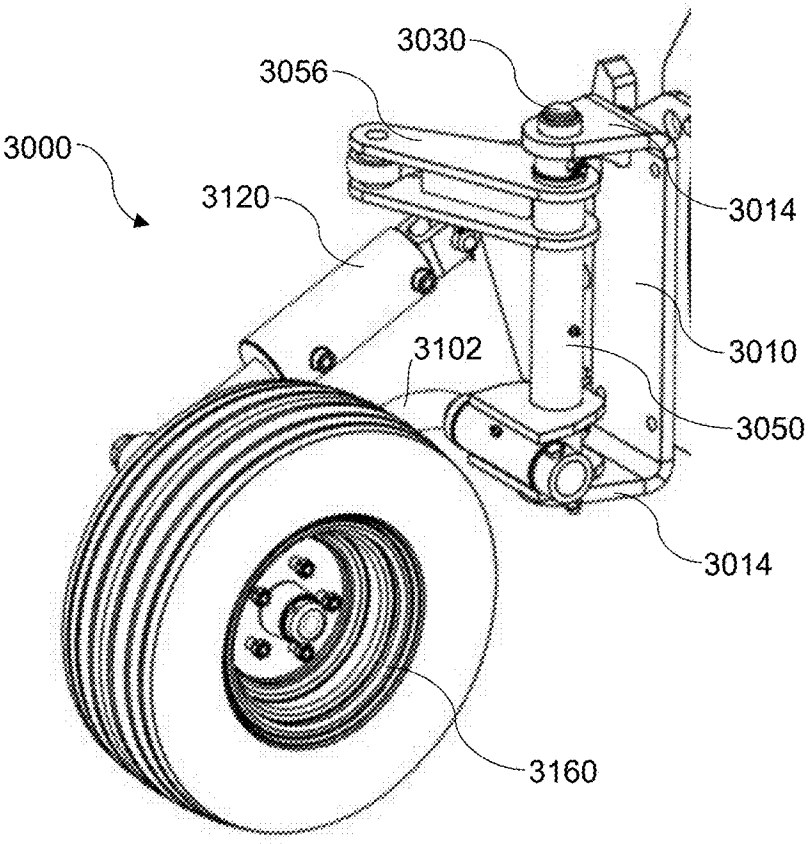
FIG. 41 is a left rear perspective view of the support-wheel assembly of FIG. 37, according to the present disclosure.

Referring to FIGS. 38 and 39, the moldboard 3110 is operatively attached to a frame 3130, which may be, for example, a frame extending parallel to a length of the vehicle (only the frame 3130 is shown) to which the moldboard 3110 is attached. An actuator 3190, shown as a hydraulic cylinder, may be extended or contracted to move the moldboard 3110 from a retracted position (FIG. 38) to an extended position (FIG. 39).

Figure 43:
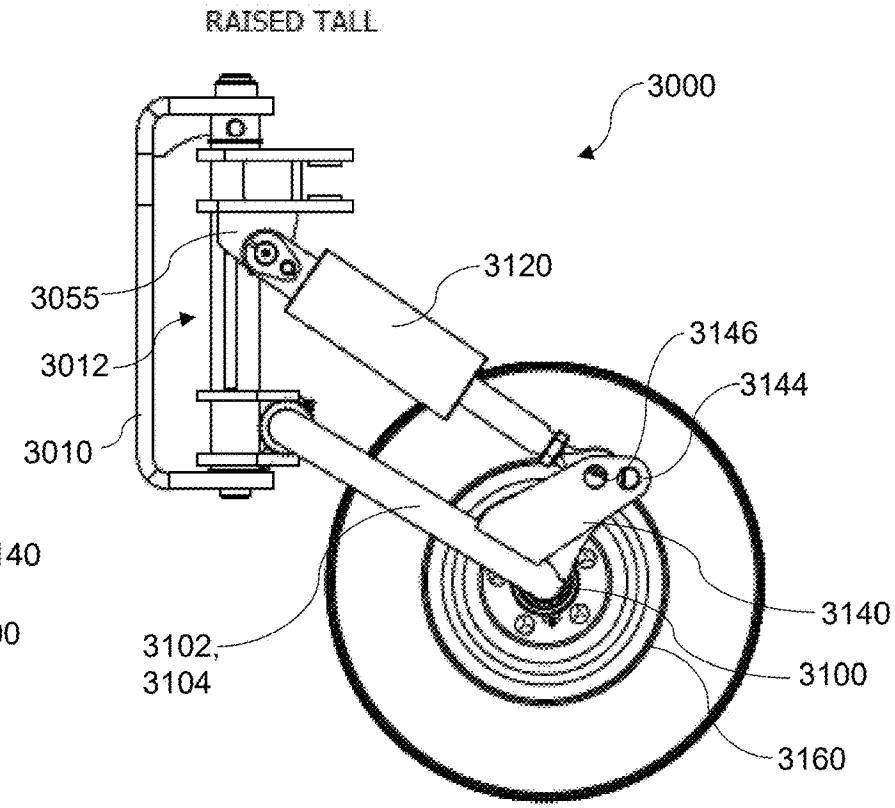
FIG. 43 is a right side elevational view of the support-wheel assembly of FIG. 37, according to the present disclosure, shown in a raised tall configuration.
Figure 42:
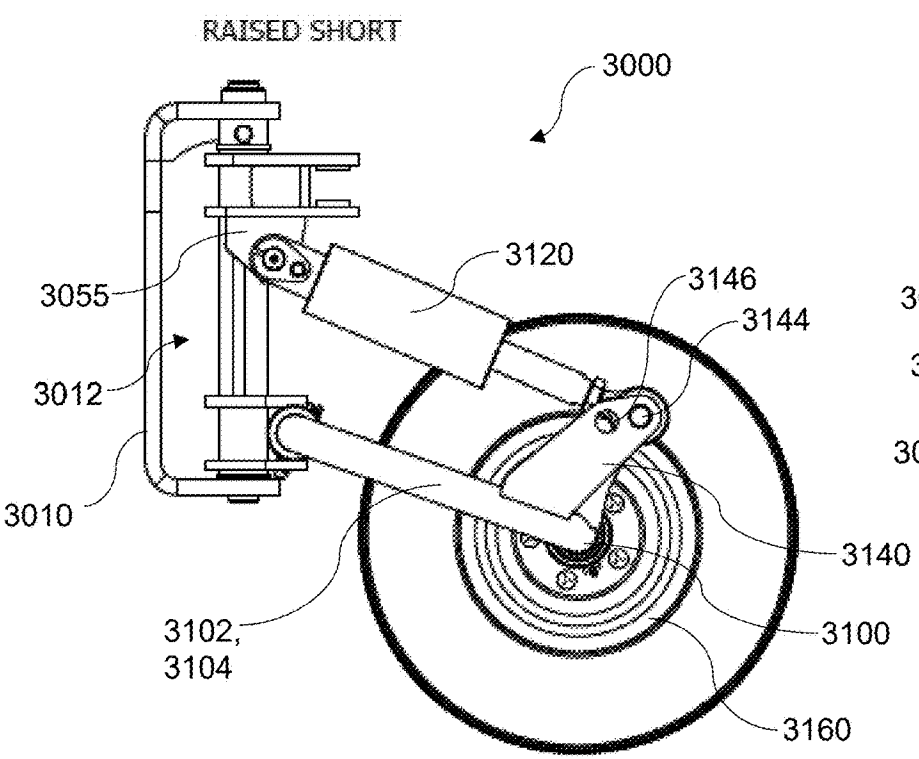
FIG. 42 is a right side elevational view of the support-wheel assembly of FIG. 37, according to the present disclosure, shown in a raised short configuration.
Figure 45:
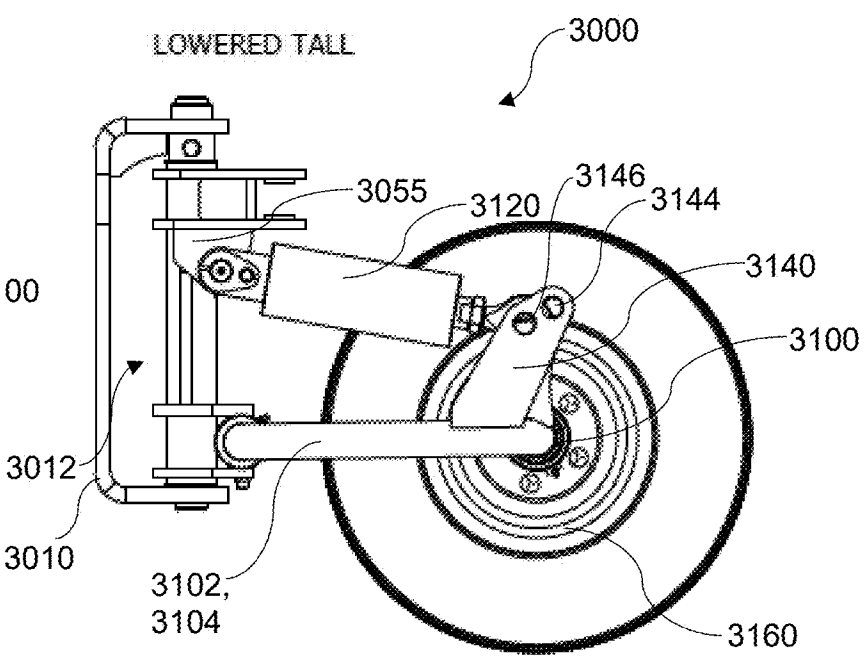
FIG. 45 is a right side elevational view of the support-wheel assembly of FIG. 37, according to the present disclosure, shown in a lowered tall configuration.
Figure 44:
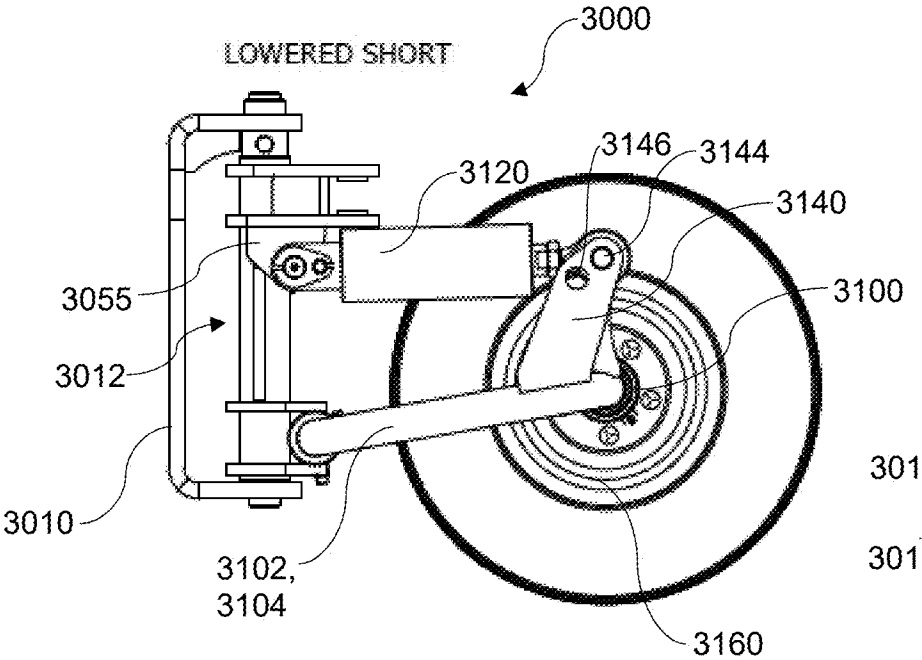
FIG. 44 is a right side elevational view of the support-wheel assembly of FIG. 37, according to the present disclosure, shown in a lowered short configuration.
Figure 46:
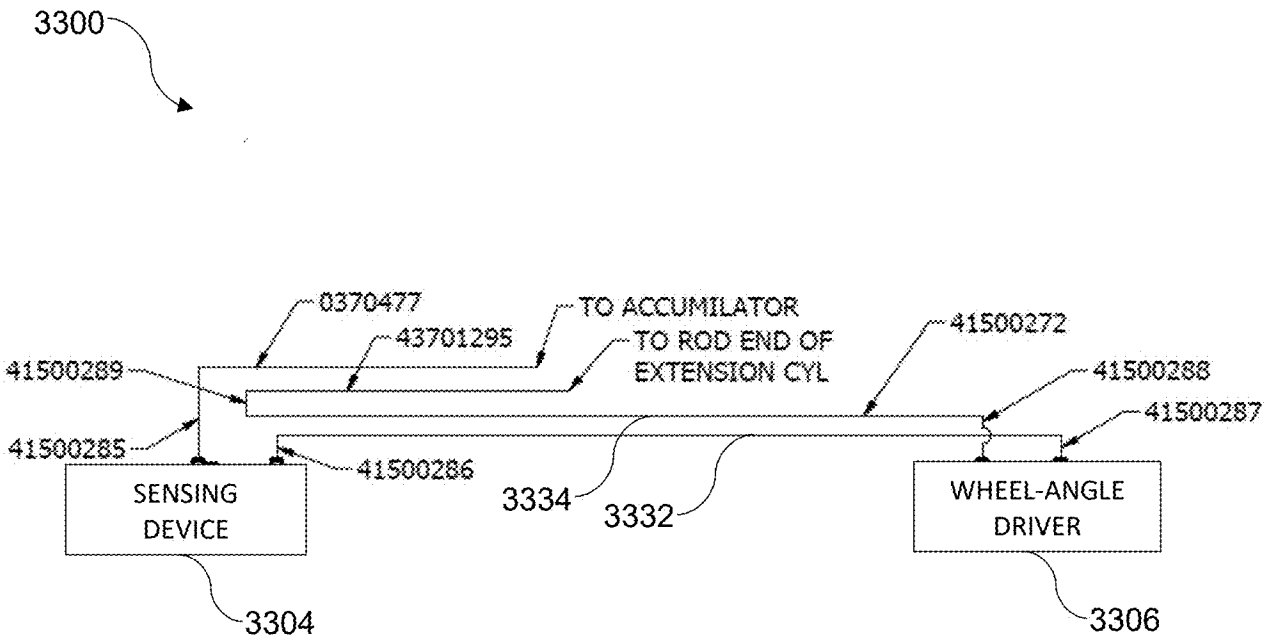
FIG. 46 is a schematic view of a control arrangement for the support-wheel assembly of FIG. 37.
Figure 47:
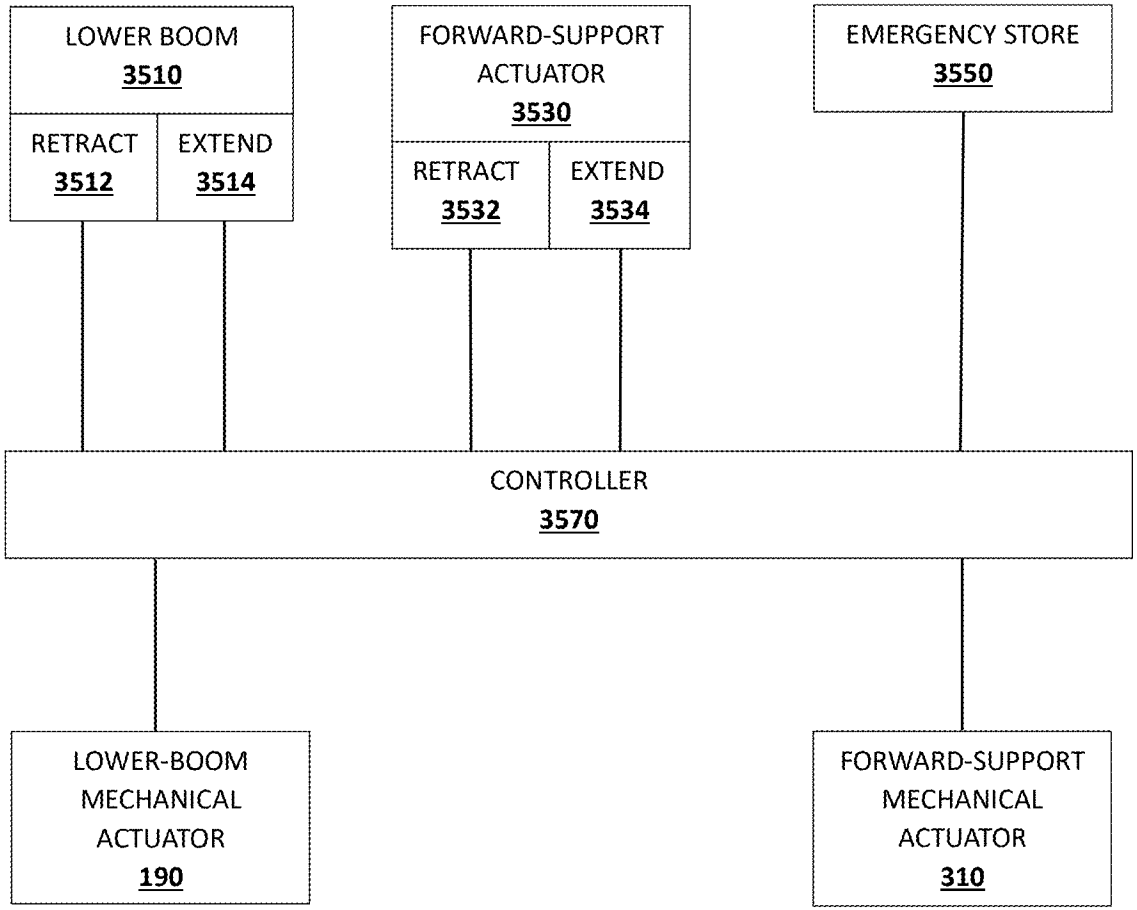
FIG. 47 is a schematic diagram of a control scheme for use with a support assembly according to the present disclosure.

Referring to FIGS. 42-45, the support assembly 3000 is capable of positioning the spindle 3100 and the wheel 3160 in various heights and configurations. For example, the support assembly 3000 may be configured in either a short configuration or a tall configuration, depending on the desired raised height and lowered height at which the moldboard 3110 is to be supported. In the short configuration, as shown in FIGS. 42 and 44, the wheel-height actuator 3120 is operatively attached to the crank arm 3140 at a first actuator-engagement hole 3144. In the tall configuration, as shown in FIGS. 43 and 45, the wheel-height actuator 3120 is operatively attached to the crank arm 3140 at a second actuator-engagement hole 3146. In the lowered positions of FIGS. 44 and 45, the wheel-height actuator 3120 is in a contracted configuration, whereas in the raised positions, of FIGS. 42 and 43, the wheel-height actuator 3120 is in an extended configuration and acts upon the spindle arm 3102 by way of the crank arm 3140 to push the wheel 3160 to raise the travel-angle frame 3012, thus raising the moldboard 3110.

Referring to FIGS. 37-46, a control arrangement 3300 may be provided interconnecting the travel-angle actuator 3080 and the wheel-height actuator 3120 for coordinated control thereof. A sensing device 3304 may be operatively connected to a wheel-angle driver 3306 to maintain the wheel 3160 in alignment with the path of travel. The sensing device may take the form of a master cylinder 3090 disposed to be extended and contracted as the moldboard 3110 is rotated with respect to frame 3130 by the actuator 3190. The wheel-angle driver 3306 may take the form of the travel-angle actuator 3080, which may take the form of a cylinder (as shown) that extends and contracts when the master cylinder 3090 extends and contracts. The relationship between the master cylinder 3090 and the travel-angle actuator 3080 may by obtained by connecting the piston ends and the rod ends of the master cylinder 3090 and the travel-angle actuator 3080 together so that when the master cylinder 3090 extends, the travel-angle actuator 3080 extends, and when the master cylinder 3090 contracts, the travel-angle actuator 3080 contracts. The cylinders may be selected to have the same dimensions or the same volume, so that the movement of the travel-angle actuator 3080 is proportional to the movement of the master cylinder 3090. This arrangement may result in maintaining the wheel-height actuator 3120 and the wheel 3160 in alignment parallel to the frame 3130 during extension and retraction of the moldboard 3110. The same or a similar control scheme may be implemented through an electronic controller, which could provide phased or otherwise coordinated movement through electronic control of the travel-angle actuator 3080 and the wheel-height actuator 3120. The sensing device 3304 could be an electronic sensor such as a potentiometer, an electronic angle sensor or position sensor, or another suitable device capable of generating a signal relating to angular movement of the wing moldboard 3110. The wheel-angle driver 3306 could be an electrically controlled or driven device such as a motor, a solenoid, or an electrically controlled hydraulic device.

A plowing system may comprise a vehicle 102; a moldboard 3110 operatively connected to the vehicle 102, the moldboard 3110 having a wheel-engaging configuration wherein a lower edge of moldboard 3110 is placed less than 18 inches above a level-ground surface; and the support-wheel assembly 3000 as disclosed herein, the support-wheel assembly 3000 being operatively connected to the moldboard 3110 to support the moldboard 3110 when the moldboard 3110 is in the wheel-engaging configuration.

Note that several variations of components disclosed herein are within the scope of the present disclosure. For example, in any embodiment of the support assembly 100, the wing moldboard 1110, 2110 may be adapted by selection of dimensions, material, and the like, for plowing snow, or for plowing soil or other material as desired. Moreover, a control arrangement similar to the control arrangement 2600 of FIG. 28B may be employed with the travel-angle actuator 3080 and the wheel-height actuator 3120, substituting one of the travel-angle actuator 3080 and the wheel-height actuator 3120 for the lower cylinder 2590, and the other of the travel-angle actuator 3080 and the wheel-height actuator 3120 for the upper cylinder 210, otherwise interconnected with lines and accumulators as shown in FIG. 28B.

The present disclosure also includes methods of installing and using any support assembly within the scope of the description above, including embodiments wherein steps may be omitted—for example, where a component has been omitted and so is not assembled or used. A method of installing a plowing system may include installation of any combination of the devices and systems disclosed herein. A method of operating a plowing system may include operation of any combination of the devices and systems disclosed herein.

It will be appreciated by those skilled in the art that various modifications and alterations could be made to the disclosure above without departing from the broad inventive concepts thereof. It is understood, therefore, that this invention is not limited to the particular embodiments disclosed, but it is intended to cover modifications within the spirit and scope of the present invention.

I claim:

1. A support assembly for a wing moldboard, comprising:

a rearward base configured to be secured to a vehicle to pivot with respect to the vehicle about an upright axis;

a lower boom having a proximal end portion and a distal end portion, the proximal end portion configured to be secured to the rearward base to pivot with respect thereto about a lower-boom pivoting axis, the lower-boom pivoting axis being horizontal, wherein the lower boom extends upwardly with respect to the rearward base so that the distal end portion is located above the proximal end portion;

an upper boom having an upper-boom proximal portion and an upper-boom distal portion, the upper-boom proximal portion being configured to be secured to the distal end portion of the lower boom to pivot the upper boom with respect to the lower boom about an upper-boom pivoting axis, the upper-boom pivoting axis being horizontal, wherein the upper-boom distal portion extends at least partially downwardly from the distal end portion of the lower boom and being configured to be secured to the wing moldboard;

a lower-boom mechanical actuator configured to be operatively connected to the lower boom to drive the lower boom between a first lower-boom position having a fixed portion of the lower boom displaced a first horizontal distance from the rearward base, and a second lower-boom position with the fixed portion of the lower boom displaced a second horizontal distance from the rearward base, the second horizontal distance being greater than the first horizontal distance; and a rotation member having a rotation-member proximal portion and a rotation-member distal portion, the rotation-member proximal portion being configured to be operatively engaged with the rearward base, and the rotation-member distal portion being configured to be operatively engaged with the upper boom to pivot the upper boom with respect to the lower boom when the lower-boom mechanical actuator drives the lower boom between the first lower-boom position and the second lower-boom position.

2. The support assembly of claim 1, wherein the wing moldboard is adapted for plowing snow.

3. The support assembly of claim 1, wherein the lower-boom mechanical actuator comprises a hydraulic cylinder.

4. The support assembly of claim 1, wherein the rotation member has a rotation-member length and the rotation member further comprises a rotation-member mechanical actuator configured to extend and contract the rotation-member length.

5. The support assembly of claim 4, wherein the rotation-member mechanical actuator comprises a hydraulic cylinder.

6. The support assembly of claim 5, wherein the lower-boom mechanical actuator comprises a hydraulic cylinder.

7. The support assembly of claim 1, wherein the upper boom has a pivot arm operatively engaged with the rotation-member distal portion.

8. The support assembly of claim 1, further comprising a wing moldboard, the wing moldboard having a forward portion, a rearward portion, and a lower edge, with the rearward portion being supported by the upper-boom distal portion.

9. The support assembly of claim 8, wherein the support assembly has a ground-proximity configuration wherein the lower edge of the wing moldboard is placed either in contact with a level-ground surface or less than six inches above the level-ground surface, and a storage configuration wherein the lower edge of the wing moldboard is placed between ground level and 40 inches above the level-ground surface and aligned with a body of the vehicle, so that the support assembly is selectively movable between the ground-proximity configuration and the storage configuration by extension and retraction of the lower-boom mechanical actuator, and a vertical position of the rearward portion of the wing moldboard is determined at least in part by a degree of extension of the lower-boom mechanical actuator.

10. The support assembly of claim 8, wherein the support assembly has a ground-proximity configuration wherein the lower edge of the wing moldboard is placed either in contact with a level-ground surface or less than six inches above the level-ground surface and a storage configuration wherein the lower edge of the wing moldboard is placed between ground level and 40 inches above the level-ground surface and aligned with a body of the vehicle, so that the support assembly is selectively movable between the ground-proximity configuration and the storage configuration by extension and retraction of the lower-boom mechanical actuator, so that a movement of the support assembly from the ground-proximity configuration to the storage configuration is determined at least in part by retraction of the lower-boom mechanical actuator.

11. The support assembly of claim 8, wherein the support assembly has a ground-proximity configuration wherein the lower edge of the wing moldboard is placed either in contact with a level-ground surface or less than six inches above the level-ground surface, and a benching configuration wherein the lower edge of the wing moldboard is placed at least 2 feet above the level-ground surface.

12. The support assembly of claim 8, wherein the support assembly has a ground-proximity configuration wherein the lower edge of the wing moldboard is placed either in contact with a level-ground surface or less than six inches above the level-ground surface, and a benching configuration wherein the lower edge of the wing moldboard is placed at least 2 feet above the level-ground surface, and wherein a rotation-member length in the ground-proximity configuration is greater than the rotation-member length in the benching configuration, so that the support assembly is selectively movable between the ground-proximity configuration and the benching configuration by extension and retraction of a rotation-member mechanical actuator.

13. The support assembly of claim 1, further comprising:

a central leveling link operatively engaged with the lower boom;

a moldboard-support link operatively engaged with the upper-boom distal portion of the upper boom, the moldboard-support link configured to engage and support the wing moldboard;

an outer leveling link having an outer-leveling-link proximal portion and an outer-leveling-link distal portion, the outer-leveling-link proximal portion being configured to be operatively engaged with a first portion of the central leveling link, and the outer-leveling-link distal portion being configured to be operatively engaged with the moldboard-support link; and an inner leveling link having an inner-leveling-link proximal portion and an inner-leveling-link distal portion, the inner-leveling-link proximal portion being configured to be operatively engaged with the rearward base, and the inner-leveling-link distal portion being configured to be operatively engaged with a second portion of the central leveling link;

wherein the inner leveling link, the central leveling link, and the outer leveling link are configured to pivot the moldboard-support link with respect to the lower boom when the lower-boom mechanical actuator drives the lower boom between the first lower-boom position and the second lower-boom position, so that the moldboard-support link maintains a selected angular orientation of the wing moldboard during motion of the lower boom.

14. The support assembly of claim 13, further comprising:

a connector link pivotably attached to the lower-boom mechanical actuator and to the lower boom; and a shear pin configured and located to prevent pivoting of the connector link with respect to the lower boom, the shear pin being configured to fail at a selected load, thereby allowing the connector link to pivot with respect to the lower boom to reduce a force transmitted from the wing moldboard to the support assembly.

15. The support assembly of claim 14, wherein the shear pin is operatively engaged with the wing moldboard by the upper boom and the lower boom.

16. The support assembly of claim 1, further comprising:

a forward moldboard-support assembly including:

a forward hinge mount movable from a first height to a second height; and a forward moldboard hinge operatively connected to the forward hinge mount.

17. The support assembly of claim 16, wherein the forward moldboard hinge includes:

a proximal leaf element configured to be operatively connected to the forward hinge mount; and a distal leaf element configured to be operatively connected to the proximal leaf element and to the wing moldboard.

18. The support assembly of claim 4, further comprising a control arrangement wherein the lower-boom mechanical actuator and the rotation-member mechanical actuator are configured to provide a phased movement in response to a single control input, and wherein the phased movement includes an extension of the rotation-member mechanical actuator followed by an extension of the lower-boom mechanical actuator.

19. The support assembly of claim 18, wherein the lower-boom mechanical actuator is a lower cylinder and the rotation-member mechanical actuator is an upper cylinder;

the upper cylinder is a hydraulic cylinder;

the control arrangement includes an extend control valve configured to selectively permit and block hydraulic flow to the lower cylinder via an extension line and a contraction line;

the contraction line is operatively connected to both a return to the extend control valve and a parallel connection to an accumulator;

a bench control valve is configured to selectively permit and block hydraulic flow to the upper cylinder via an extension line and a contraction line; and the contraction line is operatively connected to provide a return to the bench control valve, a parallel connection to an accumulator, and a further parallel connection to the extension line of the lower cylinder.

20. A plowing system comprising:

a vehicle;

a wing moldboard operatively connected to the vehicle; and a support assembly for the wing moldboard, the support assembly comprising:

a rearward base configured to be secured to a vehicle to pivot with respect to the vehicle about an upright axis;

a lower boom having a proximal end portion and a distal end portion, the proximal end portion configured to be secured to the rearward base to pivot with respect thereto about a lower-boom pivoting axis, the lower-boom pivoting axis being horizontal, wherein the lower boom extends upwardly with respect to the rearward base so that the distal end portion is located above the proximal end portion;

an upper boom having an upper-boom proximal portion and an upper-boom distal portion, the upper-boom proximal portion being configured to be secured to the distal end portion of the lower boom to pivot the upper boom with respect to the lower boom about an upper-boom pivoting axis, the upper-boom pivoting axis being horizontal, wherein the upper-boom distal portion extends at least partially downwardly from the distal end portion of the lower boom;

a lower-boom mechanical actuator configured to be operatively connected to the lower boom to drive the lower boom between a first lower-boom position having a fixed portion of the lower boom displaced a first horizontal distance from the rearward base, and a second lower-boom position with the fixed portion of the lower boom displaced a second horizontal distance from the rearward base, the second horizontal distance being greater than the first horizontal distance; and a rotation member having a rotation-member proximal portion and a rotation-member distal portion, the rotation-member proximal portion being configured to be operatively engaged with the rearward base, and the rotation-member distal portion being configured to be operatively engaged with the upper boom to pivot the upper boom with respect to the lower boom when the lower-boom mechanical actuator drives the lower boom between the first lower-boom position and the second lower-boom position;

wherein the support assembly is operatively connected to both the vehicle and the wing moldboard, thereby operatively connecting the wing moldboard to the vehicle.

21. The plowing system of claim 20, wherein the support assembly further comprises:

a forward moldboard-support assembly including:

a forward hinge mount movable from a first height to a second height; and a forward moldboard hinge operatively connected to the forward hinge mount.

22. The plowing system of claim 20, wherein:

wherein the rotation member has a rotation-member length and the rotation member further comprises a rotation-member mechanical actuator configured to extend and contract the rotation-member length;

wherein the support assembly further comprises a control arrangement wherein the lower-boom mechanical actuator and the rotation-member mechanical actuator are configured to provide a phased movement in response to a single control input, and wherein the phased movement includes an extension of the rotation-member mechanical actuator followed by an extension of the lower-boom mechanical actuator; and wherein:

the lower-boom mechanical actuator is a lower cylinder and the rotation-member mechanical actuator is an upper cylinder;

the upper cylinder is a hydraulic cylinder;

the control arrangement includes an extend control valve configured to selectively permit and block hydraulic flow to the lower cylinder via an extension line and a contraction line;

the contraction line is operatively connected to both a return to the extend control valve and a parallel connection to an accumulator;

a bench control valve is configured to selectively permit and block hydraulic flow to the upper cylinder via an extension line and a contraction line; and the contraction line is operatively connected to provide a return to the bench control valve, a parallel connection to an accumulator, and a further parallel connection to the extension line of the lower cylinder.

23. A plowing system comprising:

a vehicle;

a wing moldboard operatively connected to the vehicle and having a forward portion, a rearward portion, and a lower edge; and a support assembly operatively connected to the rearward portion of the wing moldboard and including:

a rearward base configured to be secured to the vehicle to pivot with respect to the vehicle about an upright axis;

a lower boom having a proximal end portion and a distal end portion, the proximal end portion configured to be secured to the rearward base to pivot with respect thereto about a lower-boom pivoting axis, the lower-boom pivoting axis being horizontal, wherein the lower boom extends upwardly with respect to the rearward base so that the distal end portion is located above the proximal end portion;

an upper boom having an upper-boom proximal portion and an upper-boom distal portion, the upper-boom proximal portion being configured to be secured to the distal end portion of the lower boom to pivot the upper boom with respect to the lower boom about an upper-boom pivoting axis, the upper-boom pivoting axis being horizontal, wherein the upper-boom distal portion extends at least partially downwardly from the distal end portion of the lower boom;

a lower-boom mechanical actuator configured to be operatively connected to the lower boom to drive the lower boom between a first lower-boom position having a fixed portion of the lower boom displaced a first horizontal distance from the rearward base, and a second lower-boom position with the fixed portion of the lower boom displaced a second horizontal distance from the rearward base, the second horizontal distance being greater than the first horizontal distance;

a rotation member having a rotation-member proximal portion and a rotation-member distal portion, the rotation-member proximal portion being configured to be operatively engaged with the rearward base, and the rotation-member distal portion being configured to be operatively engaged with the upper boom to pivot the upper boom with respect to the lower boom when the lower-boom mechanical actuator drives the lower boom between the first lower-boom position and the second lower-boom position;

wherein the support assembly has a ground-proximity configuration wherein the lower edge of the wing moldboard is placed either in contact with a level-ground surface or less than six inches above the level-ground surface, and a storage configuration wherein the lower edge of the wing moldboard is placed between ground level and 40 inches above the level-ground surface and is generally aligned with a body of the vehicle, so that the support assembly is selectively movable between the ground-proximity configuration and the storage configuration by extension and retraction of the lower-boom mechanical actuator, and a vertical position of the rearward portion of the wing moldboard is determined at least in part by a degree of extension of the lower-boom mechanical actuator;

a forward moldboard-support assembly including a forward hinge mount operatively connected to a forward-support mechanical actuator for raising and lowering the forward hinge mount, the forward moldboard-support assembly being operatively connected to the forward portion of the wing moldboard; and a control arrangement including a controller operatively connected to the support assembly and to the forward moldboard-support assembly, the controller configured for retracting the wing moldboard from the ground-proximity configuration to the storage configuration, the controller including:

a single input for causing both the support assembly and the forward support assembly to move the wing moldboard into the storage position.

24. The plowing system of claim 23, wherein the single input consists essentially of a single switch for causing both the lower-boom mechanical actuator and the forward-support mechanical actuator to move the wing moldboard to the storage position.

25. The plowing system of claim 24, wherein in response to the single input, both the lower-boom mechanical actuator and the forward-support mechanical actuator begin moving to the storage position within less than about 1 second.

26. The plowing system of claim 24, wherein in response to the single input, wherein the wing moldboard reaches the storage position without striking any portion of the body of the vehicle.

27. The plowing system of claim 25, wherein both the lower-boom mechanical actuator and the forward-support mechanical actuator continue moving until the wing moldboard reaches the storage position, without either of the lower-boom mechanical actuator and the forward-support mechanical actuator pausing to allow one of the lower-boom mechanical actuator and the forward-support mechanical actuator to complete a movement.

28. The plowing system of claim 23, wherein the single input consists essentially of a single retraction-initiator actuator for causing both the lower-boom mechanical actuator and the forward-support mechanical actuator to move the wing moldboard to the storage position.

* * * * *